US008655234B2

(12) United States Patent
Hori et al.

(10) Patent No.: US 8,655,234 B2
(45) Date of Patent: Feb. 18, 2014

(54) TONER SUPPLY ASSEMBLY AND IMAGE FORMING APPARATUS INCORPORATING SAME

(75) Inventors: Eisuke Hori, Tokyo (JP); Nobuo Takami, Kanagawa (JP); Yuji Suzuki, Tokyo (JP); Noriyuki Kimura, Kanagawa (JP); Hideki Kimura, Kanagawa (JP); Kenji Kikuchi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 302 days.

(21) Appl. No.: 13/198,097

(22) Filed: Aug. 4, 2011

(65) Prior Publication Data

US 2012/0033998 A1 Feb. 9, 2012

(30) Foreign Application Priority Data

Aug. 9, 2010 (JP) ..... 2010-178512

(51) Int. Cl.
*G03G 15/08* (2006.01)

(52) U.S. Cl.
USPC ..... 399/258

(58) Field of Classification Search
USPC ..... 399/260, 258, 262
See application file for complete search history.

(56) References Cited

U.S. PATENT DOCUMENTS

| | | | | |
|---|---|---|---|---|
| 5,537,197 | A | 7/1996 | Fujishiro et al. | |
| 5,565,973 | A | 10/1996 | Fujishiro et al. | |
| 5,655,193 | A | 8/1997 | Fujishiro et al. | |
| 6,442,364 | B2 | 8/2002 | Kai et al. | |
| 7,043,182 | B2 | 5/2006 | Sakai et al. | |
| 7,248,824 | B2 | 7/2007 | Takami | |
| 7,389,071 | B2 | 6/2008 | Katsuyama et al. | |
| 7,457,564 | B2 | 11/2008 | Takami | |
| 7,769,316 | B2 | 8/2010 | Kimura | |
| 7,787,784 | B2 | 8/2010 | Hori | |
| 7,813,680 | B2 | 10/2010 | Masuda et al. | |
| 7,974,556 | B2 | 7/2011 | Hori et al. | |
| 2007/0269227 | A1 * | 11/2007 | Sato | 399/260 |

(Continued)

FOREIGN PATENT DOCUMENTS

| | | |
|---|---|---|
| JP | 4-1681 | 1/1992 |
| JP | 2002-268344 | 9/2002 |
| JP | 4423140 | 12/2009 |

OTHER PUBLICATIONS

U.S. Appl. No. 13/075,641, filed Mar. 30, 2011, Yuki Oshikawa et al.

*Primary Examiner* — Susan Lee
(74) *Attorney, Agent, or Firm* — Oblon, Spivak, McClelland, Maier & Neustadt, L.L.P.

(57) ABSTRACT

A toner supply assembly includes a toner container mount and a toner container including a container body, a cap having a toner outlet, and a shutter for the toner outlet, to move horizontally. The cap includes a shutter guide rail, a contact portion, and a pressed rail provided on a lateral side. The shutter includes a shutter body to engage the shutter guide rail and a deformable portion deformable vertically and including a stopper to contact the contact portion of the cap for inhibiting the shutter from opening the toner outlet, and a stopper release projection pressed by a bottom projection on a bottom surface of the toner container mount in conjunction with installation of the toner container. A pressing member provided in a side portion of the toner container mount engages the pressed rail of the cap, inhibiting the cap from moving upward.

11 Claims, 39 Drawing Sheets

(56) References Cited

U.S. PATENT DOCUMENTS

2009/0103955 A1* 4/2009 Takuwa ..... 399/260
2009/0245882 A1 10/2009 Ozeki et al.
2009/0245889 A1 10/2009 Koetsuka et al.
2010/0003055 A1 1/2010 Kikuchi et al.
2010/0129118 A1 5/2010 Kimura et al.
2011/0058857 A1 3/2011 Hori et al.

* cited by examiner

TONER SUPPLY ASSEMBLY AND IMAGE FORMING APPARATUS INCORPORATING SAME

CROSS-REFERENCE TO RELATED APPLICATIONS

This patent application is based on and claims priority pursuant to 35 U.S.C. §119 to Japanese Patent Application No. 2010-178512, filed on Aug. 9, 2010, in the Japanese Patent Office, the entire disclosure of which is hereby incorporated herein by reference.

FIELD OF THE INVENTION

The present invention generally relates to a toner supply assembly in which a toner container is installed and an image forming apparatus, such as a copier, a printer, a facsimile machine, or a multifunction machine capable of at least two of these functions, that includes the toner supply assembly.

BACKGROUND OF THE INVENTION

Image forming apparatuses such as copiers generally include an image forming mechanism for forming an electrostatic latent image, developing the latent image with toner, transferring the developed image onto a sheet of recording media, and fixing the image thereon. Image forming apparatuses further includes a toner supply assembly including a toner container mount in which toner containers (i.e., toner bottles) are removably installed. Toner containers are often inserted into the toner container mount horizontally.

For example, JP-H04-1681-A and JP-2002-268344-A propose toner containers including a container body (i.e., bottle body) and a cap.

When the area of a toner flow channel and that of a toner outlet formed in the toner container are relatively large, a shutter is typically used to open and close the toner outlet. The shutter may be slidable in conjunction with installation or removal of the toner container from the toner container mount so that a user's single action of moving the toner container in its longitudinal direction can attain opening or closing the toner outlet as well as installation or removal of the toner container from the toner container mount. In such a configuration, however, the shutter should be configured not to move unintentionally when the toner container is not installed in the apparatus for preventing leakage of toner from the toner container. In addition, it is necessary to ensure that the shutter opens the toner outlet in conjunction with the installation of the toner container.

SUMMARY OF THE INVENTION

In view of the foregoing, one illustrative embodiment of the present invention provides a toner supply assembly to supply toner to an image forming apparatus. The toner supply assembly includes a toner container mount provided in the image forming apparatus and a toner container removably installable in the toner container mount horizontally. The toner container mount includes a bottom slide surface on which the toner container slides, a bottom projection projecting from the bottom slide surface, and a pressing member positioned in a lateral side portion of the toner container mount.

The toner container includes a cylindrical container body having an opening in one end thereof from which toner contained in the container body is discharged, a cap, into which the end of the container body having the opening is inserted, having a toner outlet to discharge the toner discharged from the opening of the container body vertically downward, and a shutter, slidably held in a bottom portion of the cap, to move horizontally along an outer surface of the cap to open and close the toner outlet. The cap includes a shutter guide rail, a contact portion, and a pressed rail provided on a lateral side of the cap to be pressed by the pressing member of the toner container mount. The shutter includes a shutter body to engage the shutter guide rail of the cap and to slide along the shutter guide rail for opening and closing the toner outlet, and a deformable portion united with the shutter body. The deformable portion can deform pivotably in a vertical direction about a connection portion between the shutter body and the deformable portion. The deformable portion of the shutter includes a stopper to contact the contact portion of the cap for inhibiting the shutter from moving in a direction to open the toner outlet relative to the toner container, and a stopper release projection projecting downward from a bottom surface of the shutter. The stopper release projection is pressed from below by the bottom projection formed in the toner container mount when the toner container is installed in the toner container mount.

When the bottom projection formed in the toner container mount presses the stopper release projection, the deformable portion of the shutter deforms upward, disengaging the stopper from the contact portion of the cap. The pressing member of the toner container mount engages and pushes from the lateral side the pressed rail of the cap in conjunction with installation of the toner container to determine a position of the cap in the direction perpendicular to the installation direction relative to the slide bottom surface of the toner container mount. While the stopper of the shutter is in contact with the contact portion of the cap, the pressing member of the toner container mount engages the pressed rail of the cap to inhibit the cap from moving upward.

In another illustrative embodiment of the present invention, an image forming apparatus includes an image forming unit to form a toner image on a sheet of recording media and the above-described toner supply assembly.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
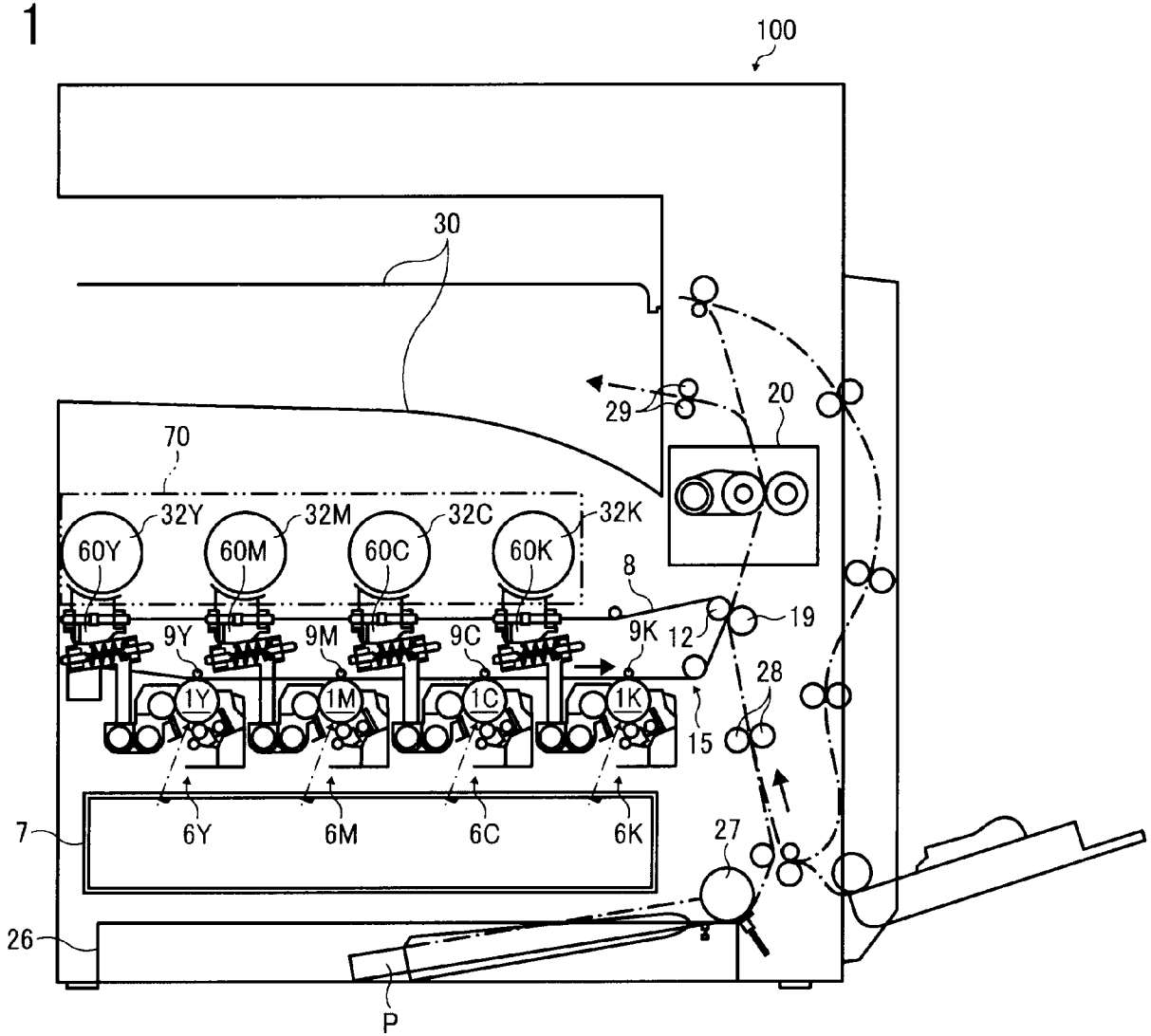
FIG. 1 is a schematic front view of an image forming apparatus according to an embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, a multicolor image forming apparatus according to an illustrative embodiment of the present invention is described.

It is to be noted that the suffixes Y, M, C, and K attached to each reference numeral indicate only that components indicated thereby are used for forming yellow, magenta, cyan, and black images, respectively, and hereinafter may be omitted when color discrimination is not necessary.

First Embodiment

An illustrative embodiment is described below with reference to FIGS. 1 to 50.

Initially, a configuration and operation of an image forming apparatus according to the present embodiment is described below.

FIG. 1 is a schematic diagram that illustrating an image forming apparatus 100 according to the first embodiment entirely. As shown in FIG. 1, a toner container frame 70 (toner container mount) is provided in an upper part of an apparatus body of the image forming apparatus 100, and four toner containers 32Y, 32M, 32C, and 32K respectively corresponding to yellow, magenta, cyan, and black are removably installed in the toner container frame 70 (also shown in FIGS. 3, 4, and 42).

An intermediate transfer unit 15 including an intermediate transfer belt 8 is provided beneath the toner container frame 70. Image forming units 6Y, 6M, 6C, and 6K respectively corresponding to yellow, magenta, cyan, and black are arranged in parallel, facing the intermediate transfer belt 8.

Toner supply devices 60Y, 60M, 60C, and 60K are provided beneath the toner containers 32Y, 32M, 32C, and 32K, respectively. Each toner supply device 60 supplies the toner contained in the corresponding toner container 32 to a development device 5 of the corresponding image forming unit 6.

Figure 2:
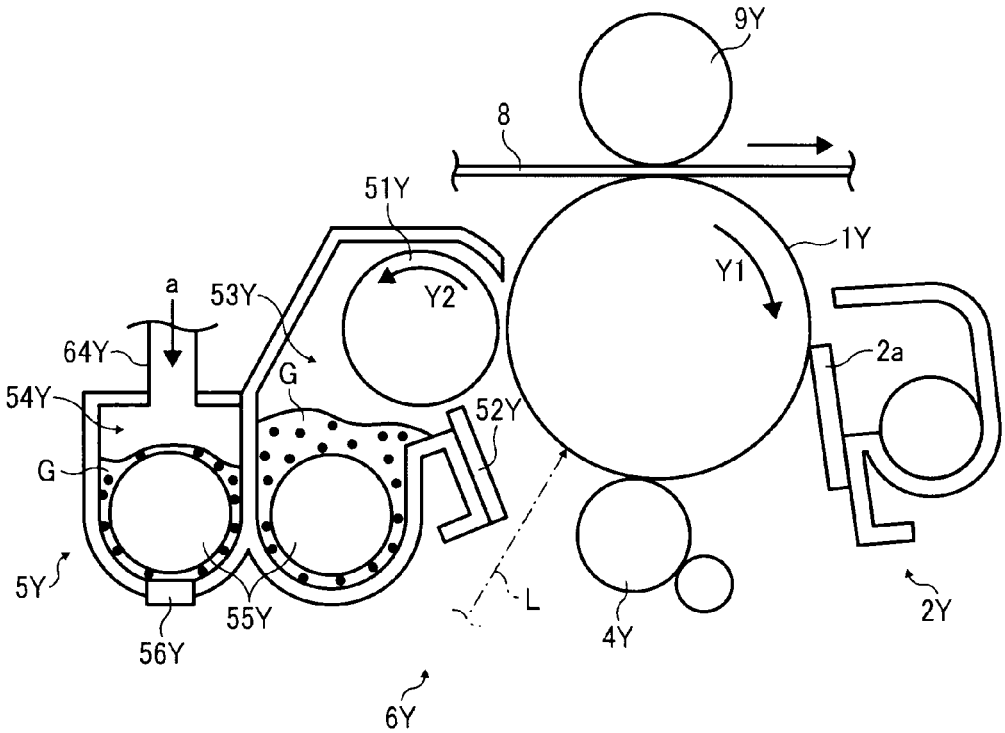
FIG. 2 is a schematic end-on axial view illustrating an image forming unit included in the image forming apparatus shown in FIG. 1.

FIG. 2 is a schematic diagram illustrating the image forming unit 6Y. Referring to FIG. 2, the image forming unit 6Y for yellow includes a photoreceptor drum 1Y and further includes a charging member 4Y, the development device 5Y, a cleaning unit 2Y, a discharger, and the like provided around the photoreceptor drum 1Y. Image forming processes, namely, charging, exposure, development, transfer, and cleaning processes are performed on the photoreceptor drum 1Y, and thus a yellow toner image is formed on the photoreceptor drum 1Y.

It is to be noted that other image forming units 6M, 6C, and 6K have a similar configuration to that of the yellow image forming unit 6Y except the color of the toner used therein and form toner images of the respective colors. Thus, only the image forming unit 6Y is described below and descriptions of other image forming units 6M, 6C, and 6K are omitted.

Referring to FIG. 2, the photoreceptor drum 1Y is rotated clockwise in FIG. 2 as indicated by arrow Y1 by a driving motor. A surface of the photoreceptor drum 1Y is charged uniformly at a position facing the charging member 4Y by the charging member 4Y (charging process).

When the photoreceptor drum 1Y reaches a position to receive a laser beam L emitted from an exposure unit 7 (shown in FIG. 1), the photoreceptor drum 1Y is scanned with the laser beam L, and thus an electrostatic latent image for yellow is formed thereon (exposure process).

Then, the photoreceptor drum 1Y reaches a position facing the development device 5Y, where the latent image is developed with toner into a yellow toner image (development process).

When the surface of the photoreceptor drum 1Y carrying the toner image reaches a position facing the primary-transfer bias roller 9Y via the intermediate transfer belt 8, the toner image is transferred therefrom onto the intermediate transfer belt 8 (primary-transfer process). After the primary-transfer process, a certain amount of toner tends to remain on the photoreceptor drum 1Y.

When the surface of the photoreceptor drum 1Y reaches a position facing the cleaning unit 2Y, a cleaning blade 2*a* of the cleaning unit 2Y mechanically collects any toner remaining on the photoreceptor drum 1Y (cleaning process). Subsequently, the discharger removes potentials remaining on the surface of the photoreceptor drum 1Y. Thus, a sequence of image forming processes performed on the photoreceptor drum 1Y is completed.

The above-described image forming processes are performed in the image forming units 6M, 6C, and 6K similarly to the yellow image forming unit 6Y. That is, the exposure unit 7 disposed above the image forming units 6 in FIG. 1 directs laser beams L according to image data onto the photoreceptor drums 1 in the respective image forming units 6. Specifically, the exposure unit 7 includes light sources to emit the laser beams L, multiple optical elements, and a polygon mirror that is rotated by a motor. The exposure unit 7 directs the laser beams L to the respective photoreceptor drums 1 via the multiple optical elements while deflecting the laser beams L with the polygon mirror.

Then, the toner images formed on the respective photoreceptor drums 1 through the development process are transferred therefrom and superimposed one on another on the intermediate transfer belt 8. Thus, a multicolor toner image is formed on the intermediate transfer belt 8.

Referring now to FIG. 1, the intermediate transfer unit 15 includes the intermediate transfer belt 8, the four primary-transfer bias rollers 9, a secondary-transfer backup roller 12, multiple tension rollers, and a belt cleaning unit. The intermediate transfer belt 8 is supported by the multiple rollers and is rotated in the direction indicated by an arrow shown in FIG. 1 as one of the multiple rollers that serves as a driving roller rotates.

The four primary-transfer bias rollers 9 are pressed against the corresponding photoreceptor drums 1 via the intermediate transfer belt 8, and four contact portions between the primary-transfer bias rollers 9 and the corresponding photoreceptor drums 1 are hereinafter referred to as primary-transfer nips. Each primary-transfer bias roller 9 receives a transfer bias whose polarity is opposite the polarity of the toner.

While rotating in the direction indicated by the arrow shown in FIG. 1, the intermediate transfer belt 8 sequentially passes through the primary transfer nips formed between the photoreceptor drums 1 and the corresponding primary-transfer bias rollers 9. Then, the single-color toner images are transferred from the respective photoreceptor drums 1 primarily and superimposed one on another on the intermediate transfer belt 8.

Then, the intermediate transfer belt 8 carrying the multicolor toner image reaches a position facing the secondary-transfer roller 19 disposed facing the secondary-transfer backup roller 12. The secondary-transfer backup roller 12 and the secondary-transfer roller 19 press against each other via the intermediate transfer belt 8, and the contact portion therebetween is hereinafter referred to as a secondary-transfer nip. The multicolor toner image formed on the intermediate transfer belt 8 is transferred onto a sheet P (recording medium) transported to the secondary-transfer nip (secondary-transfer process). A certain amount of toner tends to remain on the intermediate transfer belt 8 after the secondary-transfer process.

When the intermediate transfer belt 8 reaches a position facing the belt cleaning unit, any toner remaining on the intermediate transfer belt 8 is collected by the belt cleaning unit. Thus, a sequence of image forming processes performed on the intermediate transfer belt 8 is completed.

The sheet P is transported by a sheet feeder 26 provided in a lower portion of the image forming apparatus 100 to the secondary-transfer nip via a feed roller 27, and a pair of registration rollers 28. More specifically, the sheet feeder 26 contains multiple sheets P piled one on another. The feed roller 27 rotates counterclockwise in FIG. 1 to feed the sheet P on the top contained in the sheet feeder 26 toward a nip formed between the registration rollers 28.

The registration rollers 28 stop rotating temporarily, stopping the sheet P with a leading edge of the sheet P stuck in the nip therebetween. The registration rollers 28 resumes rotating to transport the sheet P to the secondary-transfer nip, time to coincide with the arrival of the multicolor toner image formed on the intermediate transfer belt 8. Thus, the multicolor toner image is recorded on the sheet P.

The recording medium P carrying the color toner image is sent to a fixing device 20. In the fixing device 20, a fixing belt and a pressing roller apply heat and pressure to the sheet P to fix the multicolor toner image on the sheet P.

Subsequently, the sheet P is discharged by a pair of discharge rollers 29 outside the image forming apparatus 100 and stacked as an output image on a stack tray 30 formed on an upper side of the apparatus body. Thus, a sequence of image forming processes performed in the image forming apparatus 100 is completed.

Next, a configuration and operation of the development device 5Y is described in further detail below with reference to FIG. 2.

The development device 5Y includes a development roller 51Y disposed facing the photoreceptor drum 1Y, a doctor blade 52Y disposed facing the development roller 51Y, two conveyance screws 55Y respectively disposed in developer containing compartments 53Y and 54Y, and a concentration detector 56Y to detect concentration of toner in developer G. A casing of the development device 5Y is divided, at least partially, into the developer containing compartments 53Y and 54Y. The development roller 51Y includes a magnet roller or multiple magnets fixed in position relative to the casing of the development device 5Y, a sleeve that rotates around the magnet roller, and the like. The developer containing compartments 53Y and 54Y contain two-component developer G consisting essentially of carrier (carrier particles) and toner (toner particles). An opening is formed on an upper side of the developer containing compartment 54Y, and the developer containing compartment 54Y is connected via the opening to a toner supply tube (toner supply path) 64Y through which toner is supplied from the toner container 32Y.

The development device 5Y configured as described above operates as follows.

The development sleeve of the development roller 51Y rotates in the direction indicated by arrow Y2 shown in FIG. 2. The developer carried on the development roller 51Y by the magnetic field generated by the magnets is transported in the circumferential direction of the development roller 51Y as the development sleeve rotates.

The ratio of the toner to the carrier (the concentration of toner) in the developer G contained in the development device 5Y is adjusted within a predetermined range. More specifically, the toner supply device 60Y (shown in FIG. 3) supplies toner from the toner container 32Y to the developer containing compartment 54Y according to the consumption of toner in the development device 5Y. The configuration and operation of the toner supply device 60 are described in further detail later.

The toner supplied to the developer containing compartment 54Y is mixed with the developer G therein, and the developer G is circulated in the direction perpendicular to the surface of the paper on which FIG. 2 is drawn between the two developer containing compartments 53Y and 54Y while agitated by the developer conveying screws 55Y. While the developer G is thus agitated, toner particles in the developer G are charged with friction with carrier particles and adsorbed to the carrier particles. Then, the toner particles are carried on the developing roller 51Y together with the carrier particles by a magnetic force generated on the developing roller 51Y.

The developer G carried on the development roller 51Y is transported in the direction indicated by arrow Y2 in FIG. 2 to the doctor blade 52Y. The amount of the developer G on the development roller 51Y is adjusted to a suitable amount by the doctor blade 52Y, after which the developer G is carried to the development range facing the photoreceptor drum 1Y. Then, the toner in the developer G adheres to the latent image formed on the photoreceptor drum 1Y due to the effect of the magnetic field generated in the development range. As the sleeve rotates, the developer G remaining on the developing roller 51Y reaches an upper part in the developer containing compartment 53Y and then drops from the developing roller 51Y.

Figure 3:
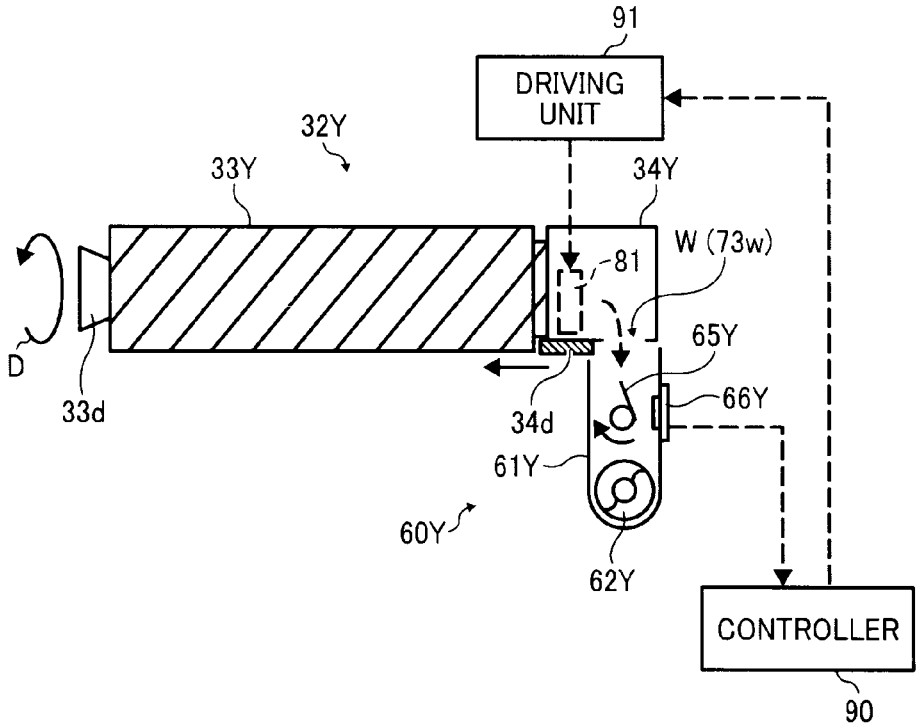
FIG. 3 is a schematic diagram illustrating a toner supply device and a toner container connected thereto included in the image forming apparatus shown in FIG. 1.

Next, referring to FIGS. 3 and 4, the toner supply devices 60Y, 60M, 60C, and 60K are described below. FIG. 3 schematically illustrates supply of toner from the toner container 32Y by the toner supply device 60Y, and FIG. 4 is a perspective view of the toner container frame 70.

Figure 4:
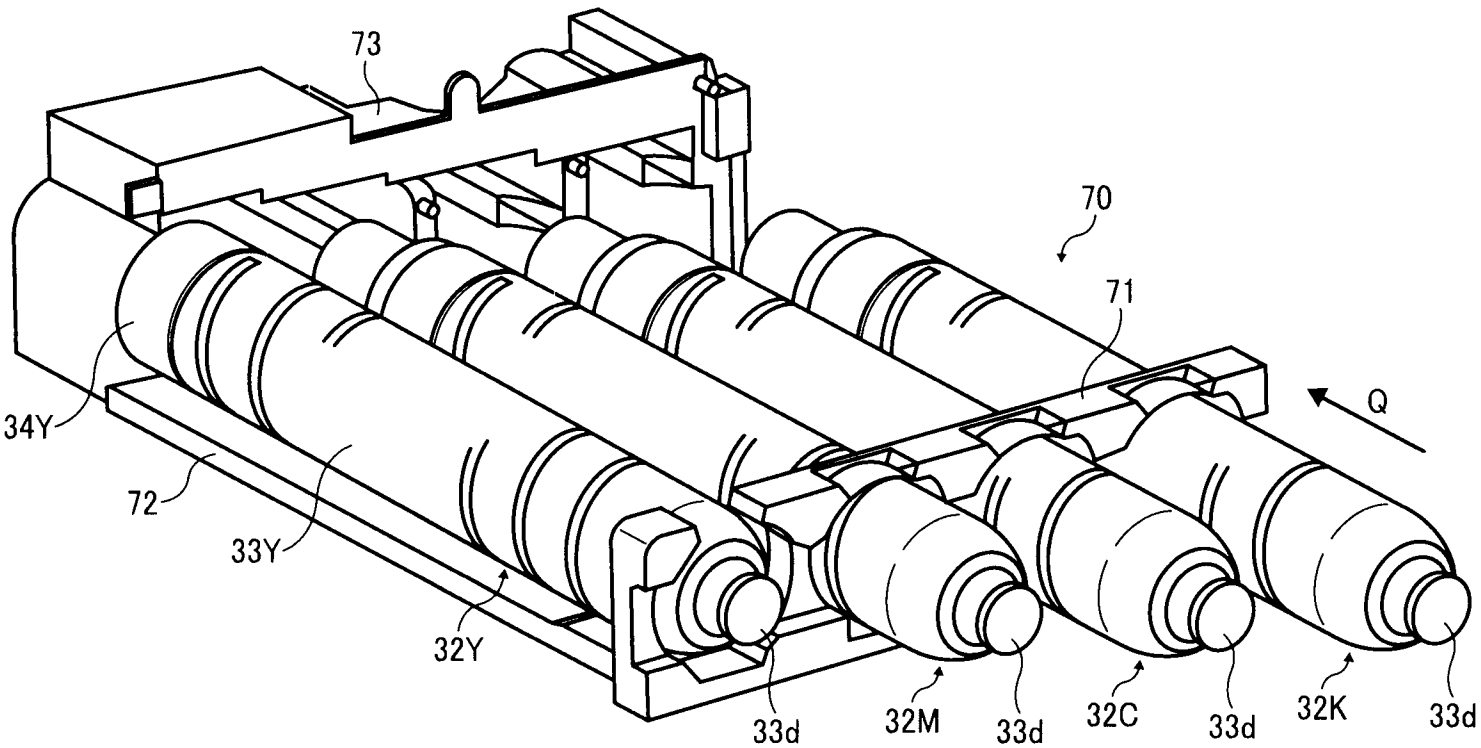
FIG. 4 is a perspective view of a toner container frame included in the image forming apparatus shown in FIG. 1, in which the toner container shown in FIG. 3 is set.

Referring to FIGS. 3 and 4, the respective color toners contained in the toner containers 32Y, 32M, 32C, and 32K mounted in the toner container frame 70 of the image forming apparatus 100 are supplied to the corresponding development devices 5Y, 5M, 5C, and 5K by the corresponding toner supply devices 60Y, 60M, 60C, and 60K according to the amount of the toner consumed.

It is to be noted that the structure of the toner supply devices 60Y, 60M, 60C, and 60K are similar, and the structure of the toner containers 32Y, 32M, 32C, and 32K are similar except the color of toner used. Therefore, only the structures for yellow are described below, omitting descriptions of other colors.

Referring to FIG. 3, the toner container 32Y is a substantially cylindrical toner bottle and includes a container body (bottle body) 33Y formed integrally with a gear 33*c* (shown in FIG. 6) and a cap 34Y. The cap 34Y is held by the toner container frame 70 so as not to rotate. Further, a toner outlet W is formed on a lower side of the cap 34Y, and the cap 34Y further includes a shutter 34*d* to open and close the toner outlet W.

It is to be noted that, in the description below, the terms "longitudinal direction" and "short side direction" mean those of the toner containers 32 unless otherwise specified, and the term "installation direction" means the direction in which the toner containers 32 are installed into the image forming apparatus 100 unless otherwise specified.

As shown in FIG. 4, when the toner container 32Y is installed in the toner container frame 70 in a direction indicated by arrow Q in FIG. 4 (hereinafter "insertion direction" or "installation direction), the shutter 34*d* (shown in FIGS. 3 and 9) of the toner container 32Y is moved in conjunction with this installation, and the toner outlet W (shown in FIG. 3) of the toner container 32Y is opened. Consequently, the toner outlet W of the toner container 32Y overlaps a toner supply opening 73*w* of the toner supply device 60. Accordingly, the toner contained in the toner container 32Y is discharged through the toner outlet W and the toner supply opening 73*w* to a toner tank 61Y of the toner supply device 60Y.

The container body 33Y is held by the toner container frame 70 rotatably relative to the cap 34Y in a direction indicated by arrow D shown in FIG. 3 by a driving unit 91 that includes a driving motor (not shown), a driving gear 81, and the like. Spiral protrusions 33*b* protruding inward are formed on an inner circumferential face of the container body 33Y. With this configuration, as the container body 33Y rotates, the toner contained in the container body 33Y is transported in a longitudinal direction of the toner container 32Y (from the left to the right in FIG. 3) and is discharged from the toner outlet W. That is, the driving unit 91 rotates the container body 33Y of the toner container 32Y as required, thus supplying the toner to the toner tank 61Y of the toner supply device 60. It is to be noted that, when the service lives of the toner containers 32Y, 32M, 32C, and 32K have expired, that is, when almost all toner in the toner container 32 is consumed, the old one is replaced with a new one.

Referring to FIG. 3, the toner supply device 60Y includes the toner tank 61, a toner conveyance screw 62Y, the toner supply path 64Y (shown in FIG. 2), a toner agitator 65Y, a toner end detector 66Y, and a driving unit 91. The toner end detector 66Y can communicate with a controller 90 of the image forming apparatus 100, which controls the driving unit 91. It is to be noted that, in FIG. 3, reference character 33*d* represents a handle part of the toner container 32Y.

The toner tank 61Y is positioned beneath the toner outlet W of the toner container 32Y and stores the toner discharged therein through the toner outlet W as well as the toner supply opening 73*w* from the toner container 32Y. A bottom portion of the toner tank 61Y is connected to an upstream side of the toner conveyance screw 62Y in a direction in which the developer G is transported (hereinafter "developer conveyance direction").

The toner end detector 66Y is disposed on a side wall of the toner tank 61Y at a predetermined height from the bottom of the toner tank 61Y. The toner end detector 66Y detects that the amount of the toner stored in the toner tank 61Y is reduced to or below a predetermined amount. For example, a piezoelectric sensor can be used as the toner end detector 66Y. When the toner end detector 66Y detects that the amount of the toner stored in the toner tank 61Y is less than the predetermined amount, the controller 90 can recognize it. Then, the controller 90 causes the driving unit 91 (including the driving gear 81) to rotate the container body 33Y of the toner container 32Y for a predetermined period, thereby supplying toner to the toner tank 61Y. If the toner end detector 66Y continues to detect that the remaining toner amount is less than the predetermined amount even when this operation is repeated for a predetermined time period, the controller deems the toner container 32Y empty (the end of toner). Then, the controller 90 causes a display of the image forming apparatus to instruct users to replace the toner container 32Y.

The toner agitator 65Y is disposed in a center portion inside the toner tank 61Y adjacent to the toner end detector 66Y for preventing the toner stored therein from being coagulated. The toner agitator 65Y includes a flexible member provided on a shaft and rotates clockwise in FIG. 3, thus stirring the toner in the toner tank 61Y. In addition, a tip of the flexible member of the toner agitator 65Y slidably contacts a detection surface of the toner end detector 66Y periodically with rotation cycle of the toner agitator 65Y, thus preventing toner from adhering to the detection surface of the toner end detector 66Y. Accordingly, a decrease in the detection accuracy can be prevented or restricted.

Although not shown, the toner conveyance screw 62Y transports the toner stored in the toner tank 61Y obliquely upward. More specifically, the toner conveyance screw 62Y linearly conveys the toner from the bottom side of the toner tank 61Y to the upper side of the development device 5Y. Then, the toner thus conveyed by the toner conveyance screw 62Y drops under its own weight through the toner supply path 64Y (see FIG. 2) as indicated by arrow a and is supplied to the developer containing compartment 54Y in the development device 5Y.

Further, referring to FIG. 4, the toner container frame 70 includes a cap holder 73 that holds the caps 34 of the respective toner containers 32, a bottle holder 72 that holds the container bodies 33 of the respective toner containers 32, and an insertion portion 71 having four insertion openings through which the four toner containers 32 are inserted into and removed from the toner container frame 70. Configurations of the toner container frame 70 are described in further detail later with reference to FIGS. 32 through 48.

Referring again to FIG. 1, when a main body cover provided on the front side of the image forming apparatus 100 (on the front side of the paper on which FIG. 1 is drawn) is opened, the insertion portion 71 of the toner container frame 70 is exposed. The toner containers 32Y, 32M, 32C, and 32K are inserted and removed on the front side of the image forming apparatus 100 with the long axis of the toner containers 32Y, 32M, 32C, and 32K kept horizontal.

Herein, a longitudinal length of the bottle holder 72 is almost equal to the longitudinal length of the container body 33Y. In addition, the cap holder 73 is provided at an end of the bottle holder 72 in its longitudinal direction (on the leading side of downstream side in the direction of insertion), and the insertion portion 71 is provided at the other end (on the upstream side) of the bottle holder 72 in that direction. Therefore, when the toner container 32Y is inserted into the toner container frame 70, the cap 34Y passes through the insertion portion 71, slides on the bottle holder 72 for a certain distance, and then is set in the cap holder 73.

Further, in the present embodiment, four antennas 73*e* (see FIGS. 38 and 39) dedicated for radio frequency identification (RFID) chips 35 (see FIGS. 5 and 9) are provided on the cap holder 73 of the toner container frame 70. Specifically, the four antennas 73*e* communicate with the RFID chips 35, serving as electronic data storages, attached to edge surfaces of the caps 34 of the toner containers 32. The toner containers 32 are aligned so that the RFID chips 35 face the antennas 73*e*, respectively.

The RFID chips 35 provided on the toner containers 32Y, 32M, 32C, and 32K exchange data with the respective antennas 73*e* provided in the image forming apparatus 100. The data exchanged between the toner containers 32 and the image forming apparatus 100 includes, for example, the production serial number of the toner containers 32, the number of times the toner container 32 is reused, the toner storage capacity, the production lot number, the color of the toner, and usage history of the image forming apparatus 100. Other data may also be included. The above-described data may be prestored on the RFID chips 35 before they are provided in the image forming apparatus 100. Alternatively, the RFID chips 35 may store data transmitted from the image forming apparatus 100 after the toner containers 32 are set in the toner container frame 70 of the image forming apparatus 100.

Next, the toner containers 32 are described in further detail below with reference to FIGS. 5 through 31.

Figure 5:
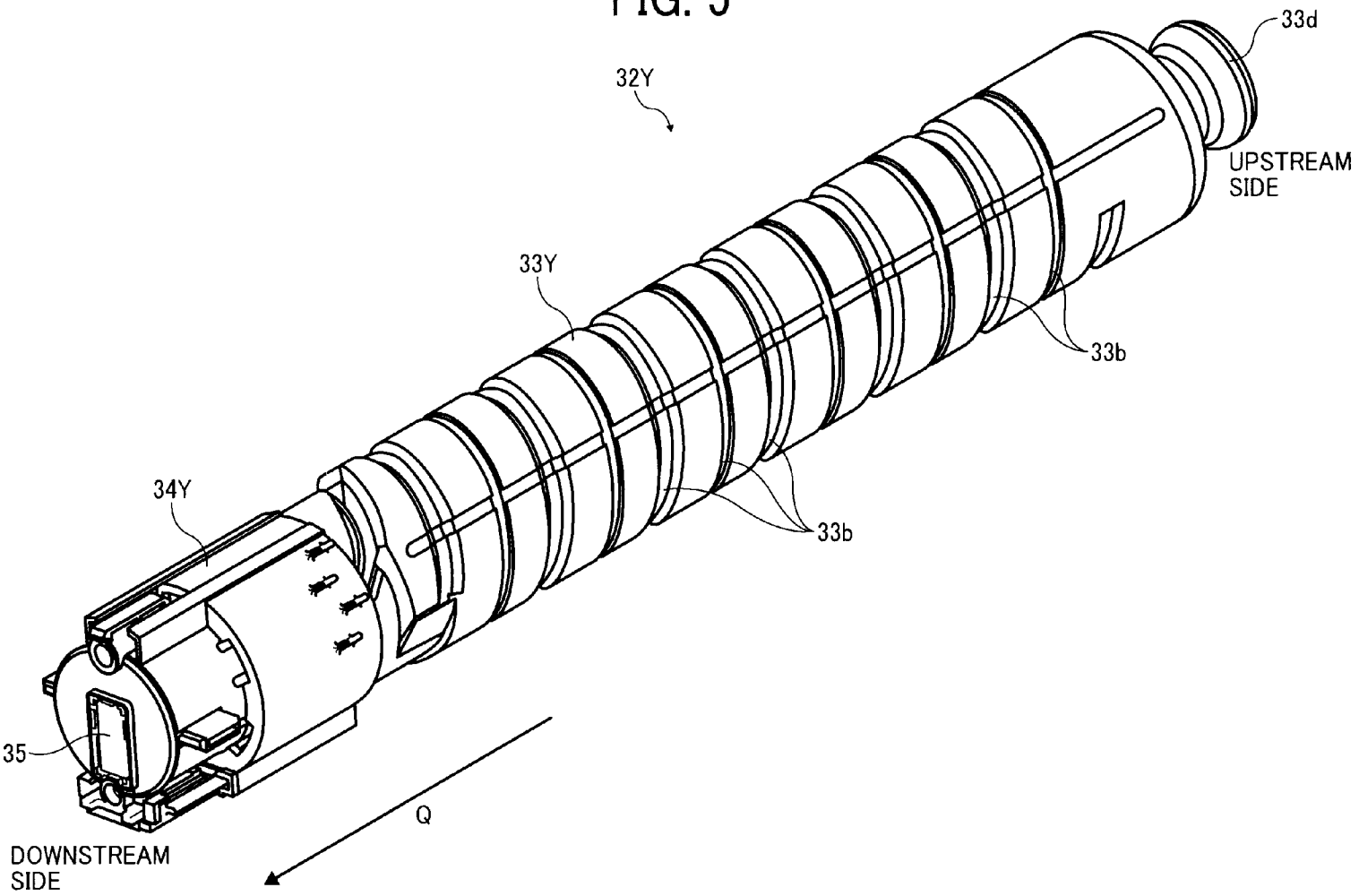
FIG. 5 is a perspective view of the toner container shown in FIG. 3 when viewed from obliquely above.
Figure 6:
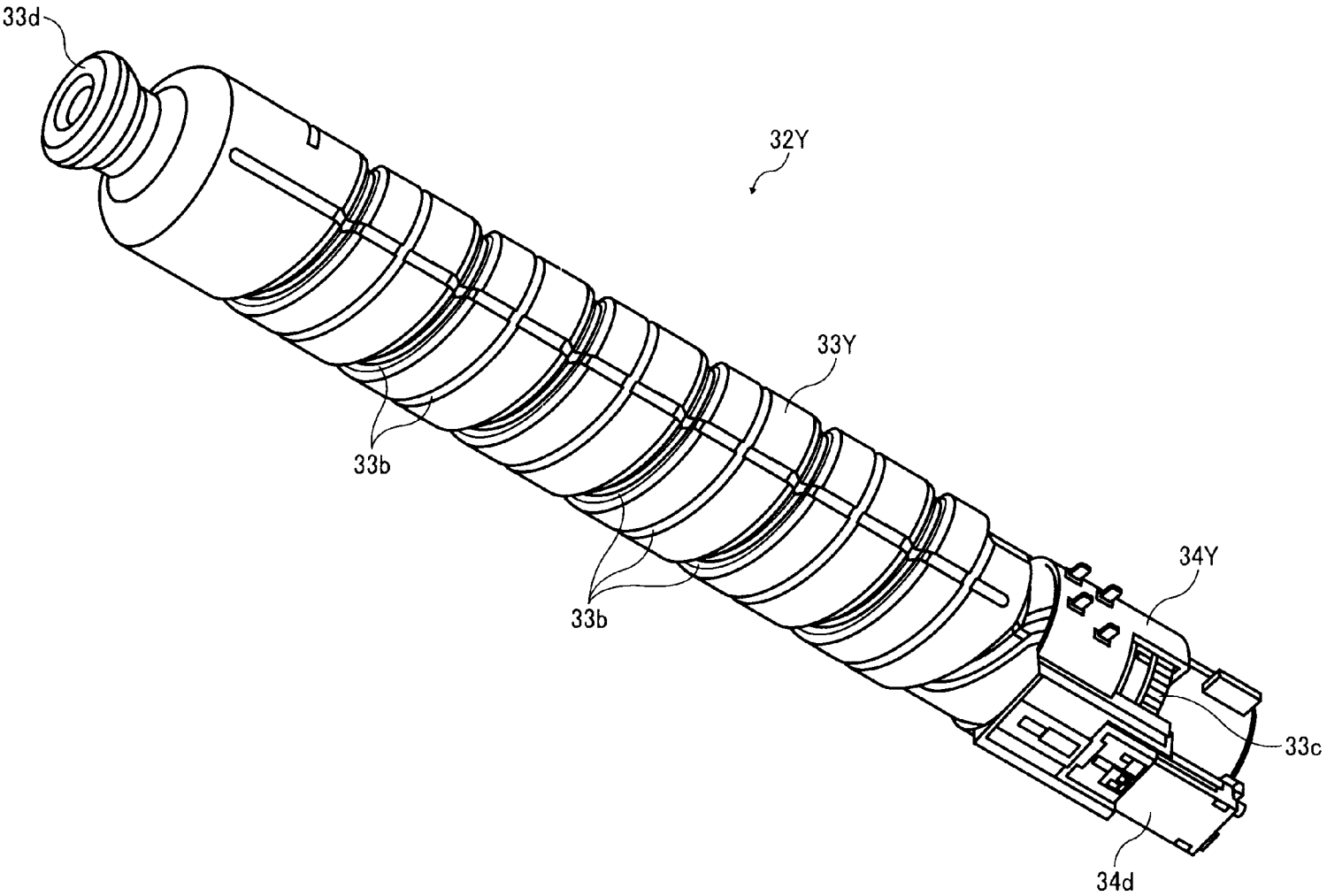
FIG. 6 is a perspective view of the toner container shown in FIG. 3 when viewed from obliquely below.
Figure 7:
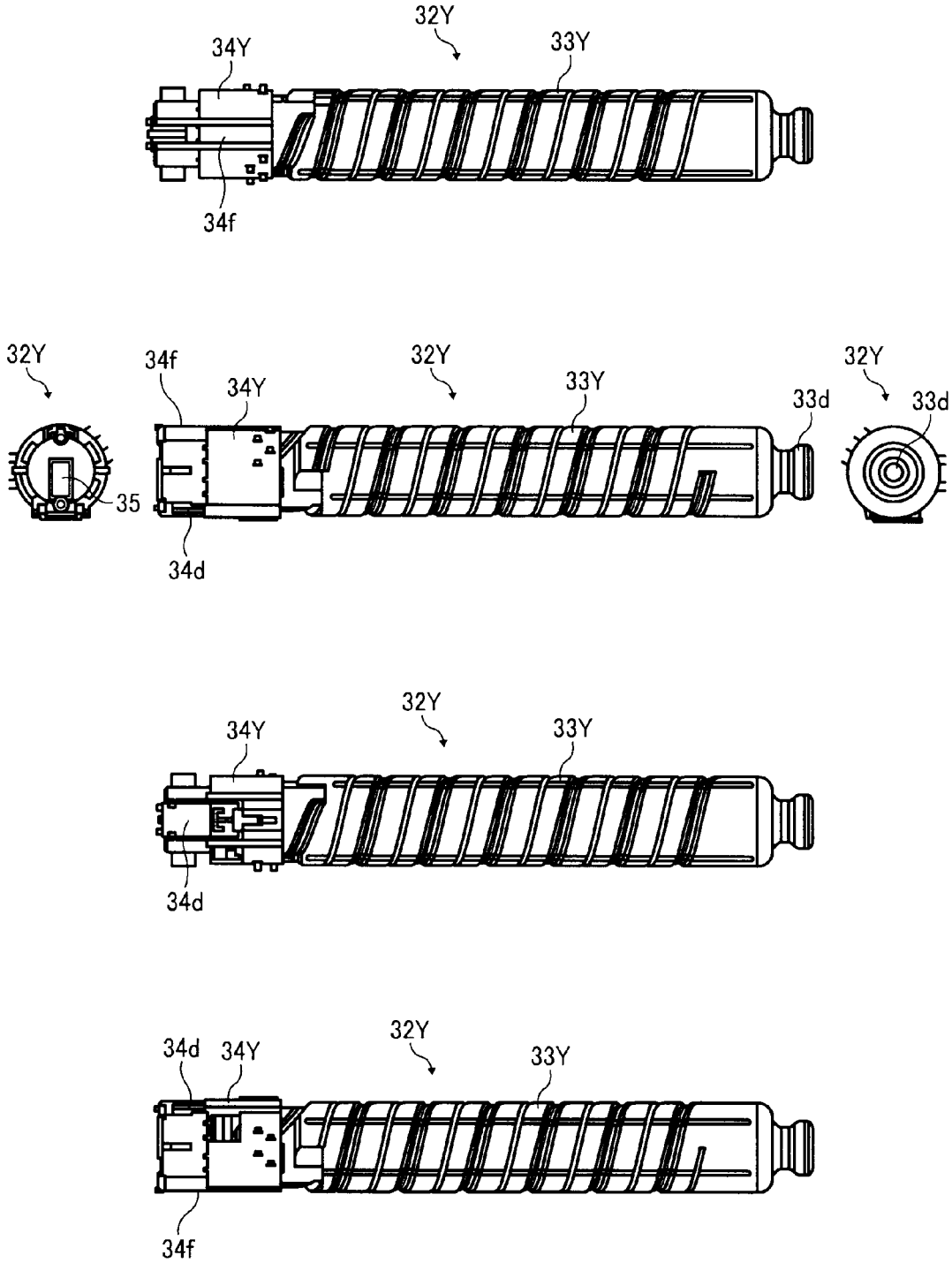
FIG. 7 is a set of six sides views of the toner container shown in FIG. 5, including a topside view, a front view, a left side view, a backside view, a bottom view, and a right side view.
Figure 8:
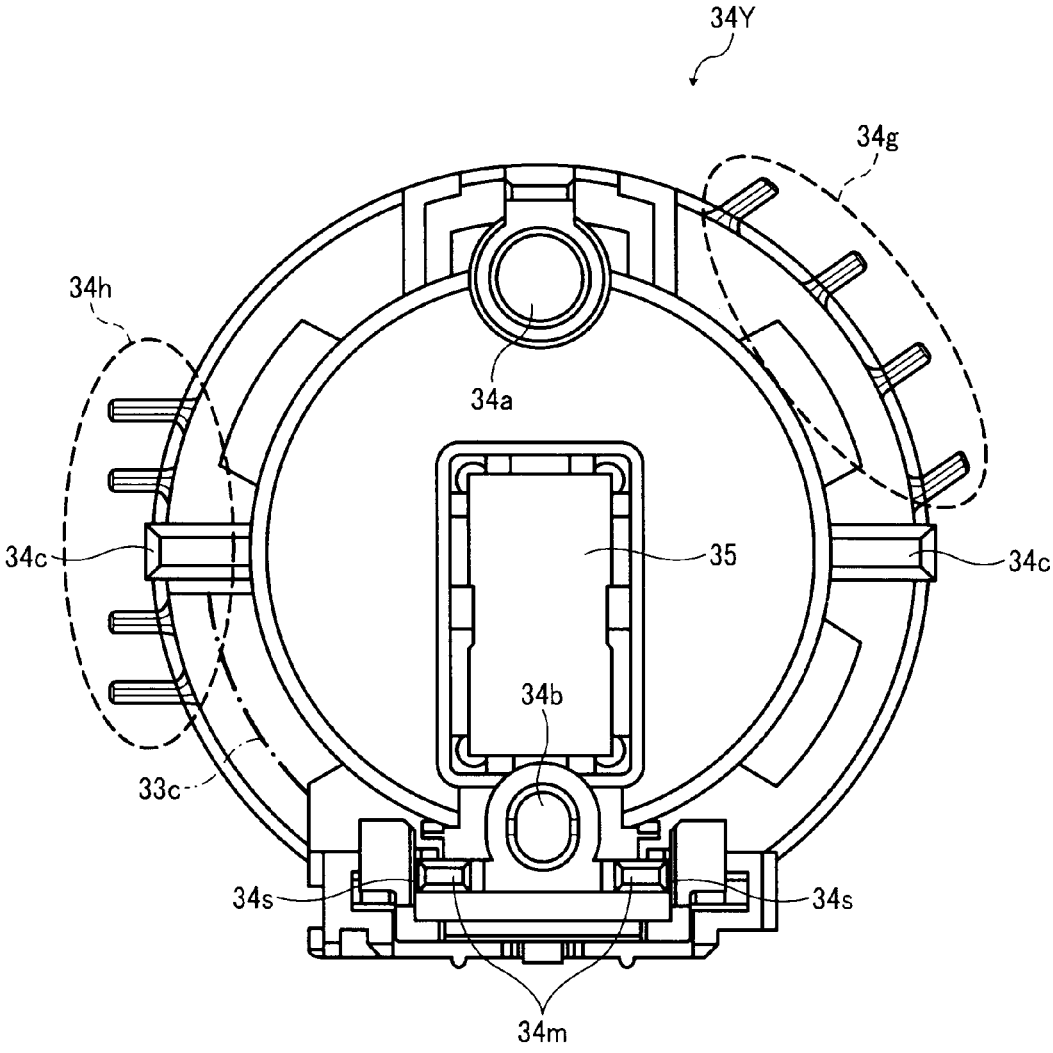
FIG. 8 is a front view of the toner container when viewed from a cap side.
Figure 9:
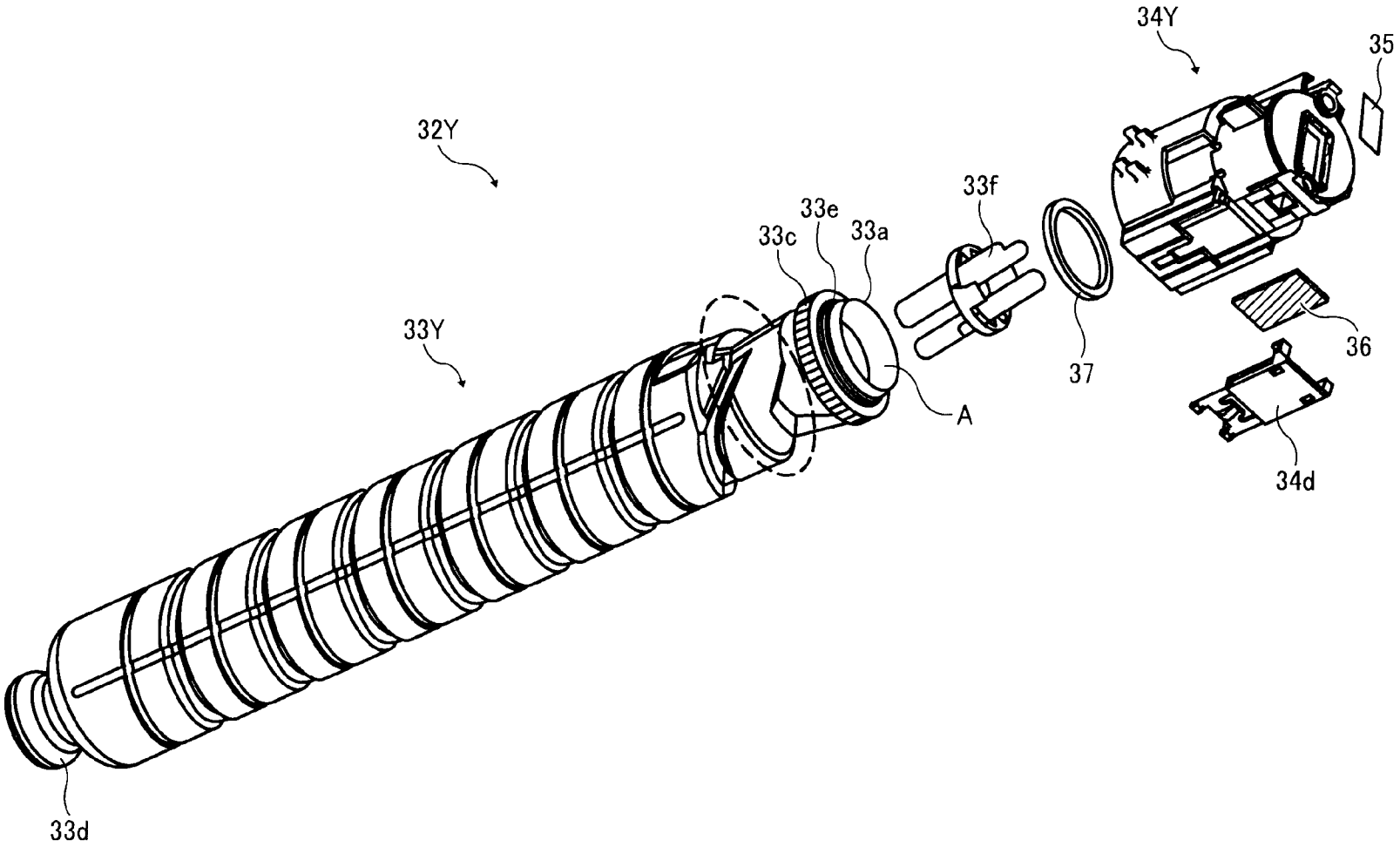
FIG. 9 is an exploded view illustrating the toner container.

As shown in FIGS. 5 and 6, the toner container 32Y includes the container body 33Y and the cap 34Y provided at the head of the container body 33Y. FIG. 7 is a set of six sides views of the toner container 32Y, including a topside view, a front view, a left side view, a backside view, a bottom view, and a right side view. It is to be noted that reference character 34*f* in FIG. 7 represents a pair of second engaging members. FIG. 8 is a front view of the toner container 32Y as view from a cap side. It is to be noted that, in FIG. 8, reference characters 34*a* represents a primary positioning hole, 34*b* represents a secondary positioning hole, 34*c* represents lateral protrusions, 34*g* represents a first discrimination portion, 34*h* represents a second discrimination portion, 34*m* represents projecting portions, and 34*s* represents a vertical face. FIG. 9 is an exploded view illustrating the toner container 32Y. With reference to FIG. 9, the toner container 32Y can be divided into an agitator 33*f*, a cap seal 37, the shutter 34*d*, a shutter seal 36 to seal the shutter 34*d*, and the RFID chip 35 serving as the electronic data storage, in addition to the container body 33Y and the cap 34Y.

Figure 11:
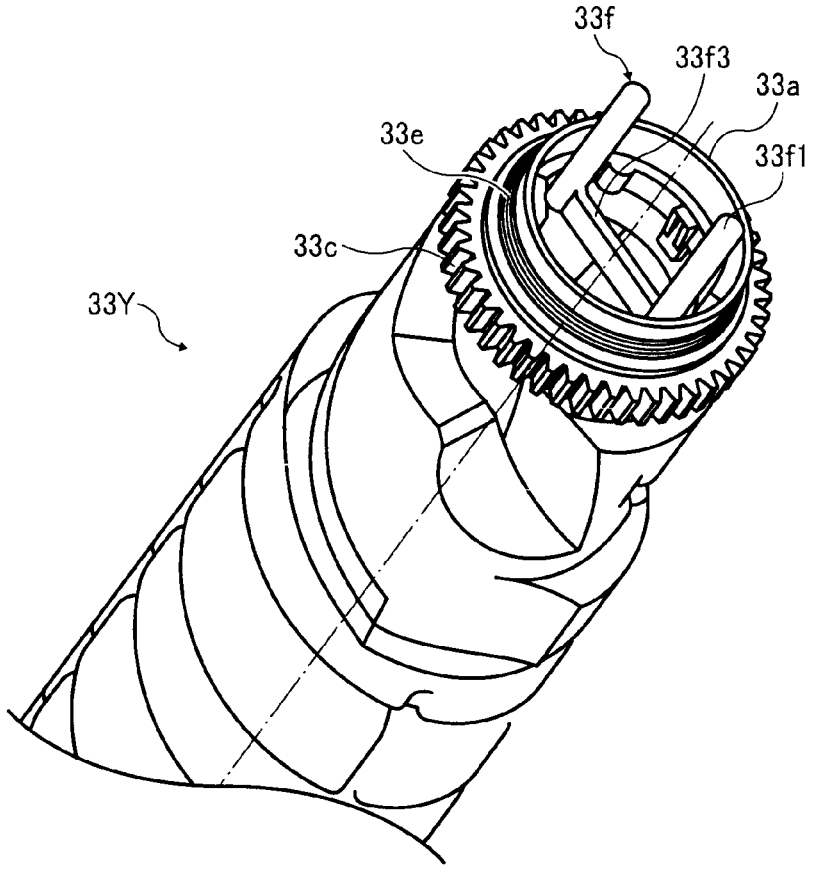
FIG. 11 is an enlarged view illustrating vicinity of an opening of the container body shown in FIG. 10.

An opening A and the gear 33*c* that rotates together with the container body 33Y are provided in one end portion of the container body 33Y in its longitudinal direction, which is on the front side of paper on which FIG. 8 is drawn (see FIGS. 9 and 11). The opening A is formed on the head of the container body 33Y that is on a leading side when the toner container 32Y is inserted into the toner container frame 70, and the toner contained in the container body 33Y is discharged through the opening A to a space (a hollow B shown in FIG. 28) inside the cap 34Y. An end portion of the bottle body 33Y that encloses the opening A is hereinafter referred to as a bottle rim 33*a*.

It is to be noted that the toner container 33Y is rotated to convey toner from the container body 33Y to the hollow B in the cap 34Y so that the level of toner in the cap 34Y does not fall below a predetermined level.

The gear 33*c* engages the driving gear 81 provided in the toner container frame 70 of the image forming apparatus 100 to rotate the container body 33Y around a rotary axis (indicated by a broken line in FIG. 11). More specifically, the gear 33*c* is provided on the entire circumference of the opening A (bottle rim 33*a*) and has multiple teeth that are radially arranged relative to the rotary axis of the container body 33Y. In addition, the gear 33*c* is partly exposed from a notch 34*x* (shown in FIGS. 15 and 22) formed in the cap 34Y on the lower left in FIG. 8, which is an engagement position where the gear 33*c* engages the driving gear 81 of the apparatus body of the image forming apparatus 100. Then, the driving force is transmitted from the driving gear 81 to the gear 33*c*, thus rotating the container body 33Y clockwise in FIG. 8. It is to be noted that, in the present embodiment, the driving gear 81 and the gear 33*c* are spur gears, for example.

Referring to FIGS. 5 and 6, the handle part 33*d* for users is provided on the other end of the container body 33Y (on the upstream or rear side in the installation direction) opposite the side where the gear 33*c* is positioned. The user grasps the handle part 33*d* to insert or remove the toner container 32Y from the image forming apparatus 100. When inserted into the apparatus, the toner container 32Y is moved in the direction indicated by arrow Q shown in FIG. 5.

As described above, the spiral protrusions 33*b* protruding inward are formed on the inner circumferential face of the container body 33Y. In other words, a spiral groove is formed in an outer circumferential surface of the toner container 33Y when viewed from outside. The spiral protrusions 33*b* are for discharging the toner from the container body 33Y through the opening A with rotation of the container body 33Y in a predetermined direction. The container body 33Y can be produced using blow molding together with elements, such as the gear 33*c* and the handle part 33*d*, provided on the circumferential surface of the container body 33Y.

Figure 10:
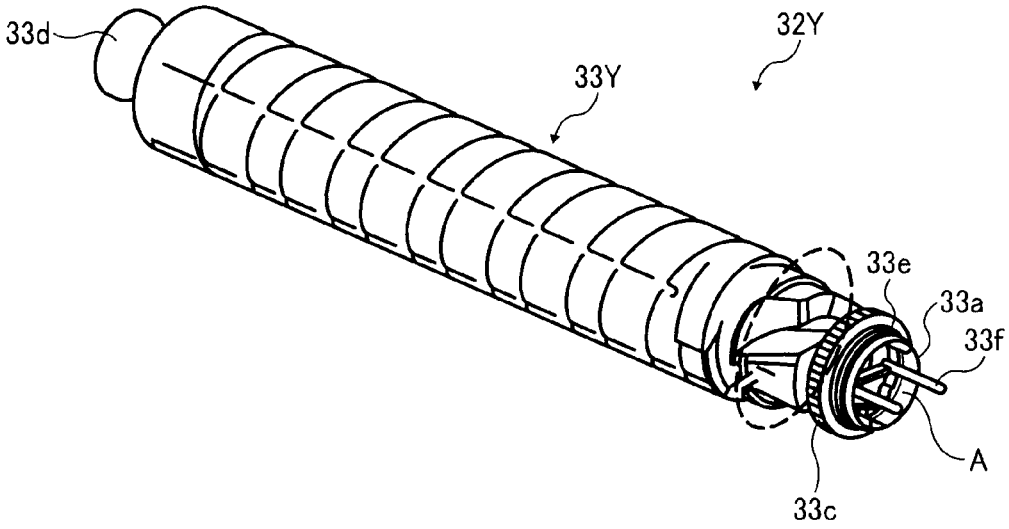
FIG. 10 is a perspective view of a container body of the toner container shown in FIG. 5.

It is to be noted that, with reference to FIGS. 9 through 11, in the toner container 32Y according to the present embodiment, the agitator 33*f* that rotates together with the container body 33Y is fitted in the bottle rim 33*a* (opening A) of the bottle body 33Y. The agitator 33*f* includes bar-shaped portions extending from the hollow B in the cap 34Y to the container body 33Y (see also FIG. 28). The agitator 33*f* is rotated together with the opening A of the container body 33Y, and thus discharging toner from the opening A can be facilitated.

Figure 12:
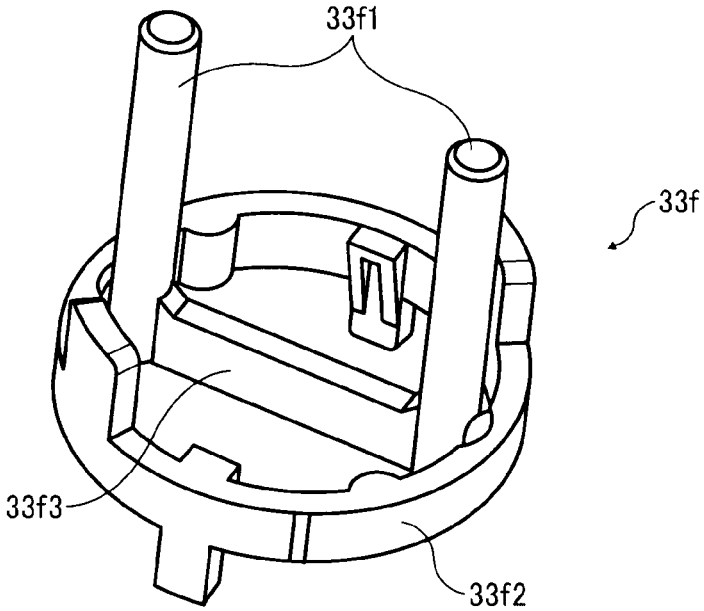
FIG. 12 is a perspective view illustrating an agitator provided in the container body shown in FIG. 11.

More specifically, as shown in FIG. 12, the agitator 33*f* includes a pair of stirring rods 33*f*1, a substantially circular engagement edge 33*f*2 to be fitted in the bottle rim 33*a*, and a bridge portion 33*f*3. The pair of stirring rods 33*f*1 protrudes from the circular engagement edge 33*f*2 to the hollow B in the cap 34Y and their phases are shifted 180 degrees from each other. The bridge portion 33*f*3 connects together the two stirring rods 33*f*1. When the agitator 33*f* is fitted into the opening A of the bottle body 33Y as shown in FIG. 11, the two cylindrical stirring rods 33*f*1 soften the toner in the hollow B formed in the cap 34Y while suitably weakening the conveyance force to convey the toner from the opening A of the container body 33Y to the hollow B in the cap 34Y. As a result, the amount of the toner supplied through the opening A of the container body 33Y to the hollow B in the cap 34Y does not become excessive. Therefore, the possibility of clogging of the hollow B in the cap 34Y with toner can be reduced.

Figure 28:
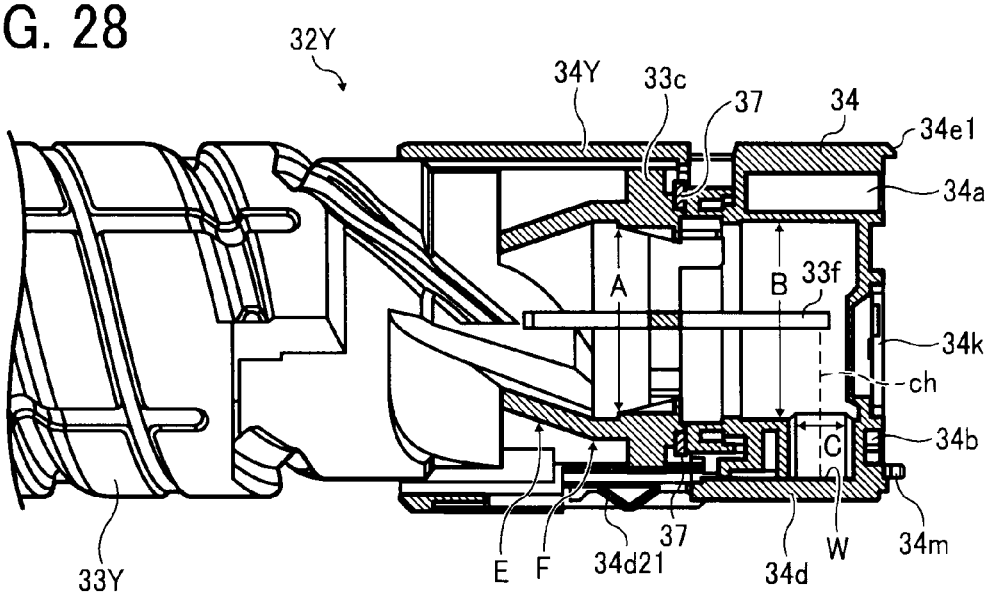
FIG. 28 is a cross-sectional view illustrating vicinity of the cap.
Figure 29:
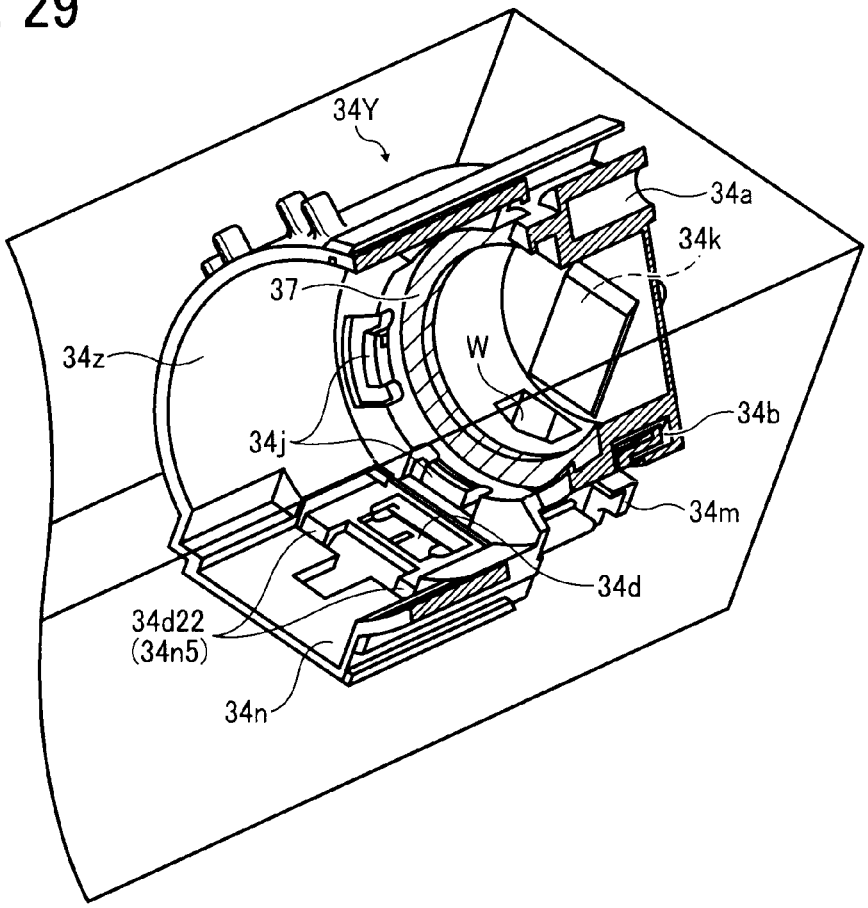
FIG. 29 is a perspective view illustrating an interior of the cap of the toner container.

It is to be noted that, if the stirring rods 33*f*1 are disposed far from the toner outlet W (or a toner drop portion C), the stirring rods 33*f*1 cannot soften the toner located closed to the toner outlet W because the two stirring rods 33*f*1 are cylindrical. Therefore, as shown in FIG. 28, the stirring rods 33*f*1 are designed to extend to a position just above the toner outlet W (toner drop portion C). More specifically, referring to FIG. 28, the stirring rods 33*f*1 extend to the right beyond a left edge of the toner outlet W more than half the diameter of the toner outlet W in the lateral direction in FIG. 28 (longitudinal direction of the toner container 32Y. That is, their tips are positioned beyond a centerline ch of the cylindrical toner drop portion C.

In addition, when the toner consumption in the development device 5Y is relatively small and accordingly the amount of the toner supplied from the toner container 32Y to the toner supply device 60Y is relatively small, the container body 33Y of the toner container 32Y is rotated for only a short time. Consequently, the container body 32Y rotates only a small angle and does not make a full rotation. Even in such a case, one of the stirring rods 33*f*1, shifted by 180 degrees, can soften the toner close to the toner outlet W (toner drop portion C).

Further, because the agitator 33*f* according to the present embodiment includes the bridge portion 33*f*3 crossing a center portion of the substantially circular engagement edge 33*f*2, the toner in a center portion of the opening A can be softened by the bridge portion 33*f*3.

Figure 13:
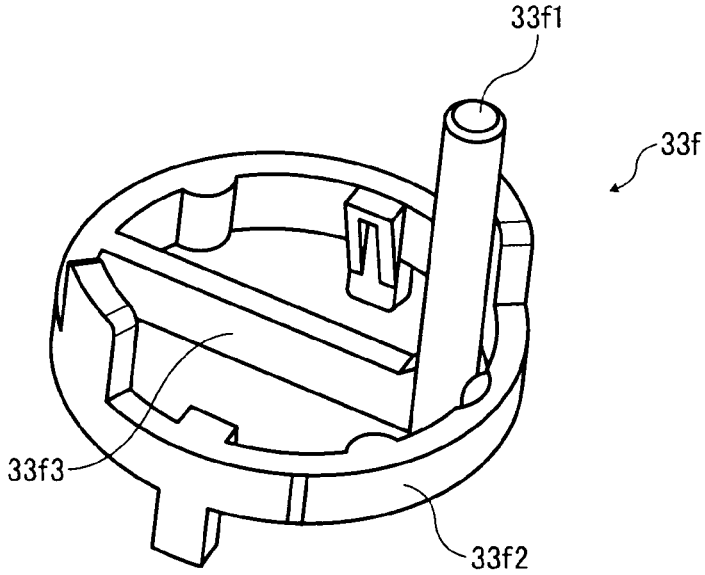
FIG. 13 is a perspective view illustrating a variation of the agitator.

It is to be noted that, although the agitator 33*f* includes two stirring rods 33*f*1 in the present embodiment, alternatively the agitator 33*f* can include only a single stirring rod 33*f*1 as shown in FIG. 13, or the agitator 33*f* can include three or greater number of stirring rods 33*f*1.

Additionally, with reference to FIGS. 9 and 10, a protrusion 33*e* (hereinafter also "an engagement portion 33*e*") is provided on an entire outer circumference of the bottle rim 33*a* of the container body 33Y and engages a retaining pawl 34*j* (see FIGS. 15 and 29) provided on the cap 34Y so that the container body 33Y and the cap 34Y are connected together. Thus, the container body 33Y engages the cap 34Y rotatably relative to the cap 34Y. Therefore, the gear 33*c* rotates relative to the cap 34Y.

Further, in the container body 33Y, the inner diameter of a portion (small-diameter portion) F shown in FIG. 28 adjacent to its head portion, in which the gear 33*c* is provided, is smaller than that of a portion for containing toner in which the spiral protrusions 33*b* are formed. The head portion of the container body 33Y includes a pump-up portion E shown in FIG. 28, indicated by a broken circle in FIGS. 9 and 10 that juts inward gradually and positioned adjacent to the small-diameter portion F. When the toner is conveyed to the opening A by the spiral protrusions 33*b* as the container body 33Y rotates, the toner is pumped up through the pump-up portion E to the small-diameter portion F on the head side of the container body 33Y. Then, the toner pumped up to the small-diameter portion F is agitated by the agitator 33*f* and is discharged from the opening A to the hollow B in the cap 34Y.

Turning now to FIGS. 14 through 17, the cap 34Y is described in further detail below.

Figure 20:
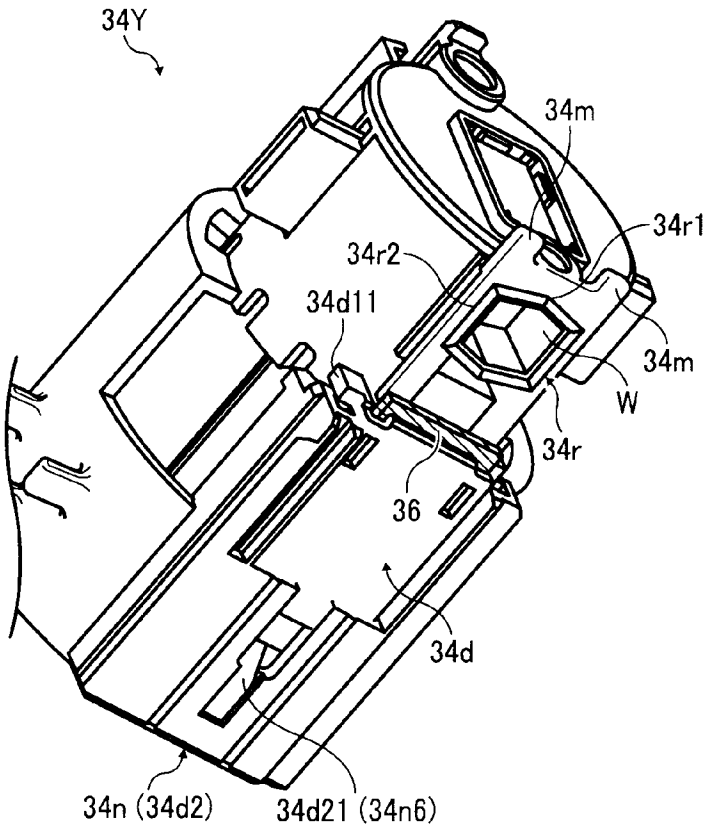
FIG. 20 is a perspective view illustrating a state in which the shutter fully opens the toner outlet.

The shutter 34*d*, the shutter seal 36, the cap seal 37, and the RFID chip 35 (electronic data storage) are provided on the cap 34Y as described above. The cap 34Y includes a bottle insertion portion 34*z* (see FIG. 29) having an inner diameter greater than that of the hollow B, and the bottle rim 33*a* enclosing the opening A of the container body 33Y is inserted into the bottle insertion portion 34*z*. With reference to FIGS. 20 and 28, the toner outlet W is formed in the bottom portion of the cap 34Y through which the toner discharged from the opening A drops its own weight outside the toner container 32Y. The shutter 34*d* is slidably held on the bottom side of the cap 34Y and opens and closes the toner outlet W with relative movement in the longitudinal direction in conjunction with installation or removal of the container body 33Y in or from the toner container frame 70 in the longitudinal direction. More specifically, the toner outlet W is opened when the shutter 34*d* relatively moves from the cap side to the container body side (from the right to the left in FIG. 28) and is closed when the shutter 34*d* relatively moves from the container body side to the cap side.

Figure 18:
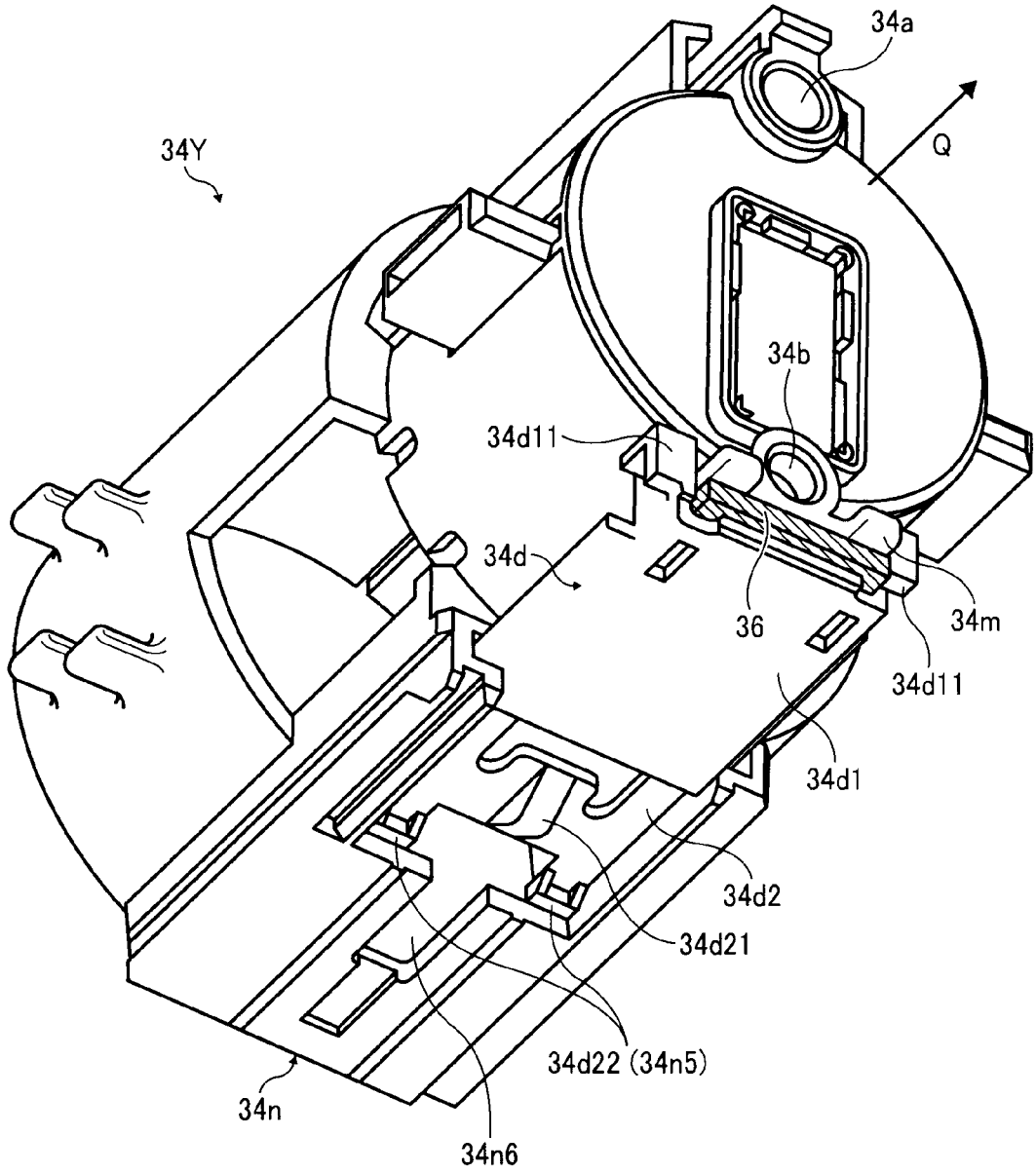
FIG. 18 is a perspective view illustrating a state in which a toner outlet formed on the bottom of the toner container is closed with a shutter.
Figure 19:
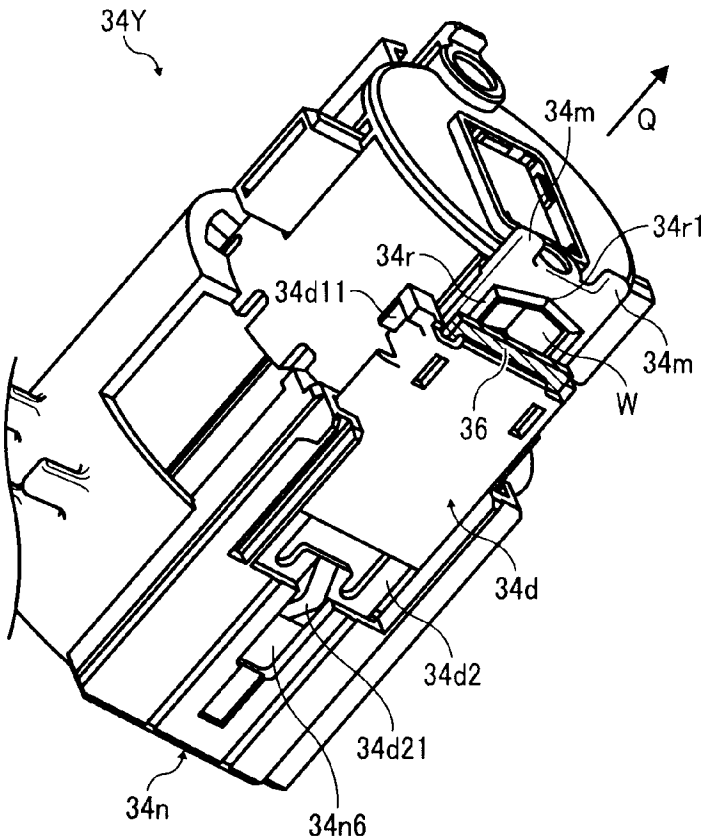
FIG. 19 is a perspective view illustrating a state in which the shutter provided on the cap partly opens the toner outlet.
Figure 21A:
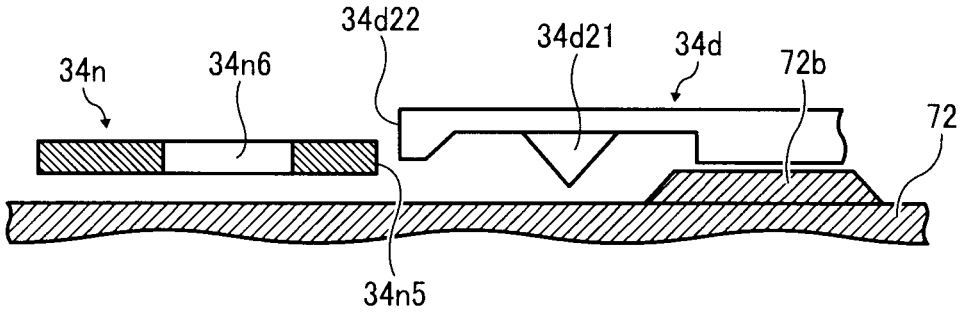
FIGS. 21A through 21C are schematic diagrams illustrating movement of the shutter relative to the cap in conjunction with installation of the toner container in a toner container frame.
Figure 21B:
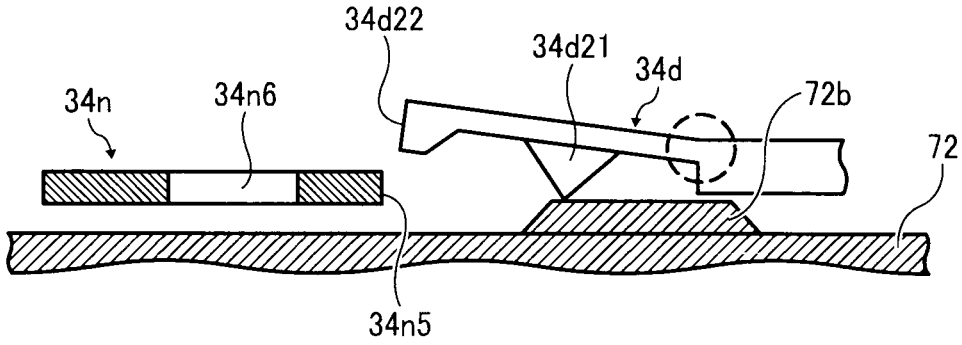
Figure 21C:
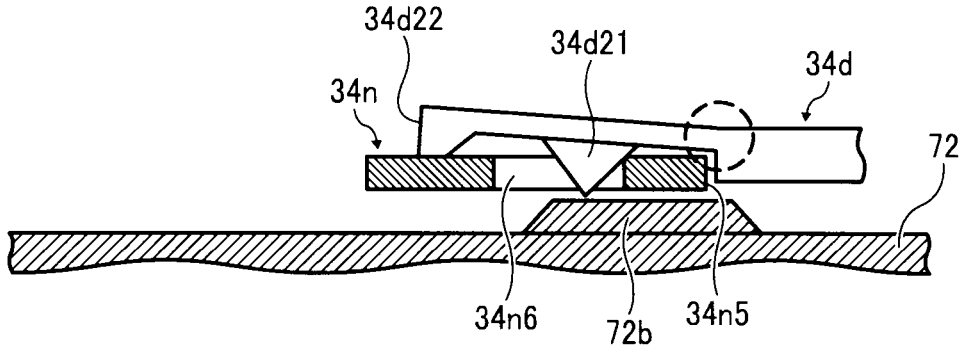

FIGS. 18 through 20 are perspective views of the cap 34Y illustrating the states from the start to the completion of opening the toner outlet W. FIGS. 21A through 21C are schematic diagrams illustrating movements of the shutter 34*d* (a deformable portion 34*d*2 shown in FIG. 26) in opening the toner outlet W.

Next, referring to FIGS. 14 15, 39, and 40, positioning of the cap 34Y in the image forming apparatus 100 is described below.

Figure 14:
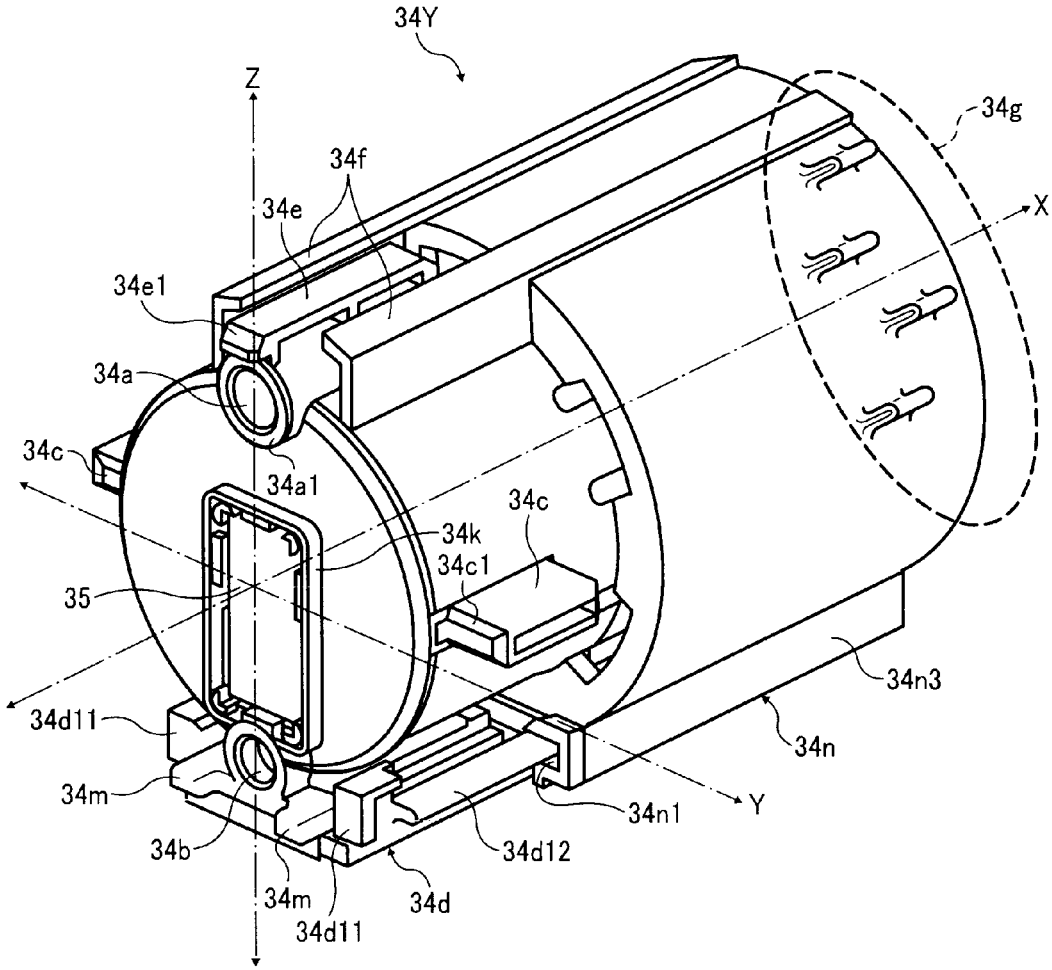
FIG. 14 is a perspective view illustrating a cap of the toner container.
Figure 15:
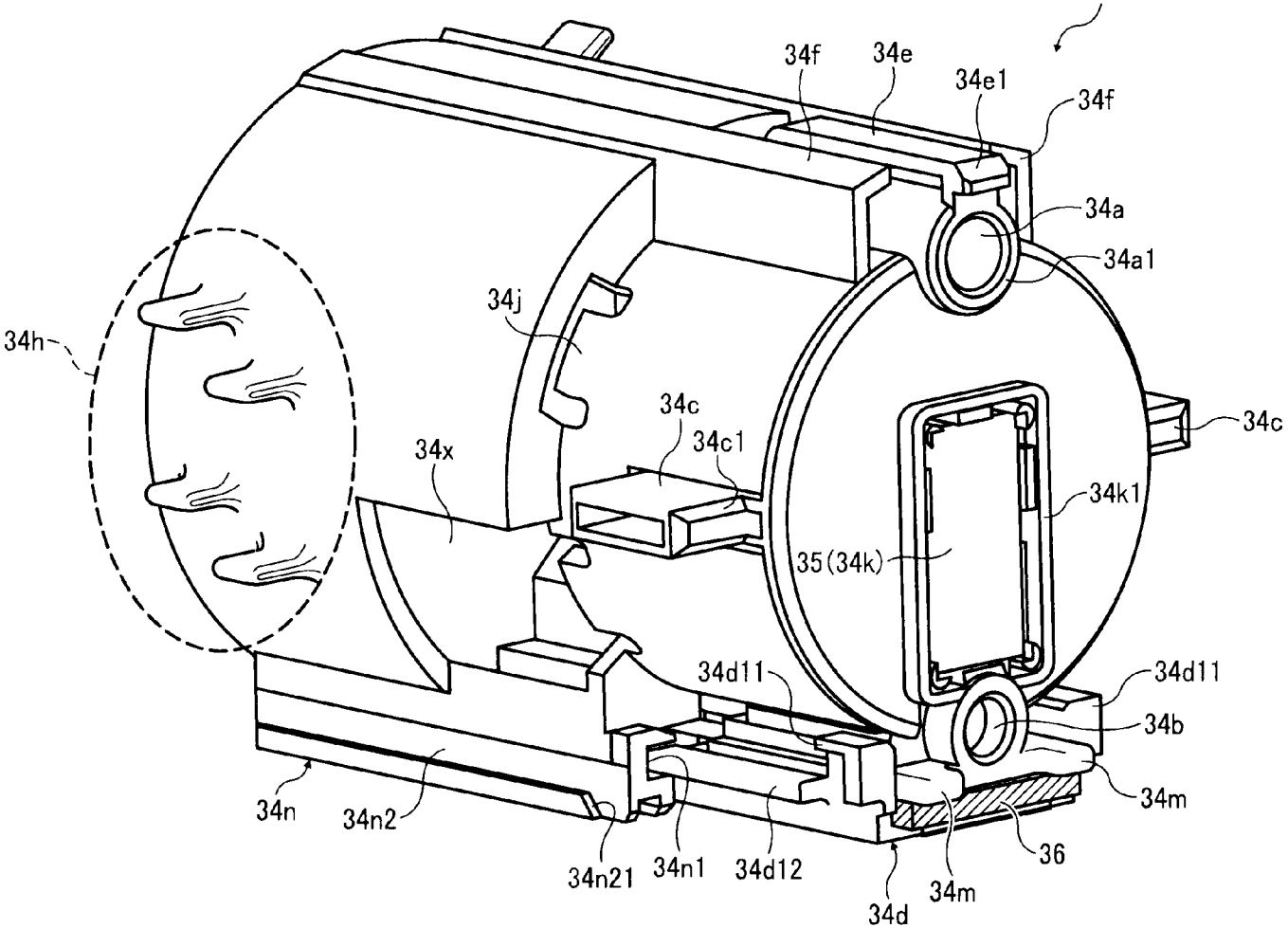
FIG. 15 is a perspective view illustrating the cap shown in FIG. 14 when viewed from another angle.

As shown in FIGS. 14 and 15, the primary positioning hole 34*a* is formed in an upper portion (a ceiling portion) of an edge surface of the cap 34Y, that is, an edge face perpendicular to the longitudinal direction of the toner container 32Y. The primary positioning hole 34*a* extends in the longitudinal direction. The primary positioning hole 34*a* functions as a main positioning reference to determine an installation position of the cap 34Y relative to the image forming apparatus 100. More specifically, a main reference pin 73*a* of the cap holder 73 (see FIGS. 39 and 40) is inserted into the primary positioning hole 34*a* as the toner container 32Y is inserted into the toner container frame 70.

In addition, the secondary positioning hole 34*b* is formed in a lower portion (bottom) of the edge surface of the cap 34Y perpendicular to the longitudinal direction of the toner container 32Y. The secondary positioning hole 34*b* extends in the longitudinal direction to an extent not to reach the toner outlet W. The secondary positioning hole 34*b* functions as a sub-positioning reference to determine the position of the cap 34Y relative to the image forming apparatus 100. More specifically, a sub-reference pin 73*b* of the cap holder 73 (see FIGS. 39 and 40) is inserted into the secondary positioning hole 34*b* in conjunction with insertion of the toner container 32Y into the toner container frame 70. It is to be noted that the secondary positioning hole 34*b* is elliptical and its vertical diameter is longer than the horizontal diameter thereof.

The position of the cap 34Y in the toner container frame 70 is determined by the above-described reference holes 34*a* and 34*b*. Further, with reference to FIGS. 8 and 14, the positioning holes 34*a* and 34*b* are arranged so that virtual perpendiculars passing through a center of the primary positioning hole 34*a* and that of the secondary positioning hole 34*b* are identical (a straight line Z shown in FIG. 14) and also pass through a center of the round body of the cap 34Y.

Herein, with reference to FIG. 28, the depth of the primary positioning hole 34*a* (length of the main reference pin 73*a* in the longitudinal direction of the toner container 32) is longer than the depth of the secondary positioning hole 34*b* (length of the sub-reference pin 73*b* in that direction). With this configuration, in installation of the cap 34Y of the toner container 32Y into the cap holder 73 of the toner container frame 70, the sub-reference pin 73*b* is inserted into the secondary positioning hole 34*b* (sub-positioning reference) after insertion of the main reference pin 73*a* into the primary positioning hole 34*a* (main positioning reference) is started. Thus, the cap 34Y of the toner container 32Y can be smoothly inserted into the cap holder 73 of the container fame 70.

In addition, because the primary positioning hole 34*a*, which is relatively long in the longitudinal direction, is provided in the ceiling portion of the cap 34Y not to be buried in toner, the primary positioning hole 34*a* does not hinder conveyance (fluidity) of the toner in the cap 34Y. Although shorter in the longitudinal direction, the secondary positioning hole 34*b* provided in the bottom portion of the cap 34Y can sufficiently function as the sub-positioning reference. Further, the secondary positioning hole 34*b* can be formed in a relatively short space extending from the edge surface of the cap 34Y to the toner outlet W, which is advantageous.

With reference to FIGS. 8 and 14 through 17, a first engaging member or restriction member 34*e* and the pair of second engaging members 34*f* are formed in the ceiling portion of the cap 34Y to position the cap 34Y in the image forming apparatus 100 (cap holder 73) in a horizontal direction indicated by arrow Y in FIG. 14, perpendicular to the longitudinal direction of the cap 34Y indicated by arrow Y. It is to be noted reference characters 34*a*1 represents a surrounding wall defining the primary positioning hole 34*a*, and 34*b*1 represents a surrounding wall defining the secondary positioning hole 34*b*. Both of the first engaging member 34*e* and the second engaging members 34*f* project upward from the outer circumferential surface of the cap 34Y symmetrically relative to the virtual perpendicular Z shown in FIG. 14 passing through the center of the primary positioning hole 34*a* on a cross section perpendicular to the longitudinal direction and in parallel to the front view shown in FIG. 8. The first engaging member 34*e* and the second engaging members 34*f* extend along the ceiling of the cap 34Y in the longitudinal direction indicated by the arrow X, which is orthogonal to the surface of the paper on which FIG. 8 is drawn. The first engaging member 34*e* and the second engaging members 34*f* engage a pair of projections 73*m* (cap engagement portions) in the cap holder 73 (see FIGS. 38 and 39). Therefore, the cap 34Y can be inserted into or released from the cap holder 73 with the horizontal position thereof retained by the first engaging member 34*e* and the second engaging members 34*f*. In addition, the horizontal position of the cap 34Y fully set in the cap holder 73 can be restricted.

More specifically, the first engaging member 34*e* (restriction member) is provided just above the primary positioning hole 34*a* and is substantially rectangular in cross section perpendicular to the longitudinal direction. The first engaging member 34*e* includes a projecting portion 34*e*1 that projects forward from an edge face of the surrounding wall 34*a*1 defining the primary positioning hole 34*a*. As shown in FIG. 14, the projecting portion 34*e*1 has a tapered tip. By contrast, the second engaging members 34*f* (restriction member) are formed on both sides of first engaging member 34*e*, and each engaging member 34*f* is L shaped in a cross section perpendicular to the longitudinal direction (in parallel to the front view of the cap 34Y shown in FIG. 8). The first engaging member 34*e* is inserted between the two projections 73*m* formed on the cap holder 73, and the pair of second engaging members 34*f* engages the two projections 73*m* with the two projections 73*m* interposed therebetween. At that time, the tapered projecting portion 34*e*1 engages the projections 73*m* before the second engaging members 34*f* engage the respective projections 73*m*, and thus the cap 34Y can be smoothly installed into the cap holder 73.

Further with reference to FIGS. 14 to 17, the pair of lateral protrusions 34*c*, serving as a second restriction member, is formed on both sides on the outer circumferential face of the cap 34Y to restrict the rotational position of the cap 34Y in the image forming apparatus 100. The lateral protrusions 34*c* (second restriction member) are aligned with a virtual horizontal line passing through a center position of a segment from the center position of the primary positioning hole 34*a* and that of the secondary positioning hole 34*b* of the virtual perpendicular Z on the cross section perpendicular to the longitudinal direction, which is orthogonal to the surface of the paper on which FIG. 8 is drawn. The lateral protrusions 34*c* protrude from lateral sides of the cap 34Y horizontally and extend in the longitudinal direction. With this configuration, while the cap 34Y is installed into the cap holder 73, the rotational position of the cap 34Y is restricted by the two lateral protrusions 34*c* (second restriction members) engaging the lateral grooves 73*c* of the cap holder 73 shown in FIG. 38. Also in the state in which the cap 34Y is set in the cap holder 73, the rotational position of the cap 34Y is restricted by the engagement between the lateral protrusions 34Y and the lateral grooves 71*c*.

More specifically, as shown in FIG. 14, tip portions 34*c*1 of the lateral protrusions 34*c* in the longitudinal direction (on the leading side in the installation direction) are tapered. As described above, in installation of the cap 34Y into the cap holder 73, initially, the first engaging member 34*e* engages the projections 73*m*, after which the second engaging members 34*f* engage the projections 73*m*. Additionally, the two lateral protrusions 34*c* whose tip portions 34*c*1 are tapered engage the respective lateral grooves 73*c*. Accordingly, the cap 34Y can be smoothly installed into the cap holder 73 with the position of the cap 34Y restricted reliably.

With reference to FIGS. 14 and 15, the RFID chip 35 is placed in a mounting section 34*k* positioned between the primary positioning hole 34*a* and the secondary positioning hole 34*b* on the edge surface of the cap 34Y (on the leading side in the installation direction), and the mounting section 34*k* enclosed by a rib (projection) 34*k*1 protruding forward from the edge surface of the cap 34Y. The RFID chip 35 is positioned facing the antenna 73*e*, a predetermined distance away from the antenna 73*e* in the cap holder 73*e*, when the cap 34Y is set in the cap holder 73 of the toner container holder 70. When cap 34Y is held in the cap holder 73, contactless communication (wireless communication) between the RFID chip 35 and the antenna 73*e* is available.

In the present embodiment, because the RFID chip 35 is mounted between the primary positioning hole 34*a* (main positioning reference) and the secondary positioning hole 34*b* (sub-positioning reference), the position of the RFID chip 35 can be determined with a higher degree of accuracy relative to the antenna 73*e* of the cap holder 73. Accordingly, communication failure caused by positional deviation of the RFID chip 35 relative to the antenna 73*e* for the RFID chip 35 can be prevented.

It is to be noted that the projecting portion 34*e*1 of the first engaging member 34*e* and the two projecting portions 34*m* project forward (to the right in FIG. 28) beyond the rib 34*k*1 surrounding the mounting section 34*k*. Therefore, even when the user places the toner container 32Y on a given object upside down with the cap 34Y on the lower side, the mounting section 34*k* accommodating the RFID chip 35 contacts the object directly, and thus the RFID chip 35 is less likely to be damaged with a direct contact with the object.

With reference to FIGS. 14, 15, and 30A through 30D, compatibility (color discrimination) of the toner containers 32Y, 32M, 32C, and 32K is described below. FIGS. 30A through 30D are front views illustrating the insertion portions 71Y, 71M, 71C, and 71K of the toner container frame 70. As shown in FIGS. 14 and 15, the discrimination portions 34*g* and 34*h* for compatibility are provided on the outer circumferential surface of the cap 34Y. When the toner container 32 is inserted into the proper opening in the toner container frame 70, claw-shaped discrimination protrusions in the discrimination portions 34*g* and 34*h* engage corresponding recesses in engagement portions 71*g* and 71*h* formed in the corresponding opening in the insertion portion 71 of the toner container frame 70 as shown in FIGS. 30A through 30D.

Arrangement of the discrimination protrusions in the discrimination portions 34*g* and 34*h* are different among the multiple colors of toners, and the recesses of the engagement portions 71*g* can engage only the discrimination protrusions of the toner container 32 of the corresponding color, which is described more specifically below. It is to be noted that, in the description below, the discrimination protrusion portions 34*g* and 34*h* and the engagement portions 71*g* and 71*h* for yellow, magenta, cyan, and black are respectively given reference character Y, M, C, and K positioned between the reference numeral and the reference character g or h.

Figure 30A:
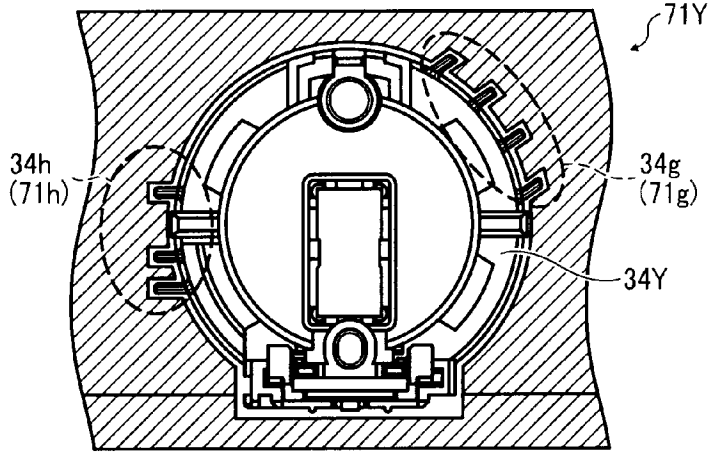
FIGS. 30A through 30D are front views of the toner container frame, in which different type toner containers are set in the insertion openings.
Figure 30B:
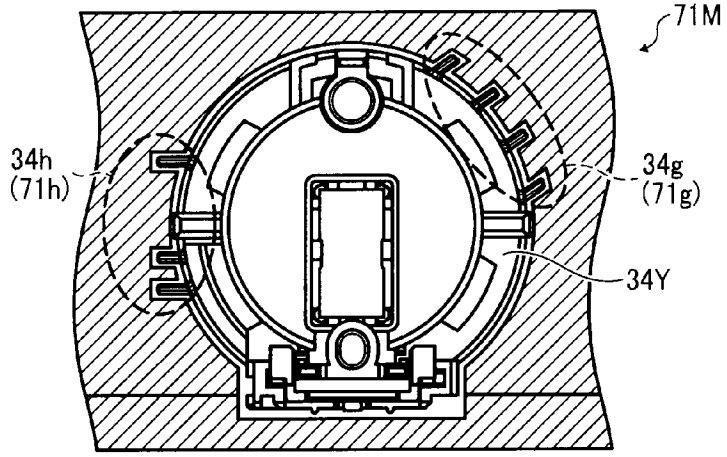
Figure 30C:
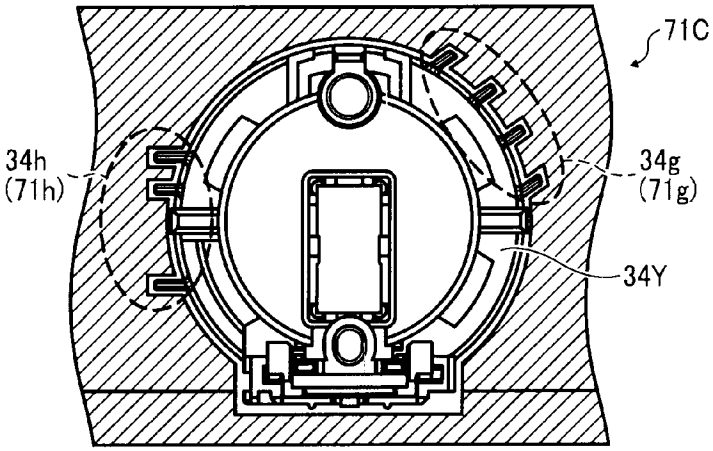
Figure 30D:
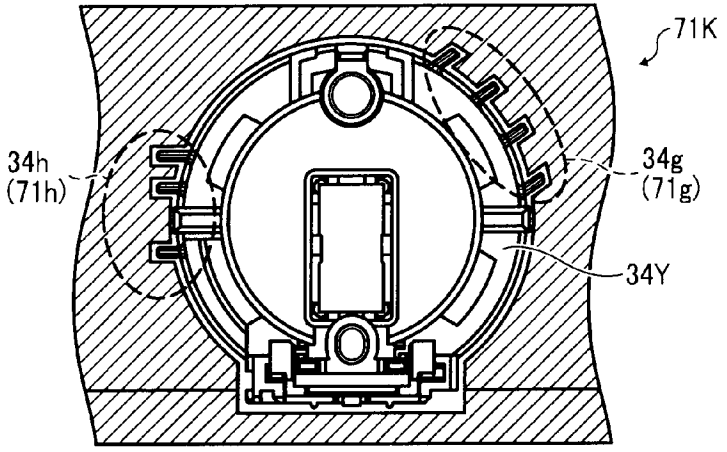

Referring to FIG. 30A, the discrimination protrusions in the description portions 34Yg and 34Yh of the cap 34Y are designed to fit only the recesses in the engagement portions 71Yg and 71Yh formed in the insertion portion 71Y of the toner container frame 70. Referring to FIG. 30B, the discrimination protrusion in the discrimination portions 34Mg and 34Mh on the cap 34M are designed to fit only the recesses in the engagement portions 71Mg and 71Mh formed in the insertion portion 71M. Referring to FIG. 30C, the discrimination protrusion in the description portions 34Cg and 34Ch on the cap 34C are designed to fit only the recesses in the engagement portions 71Cg and 71Ch formed in the insertion portion 71C. Referring to FIG. 30D, the discrimination protrusions in the discrimination portions 34Kg and 34Kh on the cap 34K are designed to fit only the recesses in the engagement portions 71Kg and 71Kh formed in the insertion portion 71K.

With this configuration, if the user erroneously tries to insert the toner container of given color (e.g., yellow toner container 32Y) into the different color insertion portion (e.g., cyan toner insertion portion 71C), the discrimination portions 34*g* and 34*h* can prevent the toner container 32 containing a wrong color toner from being inserted into the insertion portion 71, thus eliminating a trouble that image formation of a desired color is not available. That is, due to the discrimination portions 34*g* and 34*h*, the setting error of the toner containers 32 can be prevented.

Herein, to have the color identification, the discrimination protrusions in the first and second discrimination portions 34*g* and 34*h* can be partly cut off differently in accordance with the type (color) of toner contained in that toner container 32. For example, referring to FIG. 8, the number of protrusions formed on the right and left (the discrimination portions 34*g* and 34*h*) of the cap in total is eight. When some of them are cut off with cutting tools, (e.g., nippers or cutters), various types of the discrimination portions 34*g* and 34*h* can be formed. In the present embodiment, the four different discrimination portions 34*g* and 34*h* are formed as shown in FIGS. 30A through 30D.

In this configuration, it is not necessary to manufacture multiple different types of molds in accordance with the types of the toner containers 32 (caps 34). Instead, the caps 34Y 34C, 34M and 34K having compatibility discrimination can be manufactured with the same type of mold. Therefore, the total cost for manufacturing the multiple types of the toner containers 32 can be reduced.

It is to be noted that, although four types of the caps 34, shown in FIGS. 30A through 30D, each having a specific compatibility discrimination, are formed in the present embodiment, the number of cap types can be increased by cutting off some of the discrimination protrusions in different combinations.

Figure 31A:
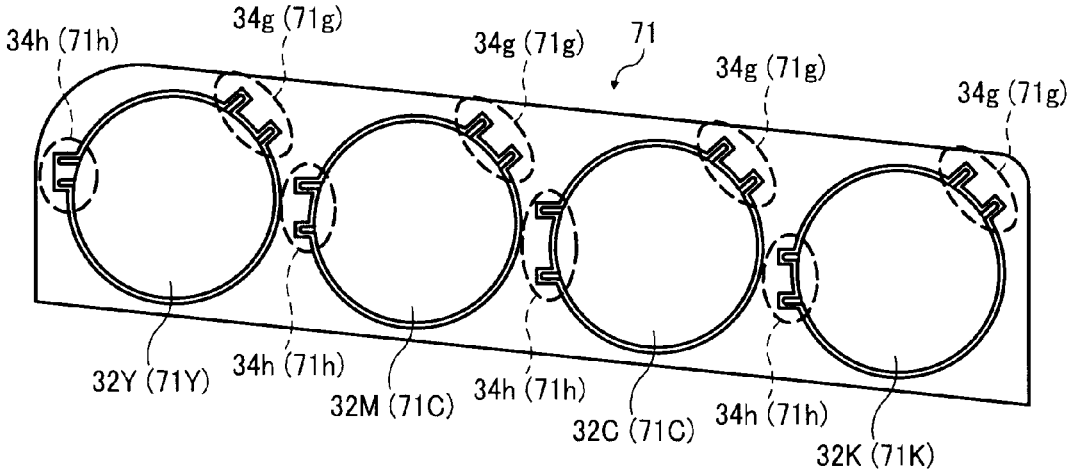
FIGS. 31A through 31C are front views illustrating a variation of the insertion portions in which different type toner containers are set.
Figure 31B:
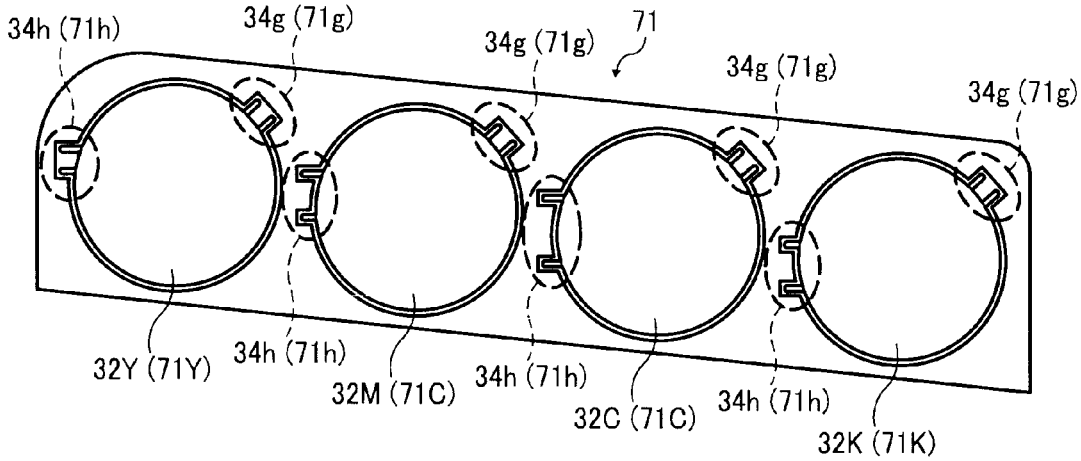
Figure 31C:
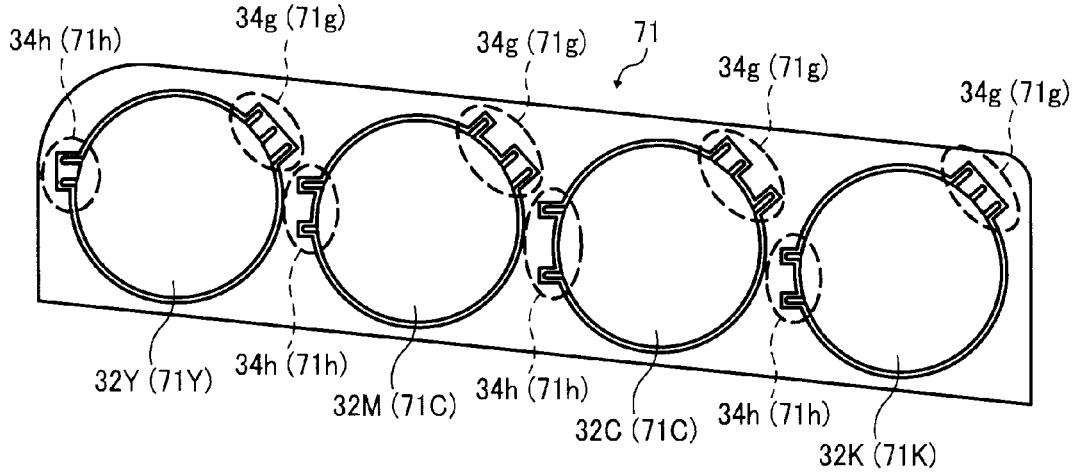

FIGS. 31A through 31C shows variations of the insertion portions 71 having different configurations for compatibility discrimination, in which the toner containers 32Y, 32M, 32C, and 32K are inserted.

In FIGS. 31A through 31C, wherever the discrimination protrusions in the discrimination portions 34*g* and 34*h* are arranged, the discrimination portion 34*g* (engagement portion 71*g*) does not interfere with the discrimination portion 34*h* (engagement portion 71*h*) of the adjacent insertion opening in the insertion portions 71. The four insertion openings in the insertion portion 71 are arranged not horizontally but obliquely so that the discrimination portion 34*g* on one side of, for example, the toner container 32Y is positioned higher than the discrimination portion 34*h* on the other side of the adjacent toner container 32M for magenta. It is to noted that, on the cross section perpendicular to the longitudinal direction, the respective protrusions (claw portions) in the discrimination portions 34*g* project from the outer circumferential surface of the cap 34 in parallel to each other, and the respective protrusions (claw portions) of the discrimination portions 34*h* project in parallel to each other.

In addition, the discrimination portions 34*g* and 34*h* are positioned on both sides of a vertical centerline (i.e., virtual perpendicular Z shown in FIG. 14) passing through a center of the substantially cylindrical cap 34 on the cross section perpendicular to the longitudinal direction. That is, in FIGS. 31A through 31C, one of the discrimination portions 34*g* and 34*h* is disposed on the right of the vertical centerline of the cap 34 and the other is disposed on the left of the vertical centerline. Accordingly, when any of the toner container 32M, 32C, and 32K is inserted into a wrong opening in the insertion portion 71 of the container frame 70, the contact pressure exerted by the discrimination protrusions 34*g* and 34*h* is not localized on one side of the cap, thus preventing deformation of the toner container 32 caused by such a localized force. In other words, when the toner container 32 is inserted into the wrong opening of the container frame 70 (insertion portion 71), the contact pressure exerted on the engagement portions 71*g* and 71*h* by the discrimination portions 34*g* and 34*h* can be distributed on both sides of the centerline of the cap 34Y in a balanced manner. In order to attain this effect, it is preferable that the discrimination portions 34*g* and 34*h* be shifted an angle ranging from about 120° to about 240° from each other in the circumferential direction of the cap 34Y.

As described above, the notch 34*x* (shown in FIG. 15) is formed in the circumference of the cap 34Y to expose the gear 33*c* of the container body 33Y partly. In the state in which the toner container 32Y is set in the toner container frame 70, the gear 33*c* exposed through the notch 34*x* of the cap 34Y engages the driving gear 81 provided in the cap holder 81 (at the position indicated by broken lines in FIG. 38). Therefore, the container body 33Y is rotated with the gear 33*c* by the driving gear 81.

Figure 16:
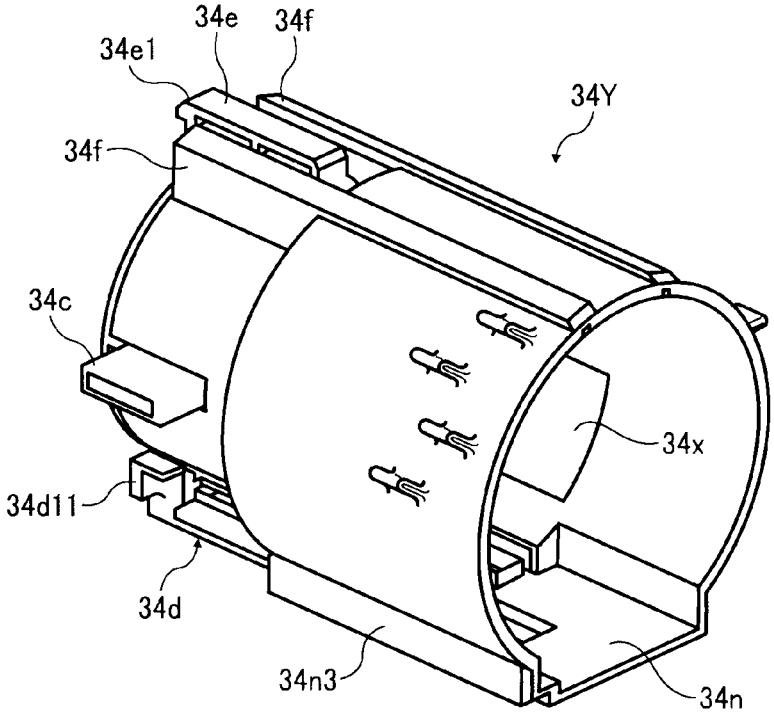
FIG. 16 is a perspective view that illustrating the cap when viewed from a connection side with the container body.
Figure 17:
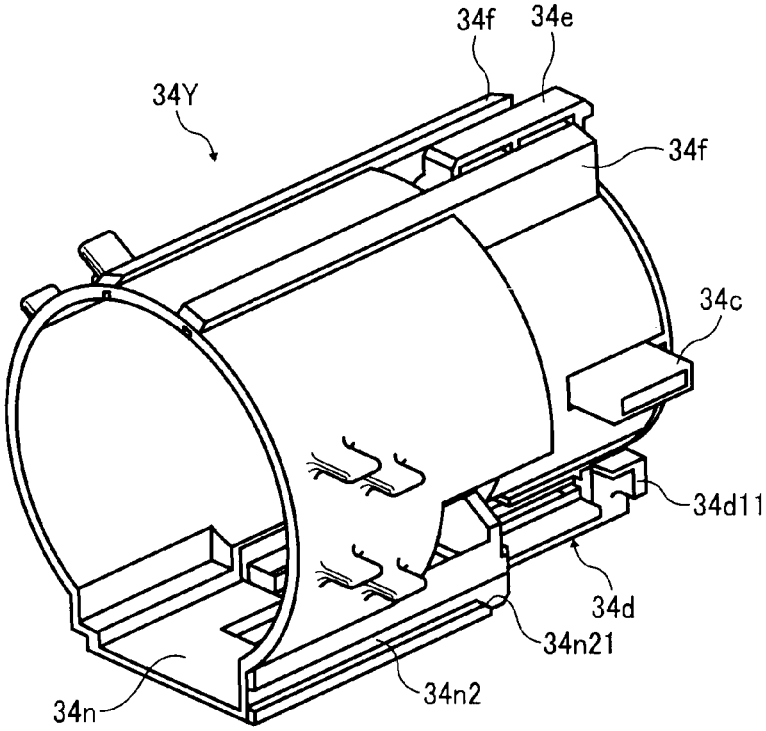
FIG. 17 is another perspective view of the connection side of the cap.

With reference to FIGS. 16 and 17, a shutter container 34*n* (containing space) is formed in the bottom portion (a second cap body 34Y2 shown in FIG. 25) of the cap 34Y. When the shutter 34*d* opens the toner outlet W, a part of the shutter 34*d* (deformable portion 34*d*2 shown in FIG. 26) is contained in the shutter container 34*n*. The shutter container 34*n* is shaped like a substantially rectangular parallelepiped projecting downward from the bottle insertion portion 34*z* (shown in FIG. 29), defined by the wall portion and interior of the cap 34Y. The shutter container 34*n* accommodates the deformable portion 34*d*2 in a deformed state, meaning that the deformable portion 34*d*2 elastically deforms upward, rotating about a connection portion with a shutter body 34*d*1 shown in FIG. 22. Referring to FIGS. 14 and 15, on an inner wall of the shutter container 34*n*, a pair of shutter rails 34*t* (see FIG. 22) serving as a shutter guide rail and a pair of slide grooves 34*n*1 are formed. The slide grooves 34*n*1 function as rails to guide opening and closing of the shutter 34*d*. A configuration and operation of the shutter 34*d* are described in further detail later.

Further, with reference to FIG. 15, a pressed rail 34*n*2 including a tip portion 34*n*21 is formed on one side of an outer surface of the shutter container 34*n*. The pressed rail 34*n*2 engages a pressing member 72*c* (shown in FIGS. 34 and 42) formed on the bottle holder 72. When the cap 34Y moves through the bottle holder 72 in installation of the toner container 32Y into the toner container frame 70, the position of the cap 34Y in the short side direction (lateral direction in which FIG. 8), perpendicular to the insertion and removal direction, is determined with the pressed rail 34*n*2 that engages the pressing member 72*c*. The pressed rail 34*n*2 is a recessed portion (groove), that is, the pressed rail 34*n*2 is formed of a recessed portion, an upper projecting portion, and a lower projecting portion. The pressed rail 34*n*2 extends in the longitudinal direction of the toner container 32Y (installation direction). The pressed rail 34*n*2 extends over the entire length of the shutter container 32*n* in the longitudinal direction (insertion direction), and the pressed rail 34*n*2 does not have a wall portion but opens on either end. Further, the tip portion 34*n*21 (on the downstream side in the insertion direction) on the lower side of the pressed rail 34*n*2 is tapered so that the pressing member 72*c* can engage smoothly with the pressed rail 34*n*2.

Further, with reference to FIG. 14, a pressure receiving face 34*n*3 is formed on the other side on the outer surface of the shutter container 34*n*. A pressure receiving member 72*d* (shown in FIGS. 34 and 42) is formed in the bottle holder 72 and slides on the pressure receiving face 34*n*3 to determine the position of the cap 34Y moving in the bottle holder 72 when the toner container 32Y is inserted into the toner container frame 70.

Figure 34:
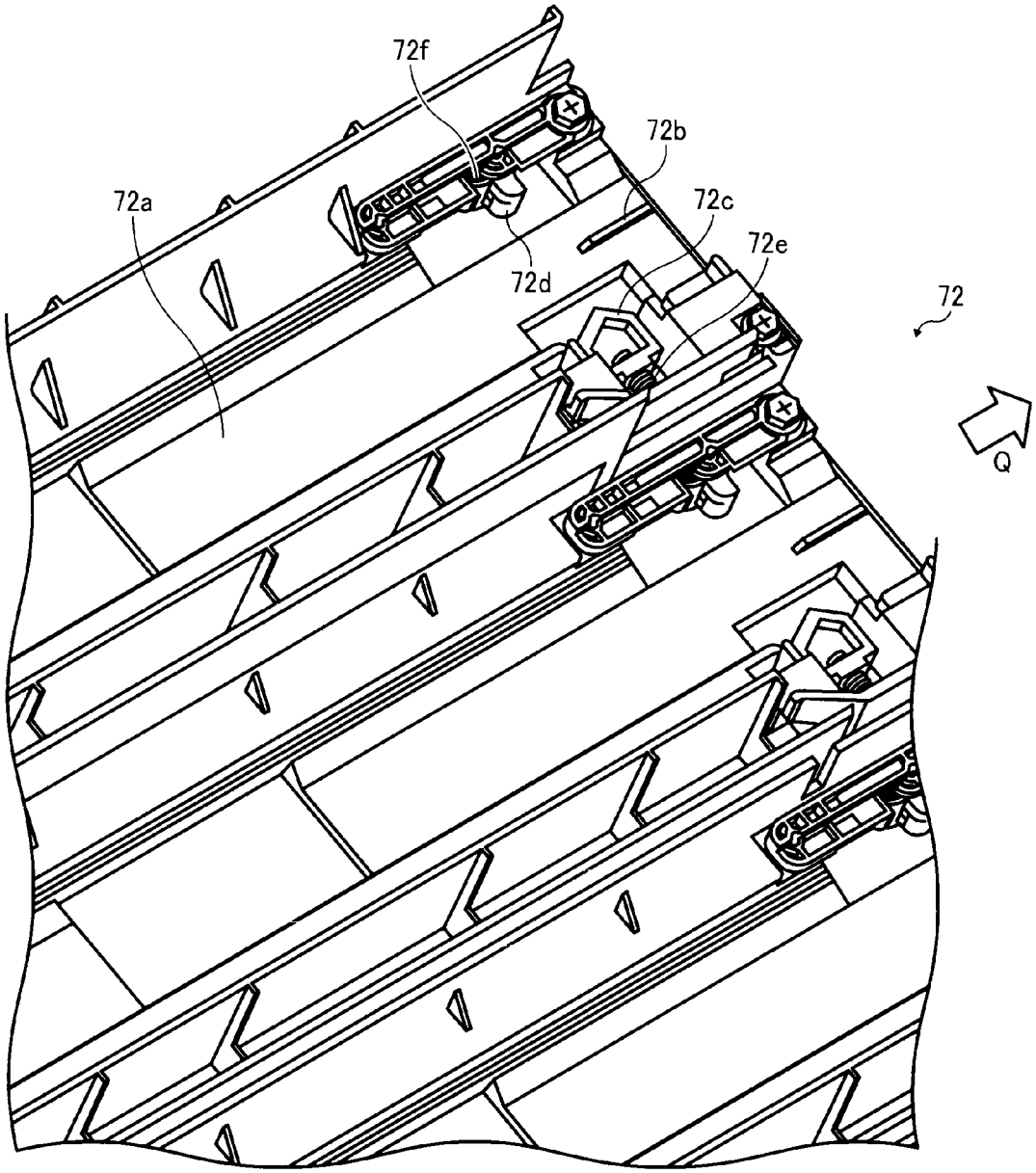
FIG. 34 is an enlarged perspective view illustrating the head portion of the bottle holder shown in FIG. 32.

With this configuration, immediately before the cap 34Y is installed into the cap holder 73 in installation of the toner container 32Y into the toner container frame 70, or immediately after the cap 34Y is removed from the cap holder 73 in removal of the toner container 32Y from the toner container frame 70, the pressed rail 34*n*2 engaging the pressing member 72*c* is pressed by the pressing member 72*c*, which is biased by a compression spring 72*e* (shown in FIG. 34). Then, the pressure receiving face 34*n*3 receives the pressing force while sliding on the pressure receiving member 72*d*. Thus, the position of the cap 34Y passing through the bottle holder 72 can be restricted immediately before inserted into or after released from the cap holder 73.

The cap 34Y configured as described above communicates with the container body 33Y through the opening A, and the toner discharged from the opening A is discharged through the toner outlet W (movement indicated broken lines shown in FIG. 3).

In the present embodiment, with reference to FIG. 28, the substantially cylindrical hollow B (space) in the cap 34Y extends in the longitudinal direction (lateral direction in FIG. 28). The inner diameter of the hollow B is smaller than the inner diameter of the bottle insertion portion 34*z* (shown in FIG. 29) into which the head portion of the container body 33Y is inserted. In addition, the cylindrical toner drop portion or (toner flow channel C (shown in FIG. 28) having a predetermined cross-sectional area extends from a lower face of the substantially cylindrical hollow B to the toner outlet W. With this configuration, the toner discharged from the opening A of the container body 33Y to the hollow B in the cap 34Y can drop through the cylindrical toner flow channel C smoothly outside (to the toner tank 61Y) under its own weight.

Figure 22:
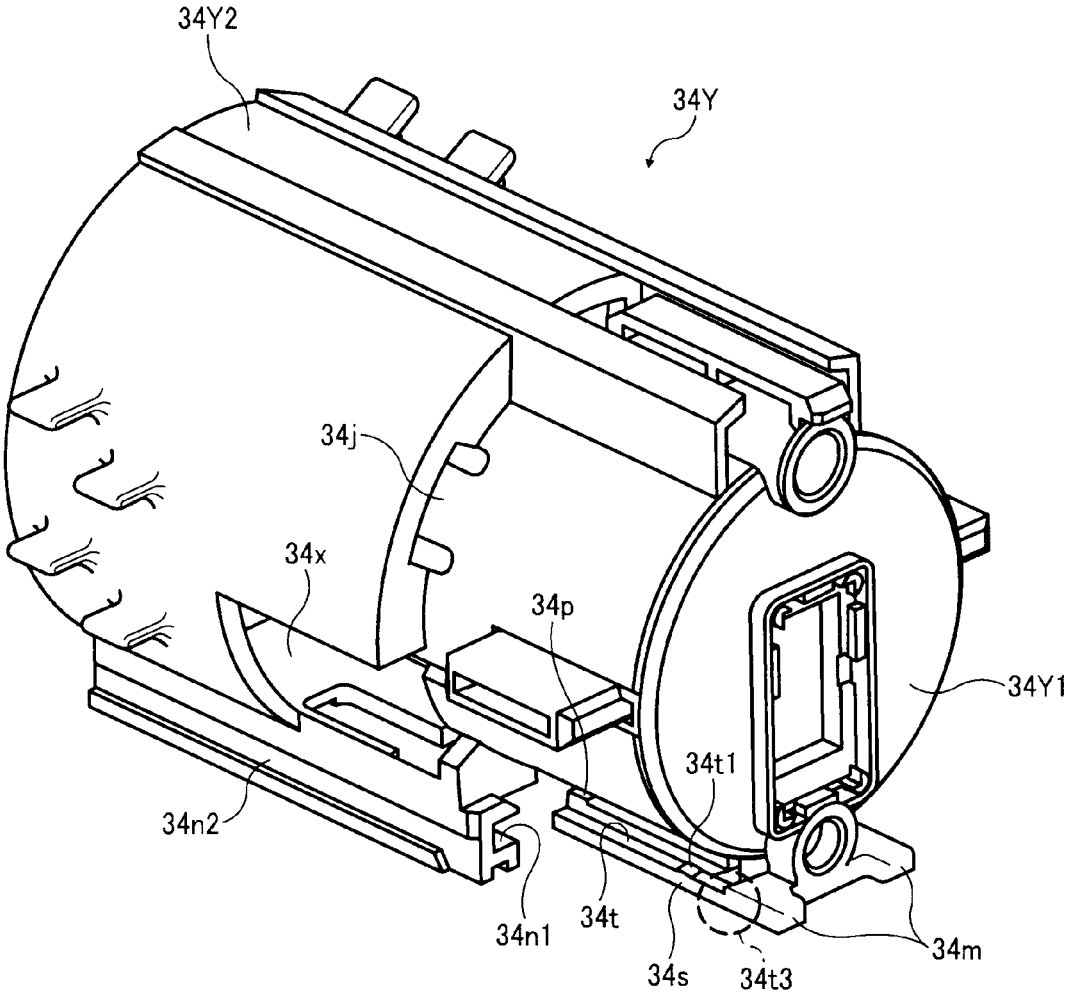
FIG. 22 is a perspective view illustrating the cap, from which the shutter is removed.

FIG. 22 illustrates the cap 34Y from which the shutter 34*d* and the shutter seal 36 are removed.

Figure 24:
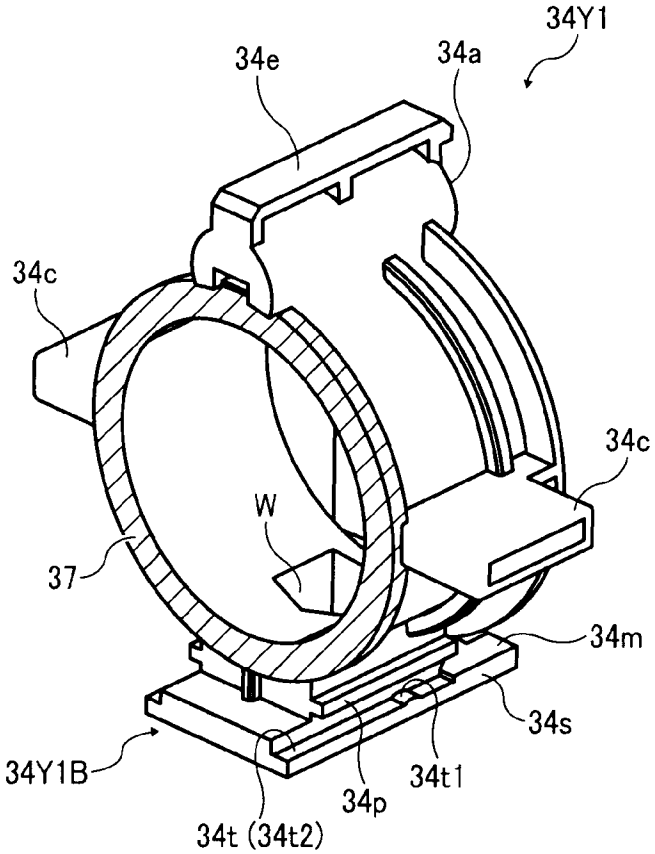
FIG. 24 is another perspective view illustrating the first cap body of the cap shown in FIG. 23.
Figure 23:
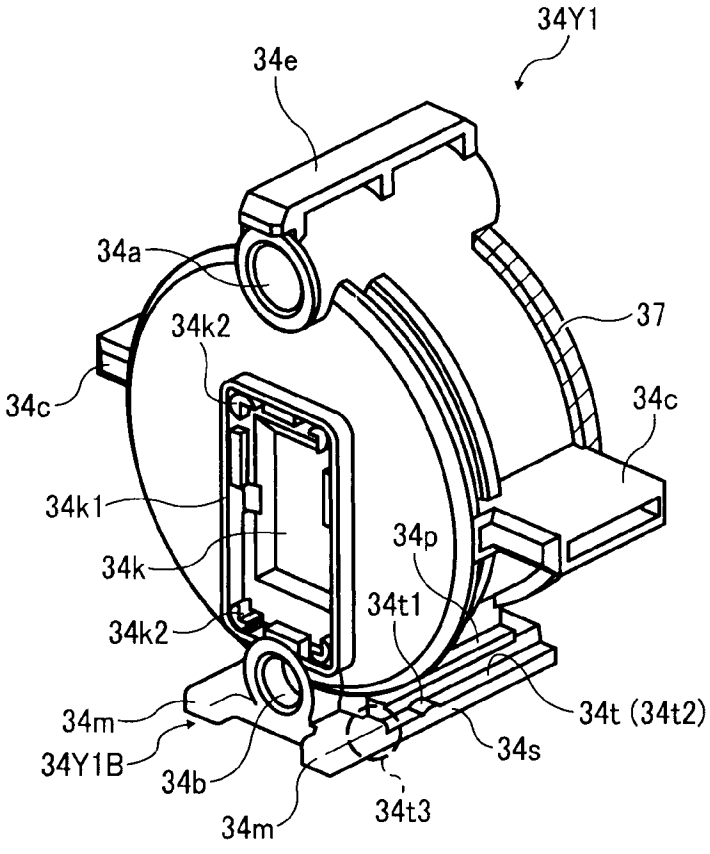
FIG. 23 is a perspective view illustrating a first cap body of the cap.
Figure 25:
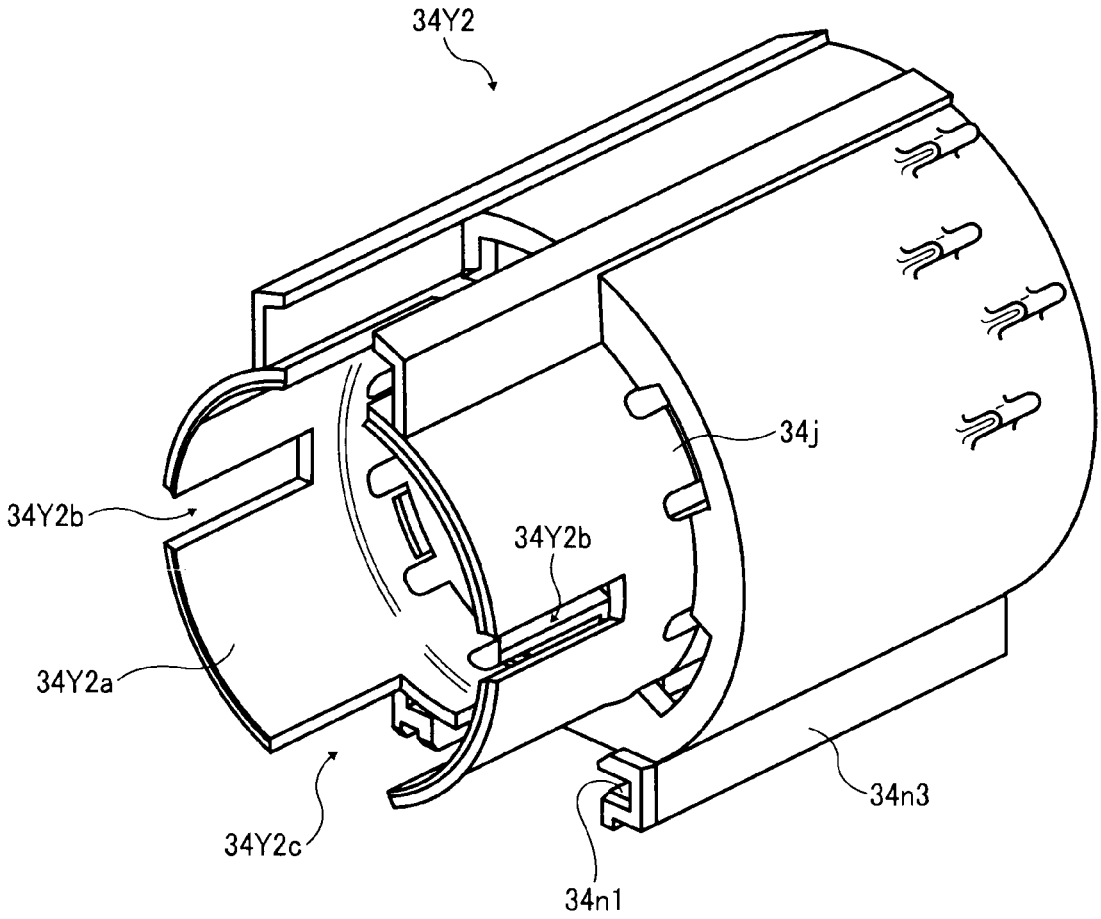
FIG. 25 is a perspective view illustrating a second cap body of the cap.

Referring to FIG. 22, the cap 34Y is constituted of a first cap body 34Y1 (see also FIGS. 23 and 24) and a second cap body 34Y2 (see also FIG. 25), which are welded together. In FIGS. 23 and 24, reference character 34Y1B represents a bottom portion (shutter support section) of the first cap body 34Y1. More specifically, the lateral protrusions 34*c* and the shutter support section 34Y1B (bottom portion) of the first cap body 34Y1 are fitted into notches 34Y2*b* and 34Y2*c* of the second cap body 34Y2, and the first cap body 34Y1 and the second cap body 34Y2 are welded together with an inner circumferential face 34Y2*c* of the second cap body 32Y2 in contact with a contact portion 34Y1*c*.

It is to be noted that, with reference to FIGS. 23 and 24, the circular cap seal 37 is bonded to an edge of the first cap body 34Y1 (facing the bottle rim 33*a* enclosing the opening A of the container body 33Y). The cap seal 37 is formed of an elastic material such as foam resin and fills a gap between the vicinity of the opening A of the container body 33Y and the face of the first cap body 34Y1 facing it. Example of the material of the cap seal 37 include foam polyurethane.

In addition, with reference to FIG. 23, the mounting section 34*k* to accommodate the RFID chip 35 is formed on the edge surface of the first cap body 34Y1. The rib (frame) 34*k*1 surrounding the mounting section 34 protrudes forward from the front surface of the first cap body 34Y1. Pedestals 34*k*2 to fix the four corners of the substantially rectangular RFID chip 35 are provided at four corners inside the rectangular rib (frame) 34*k*1 enclosing the mounting section 34*k*. Because the RFID chip 35 is set on the pedestals 34*k*2, an electronic device provided on a back side of the RFID chip 35, facing the first cap body 34Y1, can be preventing from contacting directly the first cap body 34Y1. It is to be noted that, to fix the RFID chips 35 in the mounting section 34*k*, the RFID chip 35 is put on the pedestals 34*k*2, after which the pedestals 34*k*2 are partly fused with heat and pressure and then cooled to solidify, thus bonding the pedestals 34*k*2 to the RFID chips 35.

As shown in FIGS. 23 and 24, the shutter rails 34*t* (shutter guide rails) are provided on either side of the bottom portion 34Y1B of the first cap body 34Y1 to guide the shutter 34*d* for opening and closing the toner outlet W in the longitudinal direction. A side rib 34*p* is positioned above the shutter rail 34*t*. The shutter rail 34*t* is formed in the vertical edge face 34*s* of the bottom portion 34Y1B of the first cap body 34Y1 in which the toner outlet W (see FIG. 28) is formed. In other words, the shutter rail 34*t* is formed using a part of the vertical face 34*s*. The shutter rails 34*t* are formed above upper faces 34*t*2 of projecting portions of the bottom portion 34Y1B on both ends (in the direction perpendicular to the surface of the paper on which FIG. 28 is drawn), and the vertical faces 34*s* are the both edge faces of the projecting portions of the bottom portion 34Y1B. The pair of vertical faces 34*s* is continuous from an end in the closing direction of the shutter rail 34*t* when the shutter is at the position to close the toner outlet W to the position projecting in the installation direction (also shown in FIG. 43).

More specifically, the cap 34Y includes the two projecting portions 34*m* shaped like horns, projecting in the longitudinal direction (installation direction) beyond the edge surface perpendicular to the longitudinal direction. The two projecting portions 34*m* are positioned close to the lower edge of the secondary positioning hole 34*b* and on both sides of the secondary positioning hole 34*b*. The two vertical faces 34*s* include vertical faces of the side edges of the respective projecting portions 34*m*. That is, the vertical surfaces of the projecting portions 34*m* are substantially aligned with the respective vertical faces 34*s* in which the shutter rails 34*t* are formed.

Figure 45:
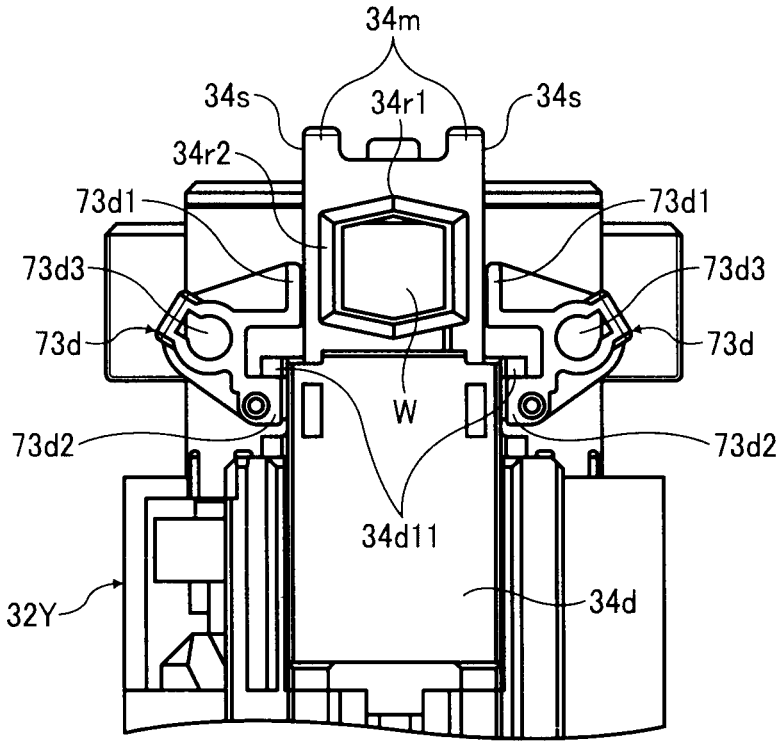
FIG. 45 is another bottom view subsequent to FIG. 44 and illustrates the process in which the toner outlet is opened by the shutter of the cap.

With reference to FIG. 45, the vertical faces 34*s* are pressed against first arms 73*d*1 of a pair of shutter retainers 73*d* in the cap holder 73. More specifically, the position of the shutter 34*d* in the cap 34Y set in the cap holder 73 is determined by the shutter retainers 73*d*.

Each shutter retainer 73*d* includes the wide long first arm 73*d*1 that contacts the side vertical face 34*s* of the shutter support section 34Y1B, a short second arm 73*d*2, and a rotary shaft 73*d*3 disposed in a center portion thereof. Herein, each projection portion 34*m* is for restraining the shutter retainers 73Y from releasing the shutter 34*d*. Referring to FIG. 45, the vertical faces 34*s* are extended in the direction of insertion by including the projection portion 34*m* therein. With this configuration, when the toner container 32Y is released from the toner container frame 70, a timing at which the shutter retainer 73*d* releases the vertical faces 34*s* held by the first arms 73*d*1 can be delayed from a timing at which the shutter retainers 73*d* completely close the shutter 34*d*. Accordingly, the toner container 32Y can be prevented from being released from the image forming apparatus 100 before the shutter 34*d* fully closes the toner outlet W. In particular, because the two projecting portions 34*m* are positioned beyond the edge of the primary positioning hole 34*a* in the direction of insertion (longitudinal direction), the first arms 73*d*1 can hold the shutter 34*d* until the last moment the cap 34Y is released from the cap holder 73. Thus the toner outlet W can be reliably closed by the shutter 34*d*.

As shown in FIGS. 23 and 24, the first cap body 34Y1 includes, in addition to the toner outlet W, the primary positioning hole 34*a* (main positioning reference) and the secondary positioning hole 34*b* (sub-positioning reference) for determining the position of the cap 34Y as well as the first engaging member 34*e* and the lateral protrusion 34*c* for restricting the movement of the cap 34Y. Therefore, even when the cap 34Y is formed with two molded pieces (first cap body 34Y1 and the second cap body 34Y2) bonded or thermally welded together, fluctuations in the accuracy of the molding or thermal welding are less likely to cause positional fluctuation of the toner outlet W of the cap 34Y relative to the toner supply opening 73*w* of the cap holder 73. Therefore, defective toner supply resulting from the position failure of the toner outlet W can be reduced or prevented.

It is to be noted that the structure and the operation of the shutter retainer 73*d* are described in further detail later with reference to FIGS. 43 through 48.

The shutter 34*d* is attached to the bottom portion of the cap 34Y configured as described above, and the shutter seal 36 (seal member) is bonded to an upper face of the shutter 34*d* facing the toner discharge outlet W. The configuration and operation of the shutter 34*d* are described in further detail below. As shown in FIGS. 18 through 20, the shutter 34*d* opens and closes the toner outlet W in conjunction with the installation of the toner container 32Y into the toner container frame 70.

Figure 26:
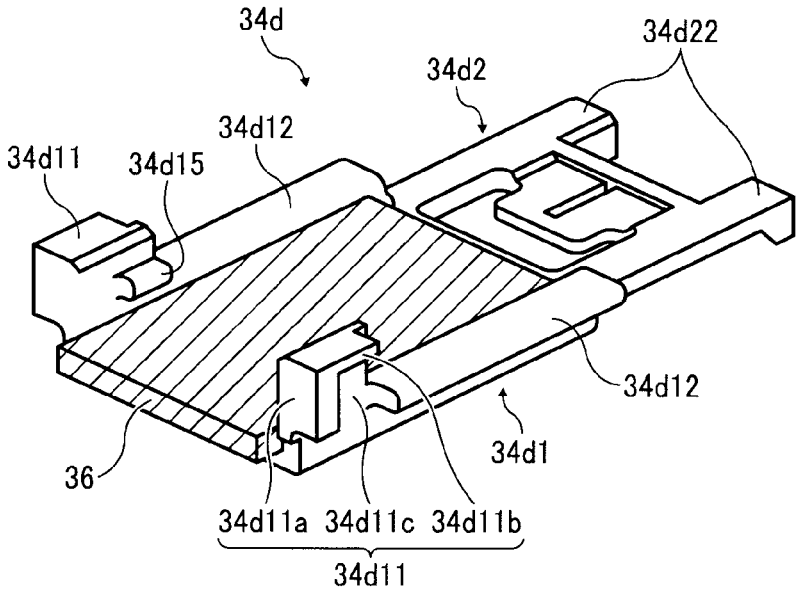
FIG. 26 is a perspective view illustrating the shutter.
Figure 27:
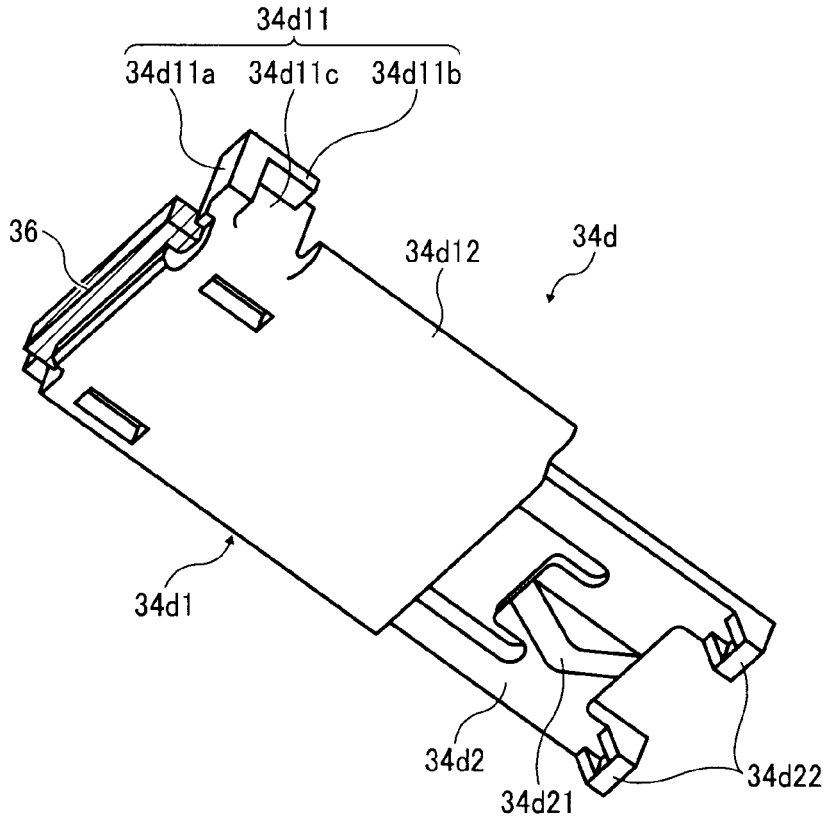
FIG. 27 is another perspective view of the shutter shown in FIG. 26.

FIGS. 26 and 27 are perspective views illustrating the shutter 34*d* as viewed from different angles.

As shown in FIGS. 26 and 27, the shutter 34*d* includes the planar shutter body 34*d*1 and the elastic deformable portion 34*d*2 projecting from the shutter body 34*d*1 to the side of the container body 33Y. The deformable portion 34*d*2 is thinner than the shutter body 34*d*1. The shutter body 34*d*1 includes a pair of clamped portions 34*d*11, a pair of shutter sliders 34*d*12 projecting outward from the sides of the shutter body 34*d*1, and a pair of shutter-rail engagement portions 34*d*15 each formed on an inner face of the shutter slider 34*d*12. The pair of clamped portions 34*d*11 stands upward on both sides of an end portion of the shutter body 34*d*1 opposite the deformable portion 34*d*2. The shutter sliders 34*d*12 are projecting portions provided on both sides of the shutter body 34*d*1 and extend in the direction of insertion of the toner container 32Y. Each shutter-rail engagement portion 34*d*15 projects inward from the shutter body 34*d*1 (on the opposite of projection of the shutter slider 32Y*d*12), positioned at a predetermined distance from the shutter seal 36 in a vertical direction in FIGS. 26 and 27. In addition, the length of the shutter slider 32Y12 in the direction of insertion of the toner container 32Y is equal or similar to the length from an end of the shutter rail 34*t* to a shutter projection 34*t*1 formed on the shutter rail 34*t* in the longitudinal direction when the shutter 34*d* is attached to the first cap body 34Y1 (see FIGS. 23 and 24). It is to be noted that the length of the slide grooves 34*n*1 formed in the shutter container 34*n* in the second cap body 34Y2 (see FIG. 25) in the direction of insertion is almost equal to the length of the shutter sliders 34*d*12.

The shutter sliders 34*d*12 of the shutter body 34*d*1 are fitted into the respective slide grooves 34*n*1 (outside rail) of the second cap body 34Y2. Further, the shutter rails 34*t* (inside rail) of the first cap body 34Y1 are interposed between the respective shutter-rail engagement members 34*d*15 and the shutter seal 36, engaged therewith. In this state, the shutter 34*d* moves along the rails (the slide groove 34*n*1 and the shutter rail 34*t*), and the shutter body 34*d*1 of the shutter 34*d* opens and closes the toner outlet W.

As described above, the shutter seal 36 is bonded to the upper face of the shutter body 34*d*1 that faces the toner outlet W. The shutter seal 36 can be formed of an elastic material for preventing leakage of the toner between the shutter body 34*d*1 and the toner outlet W when the toner outlet W is closed by the shutter body 34*d*1 of the shutter 34*d*.

In the present embodiment, as shown in FIGS. 26 and 27, the shutter seal 36 is disposed projecting beyond the end of the shutter body 34*d*1 in the longitudinal direction (direction of insertion). When the cap 34Y is installed into the cap holder 73, the tip portion (projecting portion) of the shutter seal 36 closely contacts a wall 73*w*1 (see FIGS. 38 and 42) surrounding the toner supply opening 73*w*, and thus the shutter seal 36 can prevent leakage of the toner to the vicinity of the toner supply opening 73*w*.

As shown FIGS. 21A through 21C, 26, and 27, the deformable portion 34*d*2 is integrally formed with the shutter body 34*d*1 and is elastically deformable (pivotable) vertically around a connection point (indicated by broken circle in FIGS. 21B and 21C) between the deformable portion 34*d*2 and the shutter body 34*d*1. The deformable portion 34*d*2 is positioned on the side of the container body 33Y in the longitudinal direction relative to the shutter body 34*d*1 (see FIG. 18). In FIGS. 21A through 21C, and 27, the deformable portion 34*d*2 includes a pair of stoppers 34*d*22 and a stopper release member 34*d*21.

Each stopper 34*d*22 is a wall formed on a leading tip portion of the deformable portion 34*d*2 in a direction in which the shutter 34*d* relatively moves to open the toner outlet W (hereinafter "opening direction"), which is on the side of container body 33Y (on the left in FIGS. 21A through 21C). That is, the stoppers 34*d*22 are positioned farthest in the deformable portion 32*d*2 from the shutter body 34*d*1. Because edge faces of the stoppers 34*d*22 contact a contact face 34*n*5 of the shutter container 34*n*, the stoppers 34*d*22 restrict the movement of the shutter 34*d* in the opening direction. That is, when the toner container 32Y is not set in the image forming apparatus 100, the stoppers 34*d*22 of the shutter 34*d* contact the contact face 34*n*5, preventing the shutter 34*d* from moving in the opening direction, and thus the toner outlet W can be kept closed. It is to be noted that the opening direction of the shutter 34*d* is opposite the insertion direction of the toner container 32Y indicated by arrow Q.

Figure 32:
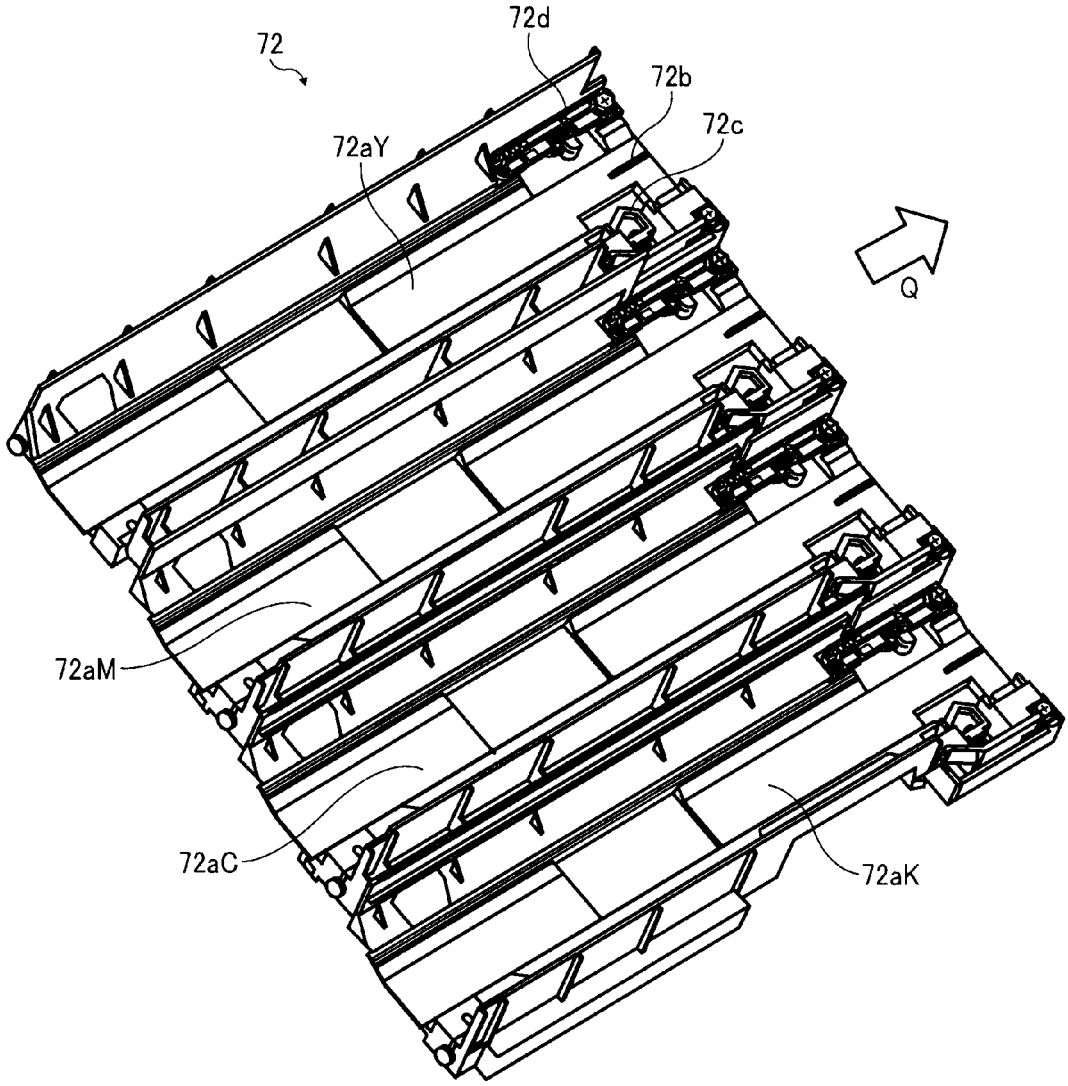
FIG. 32 is a perspective view illustrating a bottle holder in the toner container frame.
Figure 42:
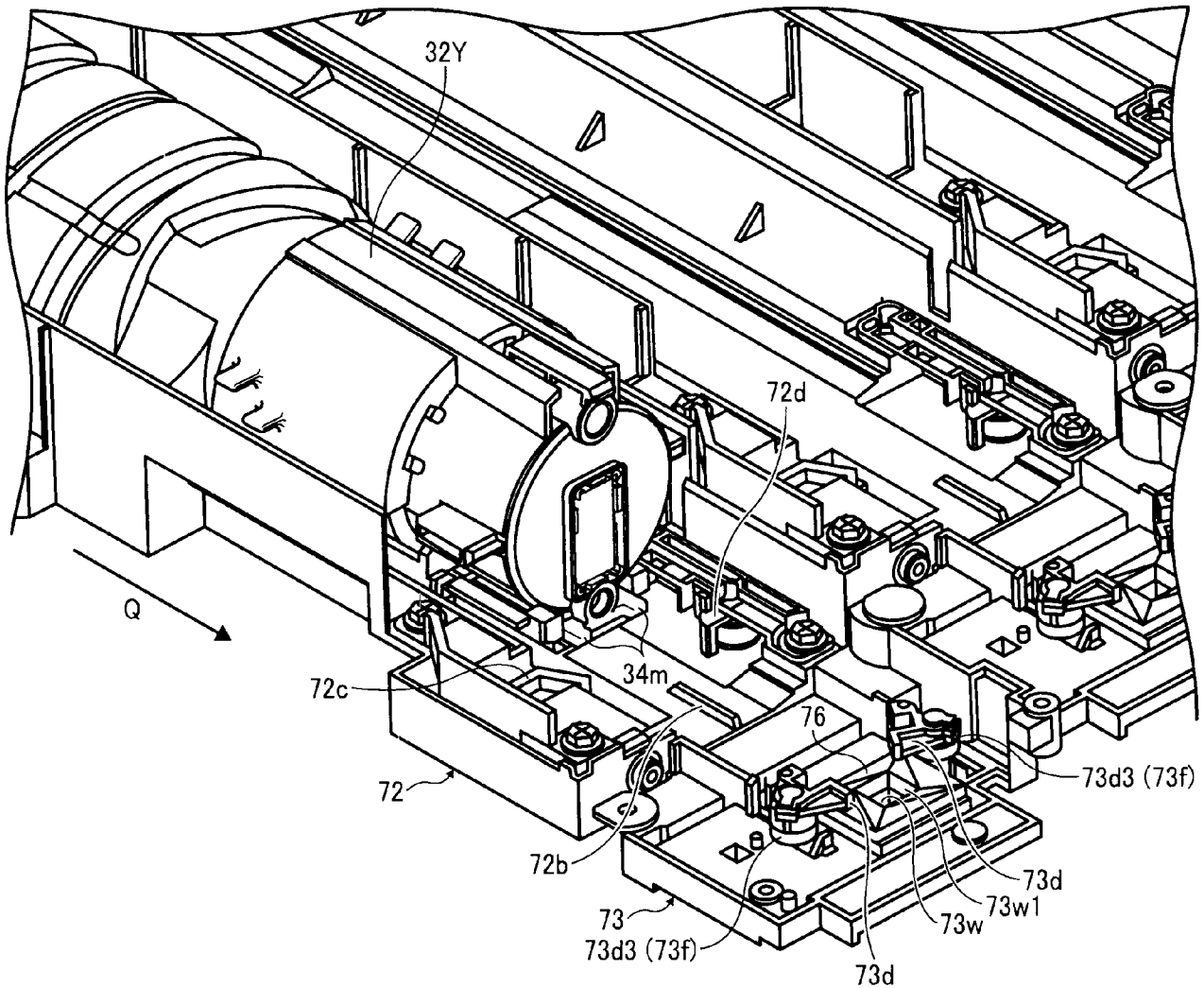
FIG. 42 is a perspective view illustrating processes of insertion of the toner container into the toner container frame.

As shown in FIG. 27, the stopper release member 34*d*21 (stopper release projection) projects downward from the deformable portion 34*d*2. As the deformable portion 34*d*2 elastically deforms receiving an external force, the stoppers 34*d*22 move upward and are disengaged from the contact face 34*n*5. The stopper release member 34*d*21 is a mountain-shaped projection formed between the stoppers 34*d*22 and the connection between the shutter body 34*d*1 and the deformable portion 34*d*2. The stopper release member 34*d*21 is sloped on both sides in the longitudinal direction. With reference to FIGS. 32 and 42, a bottom projection 72*b* (pressing projection) that is a trapezoidal rib is provided in an end portion of a bottle receiving face 72*a* in the bottle holder 72 (on the downstream side in the insertion direction indicated by arrow Q). With this configuration, in conjunction with insertion of the toner container 32Y into the toner container frame 70, the sloped side of the stopper release member 34*d*21 contacts the bottom projection 72*b* and then climbs onto the bottom projection 72*b*. Thus, with the stopper release member 34*d*21 pushed up by the bottom projection 72*b*, that is, with the external force from below, the deformable portion 34*d*2 is deformed upward and the stoppers 3422 are moved up. Thus, the stoppers 34*d*22 are disengaged from the contact face 34*n*5, and the shutter 34*d* becomes movable in the opening direction.

Next, with reference to FIGS. 21A through 21C, movement of the shutter 34*d* relative to the shutter container 34*n* of the cap 34Y in conjunction with the installation of the toner container 32Y is described below. It is to be noted that the positions of the shutter 34*d* shown in FIGS. 21A, 21B, and 21C respectively correspond to those shown in FIGS. 18, 19, and 20, relative to the second cap body 34Y2.

As shown in FIG. 21A, when the insertion of the toner container 32Y into the toner container frame 70 (to the right in FIG. 21A) is started and (from left side to right side in FIGS. 21A through 21C) and the stopper release member 34*d*21 has not yet reached the bottom projection 72*b* in the bottle holder 72, the stoppers 34*d*22 are in contact with the contact face 34*n*5, and thus the movement of the shutter 34*d* in the opening direction is restricted.

As the toner container 32Y is further inserted, as shown in FIG. 21B, the stopper release member 34*d*21 is pressed up by the bottom projection 72*b*, and the deformable portion 34*d*2 elastically deforms (pivots) around the connection point (indicated by the broken circle shown in FIG. 21B) between the deformable portion 34*d*2 and the shutter body 34*d*1. As a result, the stoppers 34*d*22 are disengaged from the contact face 34*n*5, and the shutter 34*d* can move in the opening direction relative to the toner container 32Y.

Subsequently, the shutter body 34*d*1 of the shutter 34*d* contacts the wall 73*w*1 surrounding the toner supply opening 73*w* (see FIGS. 38 and 39), and the movement of the shutter 34*d* in the cap holder 73 of the toner container frame 70 is restricted. That is, the shutter 34*d* does not move absolutely in the longitudinal direction. The toner container 32Y, however, is moved further in the direction of insertion; the shutter 34*d* moves relative to the toner container 32Y in the opening direction. That is, as shown in FIG. 21C, the shutter 34*d* moves relatively toward the container body 33Y, and then the shutter 34*d* is contained in the shutter container 32*n* (container space). Then, movement of the shutter 34*d* in the opening direction is completed, and the toner outlet W is fully opened. At this time, the stopper release member 34*d*21 of the shutter 34*d* is stored in a notch 34*n*6 formed on the bottom of the shutter container 34*n* (also shown in FIG. 20).

As described above, in the toner container 32Y according to the present embodiment, the shutter 34*d* includes the shutter body 34*d*1 and the deformable portion 34*d*2 that elastically pivots around the connection point therebetween, and the deformable portion 34*d*2 includes the stoppers 34*d*21 to restrict the movement of the shutter 34*d* in the opening direction and the stopper release member 34*d*21 to release the stoppers 34*d*22. Therefore, when the toner container 32Y is not installed, the shutter 34*d* can be prevented from opening the toner outlet W spontaneously. In other words, only when the toner container 32Y is installed in the image forming apparatus 100, the shutter 34*d* opens the toner outlet W in conjunction with the installation operation.

Herein, the shutter-rail engagement members 34*d*15 (see FIG. 26) contact a second contact portion 34*t*3 indicated by a broken circle shown in FIGS. 22 and 23 and also function as second stoppers to restrict the movement of the shutter 34*d* in a direction to close the toner outlet W (closing direction), opposite the direction in which the stoppers 34*d*22 restrict the movement of the shutter 34*d*. The closing direction of the shutter 34*d* is identical to the insertion direction of the toner container 32Y indicated by arrow Q. More specifically, when the shutter 34*d* relatively moves from the open position (shown in FIG. 20) to a closed position (shown in FIG. 18) to close the toner outlet W, the shutter-rail engagement members 34*d*15 of the shutter 34*d* contact the second contact portion 34*t*3 on the shutter rail 34*t* on the downstream side in the closing direction, and the stoppers 34*d*22 contact the contact face 34*n*5 of the shutter container 34*n* on the upstream side in the closing direction. Thus, the position of the shutter 34*d* to close the toner outlet W is determined.

Regarding this positioning, the user can feel a click sensation and recognize that the toner outlet W is fully closed with the shutter 34*d* when the shutter-rail engagement portions 34*d*15 contact the second contact portions 34*t*3 immediately after passing over the projection portion 34*t*1 on the shutter rail 34*t* (see FIGS. 23 and 24). In other words, for such an effect, the second contact portions 34*t*3 are positioned adjacent to and downstream from the shutter projection 34*t*1 in the closing direction of the shutter 34*d*.

It is to be noted that, as shown in FIGS. 22 through 24, the rib 34*p* extending in the longitudinal direction is provided across a groove above the shutter rail 34*t*, and an outer side face of the rib 34*p* is aligned with or in parallel to the vertical face 34*s*. Each rib 34*p* prevents the first arm 73*d*1 of the shutter retainer 73*d* from entering the groove above the shutter rail 32*t* when the vertical face 34*s* of the shutter rail 34*t* is held by the first arm 73*d*1. That is, the distance between the shutter rail 34*t* and the rib 34*p* (height of the groove) is smaller (lower) than the height of the first arm 73*d*1 in the direction orthogonal to the surface of the paper on which FIG. 45 is drawn.

It is to be noted that this effect of the ribs 34*p* can be attained as long as the ribs 34*p* project laterally (orthogonal to the surface of the paper on which FIG. 28 is drawn) and extend in the longitudinal direction (lateral direction in FIG. 28); the above-described vertical surface is not essential.

Figure 43:
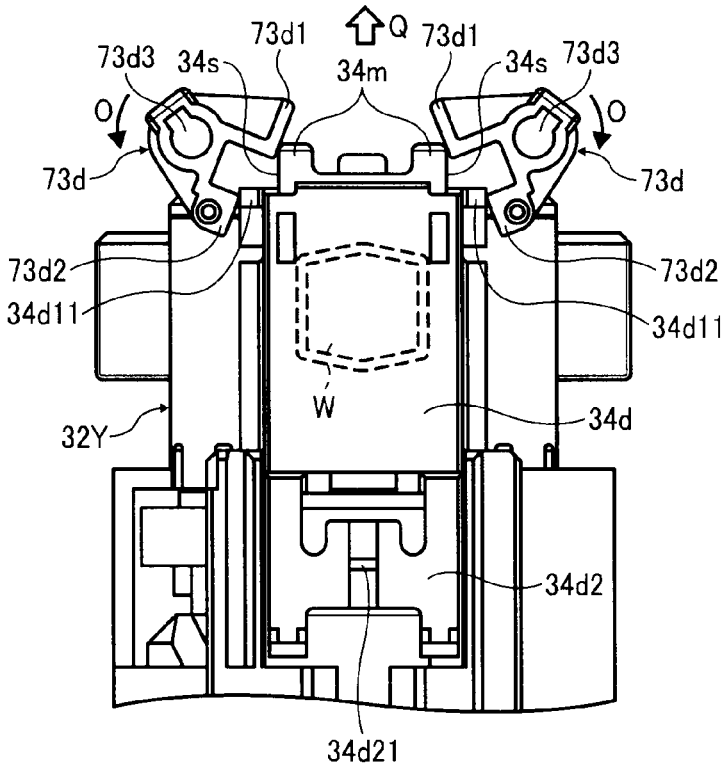
FIG. 43 is a bottom view illustrating a process in which the shutter engages shutter retainers of the cap holder and opens the toner outlet.
Figure 44:
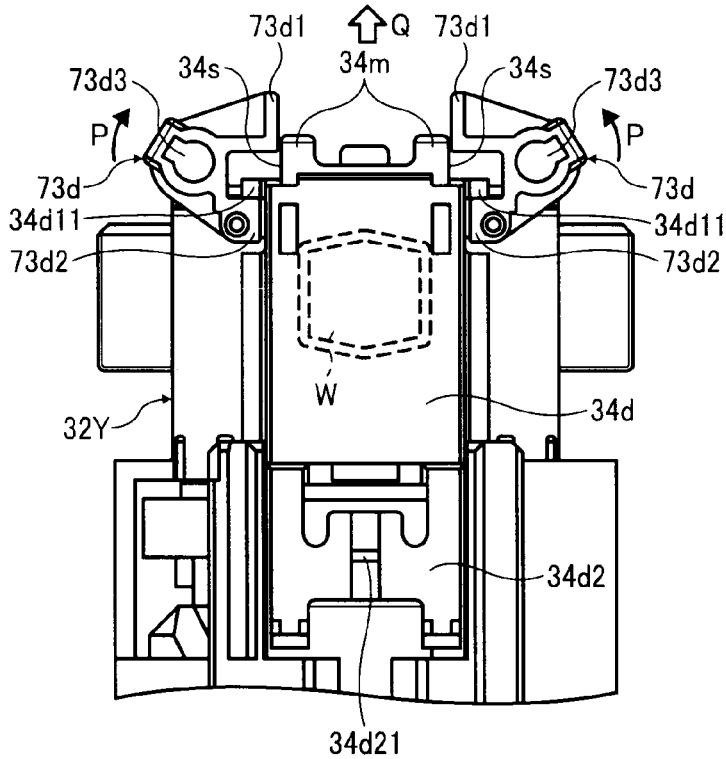
FIG. 44 is another bottom view subsequent to FIG. 43 and illustrates the process in which the toner outlet is opened by the shutter of the cap.

Additionally, referring to FIGS. 26 and 27, the clamped portions 34*d*11 are provided on both sides in the leading end portion of the shutter body 34*d*1 in the installation direction. As shown in FIGS. 43 through 45, the clamped portions 34*d*11 are held by the second arms 73*d*2 of the shutter retainers 73*d*, respectively. As shown in FIG. 26, each clamped portion 34*d*11 includes an engagement wall 34*d*11*a* standing on the leading edge in the installation direction, a sidewall 34*d*11*c* also functioning as a sidewall of the shutter body 34*d*1, and a movement restriction wall 34*d*11*b* extending in parallel to the insertion direction and provided in an upper portion of the clamped portion 34*d*11, above the sidewall 3411*c* in FIG. 26.

Figure 38:
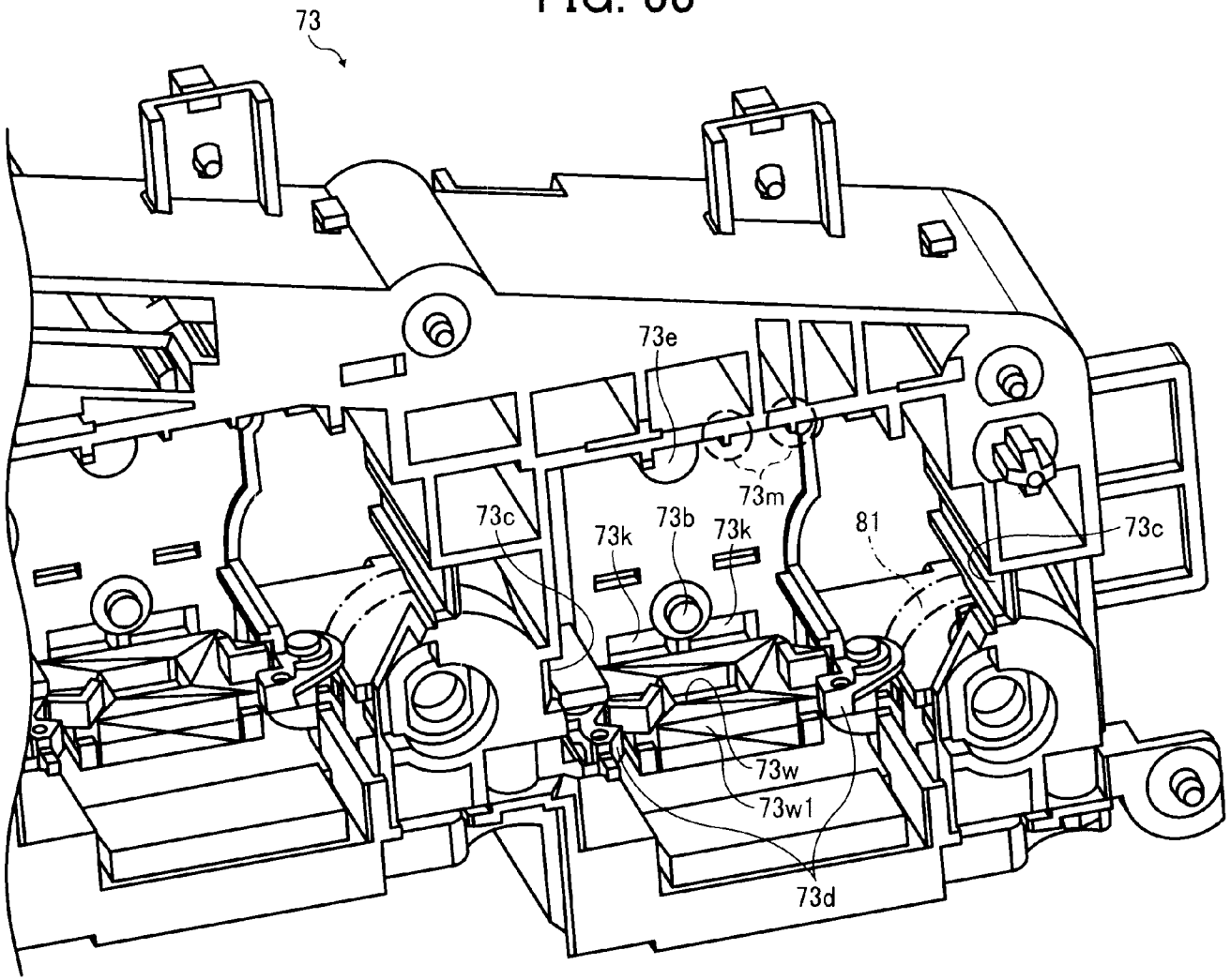
FIG. 38 is an enlarged perspective view illustrating a part of the cap holder shown in FIG. 37.

As shown in FIGS. 38 and 42, the pivotable shutter retainers 73*d* are provided in the cap holder 73 and face each other in a lateral direction in FIG. 43. When the shutter 34*d* opens and closes the toner outlet W, the clamped portions 34*d*11 are held by the second arms 73*d*2 of the shutter retainer 73*d*, and the vertical faces 34*s* of the cap 34Y are held by the first arms 73*d*1, and thus the positions of the shutter 34*d* and the cap 34Y in the cap holder 73 are determined. At this time, the second arm 73*d*2 of each shutter retainer 73*d* holds the sidewall 34*d*11*c* (shown in FIG. 26) of the clamped portion 34*d*11 in the shutter body 34*d*1, and the movement restriction wall 34*d*11*b* prevents the clamped portion 34*d*11 from moving vertically relative to the second arm 73*d*2. Additionally, the engagement wall 34*d*11*a* engages the second arm 73*d*2, which is described in further detail later.

Next, the shape of the toner outlet W is described below.

Referring to FIGS. 20 and 45, the toner outlet W opened and closed by the above-described shutter 34*d* is hexagonal when viewed from the lower side of the cap 34Y. More specifically, a rim 34*r* that projects downward from the bottom side of the shutter support section 34Y1B in the cap 34Y encloses the hexagonal toner outlet W. The enclosure of the rim 34*r* is sharpened toward both ends away from a center position of the toner outlet W in the direction of insertion and includes tips 34*r*1 positioned on both sides of the rim 34*r* in the longitudinal direction (vertical direction in FIG. 45) of the toner container 32Y. That is, the width of the toner outlet W is reduced with the increase in the distance from the center position of the toner outlet W. Specifically, when viewed from the lower side, the rim 34*r* is hexagonal and includes two pairs of lateral portions on both side of either apex (tip 34*r*1) and a pair of parallel side rims 34*r*2 extending in the longitudinal direction (vertical direction in FIG. 45). Then, the toner outlet W is hexagonal in conformity with the shape of the hexagonal rib 34*b*.

As descried above, the width (length in the direction perpendicular to the longitudinal direction of the toner container 32Y) of the rim 34*r* surrounding the toner outlet W is gradually narrowed toward the tips 34*r*1 in the longitudinal direction (opening and closing direction of the shutter 34*d*). Therefore, when the shutter 34*d* closes the toner outlet W, sliding contact between the shutter seal 36 bonded to the shutter 34*d* and the rim 34*r* of the toner outlet W is started at the tip 34*r*1 having a smaller area. Then, the contact area between the shutter seal 36 and the lateral portions of the rim 34*r* is gradually increased as the width of the enclosure of the rim 34*r* increases. With this configuration, although the shutter seal 36 contacts the rim 34*r*, peeling the shutter seal 36 from the shutter 34*d* or damage to the shutter seal 36 can be inhibited. When the shutter 34*d* opens the toner outlet W, the contact area between the shutter seal 36 and the side rims 34*r*10 is gradually reduced; the damage to the shutter seal 36 caused by the contact with the rim 34*r* can be reduced.

In addition, a seal member 76 formed of an elastic material (e.g., foam resin) is provided around the toner supply opening 73*w* (also shown in FIG. 42) of the cap holder 73 to prevent scattering of toner from the toner supply opening 73*w* communicating with the toner outlet W of the toner container 32Y. Therefore, when the rim 34*r* slides on the seal member 76 around the toner supply opening 73*w* in installation of the cap 34Y into the cap holder 73 in the longitudinal direction, sliding contact between the rim 34*r* and the seal member 76 can start at the tip 34*r*1 having a smaller area, and the contact area can increase gradually. Accordingly, the peeling the seal member 76 from the toner supply opening 73*w* and damage to the seal member 76 can be alleviated similarly. In addition, when the cap 34Y is removed from the cap holder 73 in the longitudinal direction, the contact area (sliding area) between the rim 34*r* and the seal member 76 on the toner supply opening 73*w* can be reduced gradually; the damage to the seal member 76 surrounding the toner supply opening 73*w* can be reduced.

Therefore, the toner contained in (or remaining in) the toner container 32Y can be reliably prevented from scattering outside when the toner container 32Y is installed in or released from the image forming apparatus 100.

It is to be noted that, referring to FIG. 20, the rim 34*r* is tapered so that the projecting amount thereof gradually decreases in the longitudinal direction (vertical direction in FIG. 45) with increases in the distance from the center position of the toner outlet W, that is, the height of the rim 34*r* of the cap 34Y decreases toward the tips 34*r*1 on both sides in the longitudinal direction although it not clearly shown in the drawings.

With this configuration, even when the shutter seal 36 bonded to the shutter 34*d* slides on the rim 34*r* in conjunction with the installation of the toner container 32Y in the longitudinal direction, peeling the shutter seal 36 from the shutter 34*d* can be prevented, and damage to the shutter seal 36 can be reduced. Similarly, even when the rim 34*r* slides on seal member 76 (see FIG. 42) surrounding the toner supply opening 73*w* in conjunction with the installation of the toner container 32Y in the longitudinal direction, peeling the seal member 76 from the toner supply opening 73*w* can be prevented, and damage to the seal member 76 can be damaged.

Herein, the respective color toners contained in the toner container 32Y, 32M, 32C, and 32K according to the embodiments of the present invention have a volume average particle diameter of 3 μm to 8 μm. Additionally, the ratio of Dv/Dn is 1.00 to 1.40 when Dv represents a volume average particle diameter and Dn represents a number average particle diameter.

Accordingly, toner particles suitable to image patterns can be selected in image development, and satisfactory developing performance can be attained even when the toner is agitated in the development device 5 for a relatively long time. Thus, high quality images can be produced. In addition, the above-described toner particles can be effectively and reliably transported without clogging toner conveyance tubes forming the toner supply path 64Y.

It is to be noted that volume average particle diameter Dv and number average particle diameter Dn of the toner particles can be measured by, for example, COULTER Counter TA-II (COULTER ELECTRONIC COMPANY) or COULTER Multisizer II (COULTER ELECTRONIC COMPANY).

In addition, it is preferable that the toner used in the present embodiment be substantially spherical and have a first shape factor SF-1 and a second shape factor SF-2 both within a range of 100 to 180. With such toner, higher transfer effectiveness can be maintained while preventing degradation of cleaning performance. In addition, the above-described toner particles can be effectively and reliably transported without clogging toner conveyance tubes forming the toner supply path.

The first shape factor SF-1 is a parameter representing the degree of roundness of toner particles and can be expressed by the following formula:

$$SF\text{-}1=(M^2/S)\times(100\pi/4)$$

wherein M represents the maximum particle diameter of a toner particle projected on a two-dimensional plane, and S represents the projected area of the toner particle. The toner particle is a perfect sphere when the first shape factor SF-1 is 100. As the first shape factor SF-1 increases, the degree of sphericity decreases.

In addition, the second shape factor SF-2 represents irregularity (i.e., a degree of unevenness in the spherical surface) of toner particles and can be expressed by the following formula:

$$SF\text{-}2=\{N^2/S\}\times(100\pi/4)$$

wherein N is the peripheral length of a toner particle projected on a two-dimensional plane and S represents the projected area of the toner particle. The surface of the toner particle is smooth when the second shape factor SF-2 is 100, and the surface of the toner particle becomes more uneven as the second shape factor SF-2 increases.

The first shape factor SF-1 and second shape factor SF-2 can be measured by taking a photograph using a scanning electron microscope, S-800 (Hitachi, Ltd.) and analyzing the photograph using an image analyzer, LUSEX3 (NIRECO CORPORATION).

Next, turning now to FIGS. 32 through 48, structures and operations of the toner container frame 70 including the bottle holder 72 and the cap holder 73 are described below.

As described with reference to FIG. 4, the toner container frame 70 includes the bottle holder 72, the cap holder 73, and the insertion portion 71. The user holds the handle part 33*d* and installs the toner container 32Y into the toner container frame 70, with the long axis of the toner container 32Y horizontally, through the insertion portion 71 with the cap 34Y forming the leading end of the toner container 32Y. The toner container 32Y inserted through the insertion opening 71Y slides on the bottle receiving face 72*a* (see also FIGS. 34 and 35) of the bottle holder 72 and is pressed to the cap holder 73.

Figure 33:
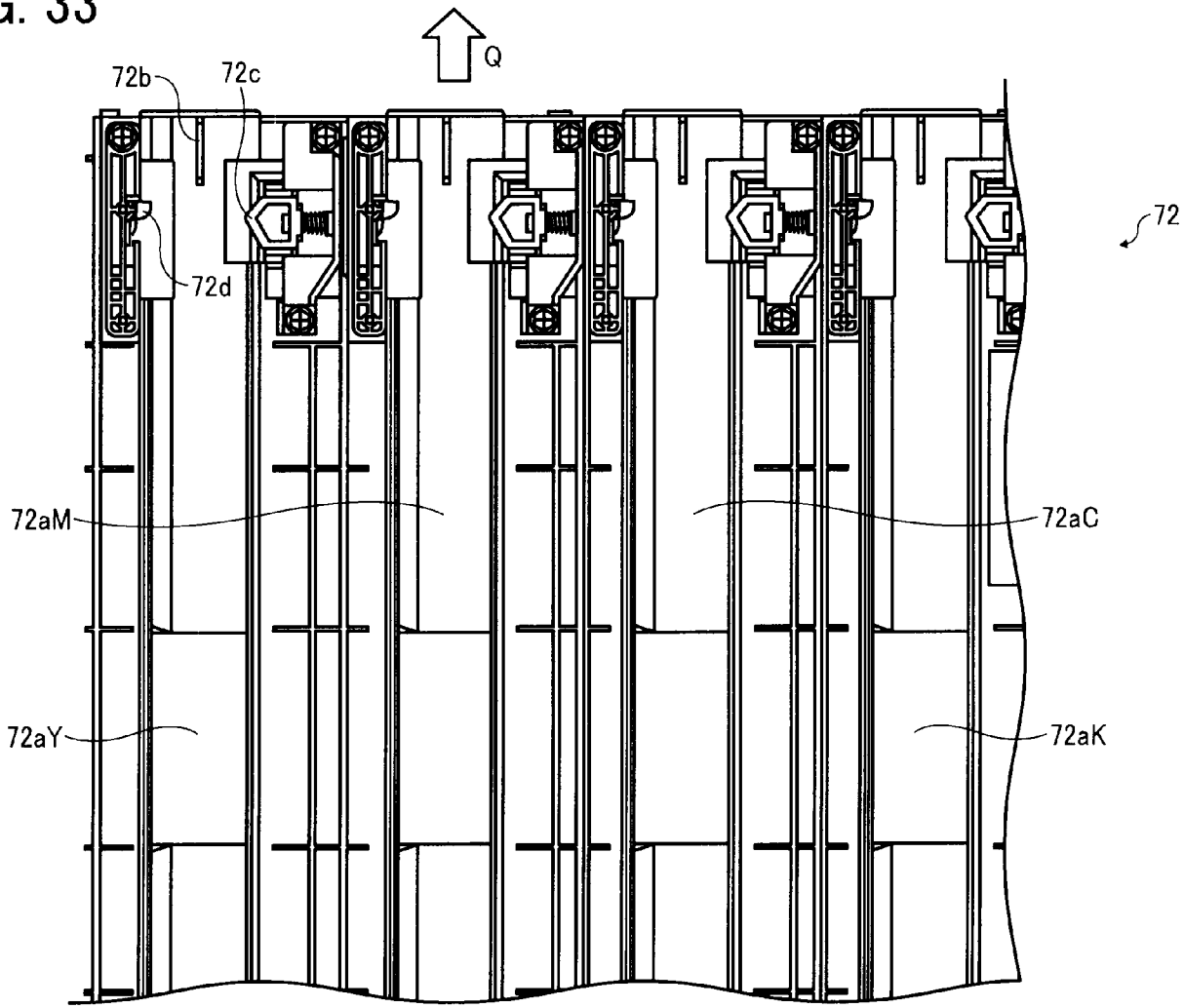
FIG. 33 is a top view illustrating the bottle holder in the toner container frame shown in FIG. 32.

Herein, with reference to FIGS. 32 and 33, the bottle receiving faces 72*a*Y, 72*a*M, 72*a*C, and 72*a*K for respective colors are formed in the bottle holder 72, and the toner containers 32Y 32M, 32C, and 32K are inserted into the corresponding portions of the bottle holder 72 in the direction indicated by arrow Q shown in FIGS. 32 and 33. Further, in FIG. 37, the bottle holders 73Y, 73M, 73C, and 73K for respective colors are formed in the cap holder 73, and, when the toner containers 32Y, 32M, 32C, and 32K are inserted into the toner container frame 70 in the direction indicated by arrow Q shown in FIGS. 32 and 33, the caps 34Y, 34M, 34C, and 34K are held in position not to rotate by the respective cap holders 73Y, 73M, 73C, and 73K.

Referring to FIGS. 32 through 36, the bottle holder 72 of the toner container frame 70 further includes, for each color, a torsion coil spring 72*f* in addition to the bottle receiving face 72*a*, the bottom projection 72*b*, the pressing member 72*c*, the pressure receiving member 72*d*, and the compression spring 72*e*.

The bottle receiving face 72*a* serves as a slide face on which the toner container 32 slides when the toner container 32 is installed into or released from the toner container frame 70 and also functions as a holder to hold the rotary container body 33 after the toner container 32Y is fully set.

Referring to FIG. 33, the bottom projection 72*b* that is a trapezoidal rib, projecting from the bottle receiving face 72*a*, is disposed on the downstream side in the insertion direction of the toner container 32Y. As described above with reference to FIG. 21, the bottom projection 72*b* is for pushing up the stopper release member 34*d*21 of the shutter 34*d* in conjunction with insertion of the toner container 32Y into the toner container frame 70, thereby disengaging the stoppers 34*d*22 from the contact faces 34*n*5. That is, the bottom projection 72*b* enables the shutter 34*d* to open the toner outlet W.

Figure 36:
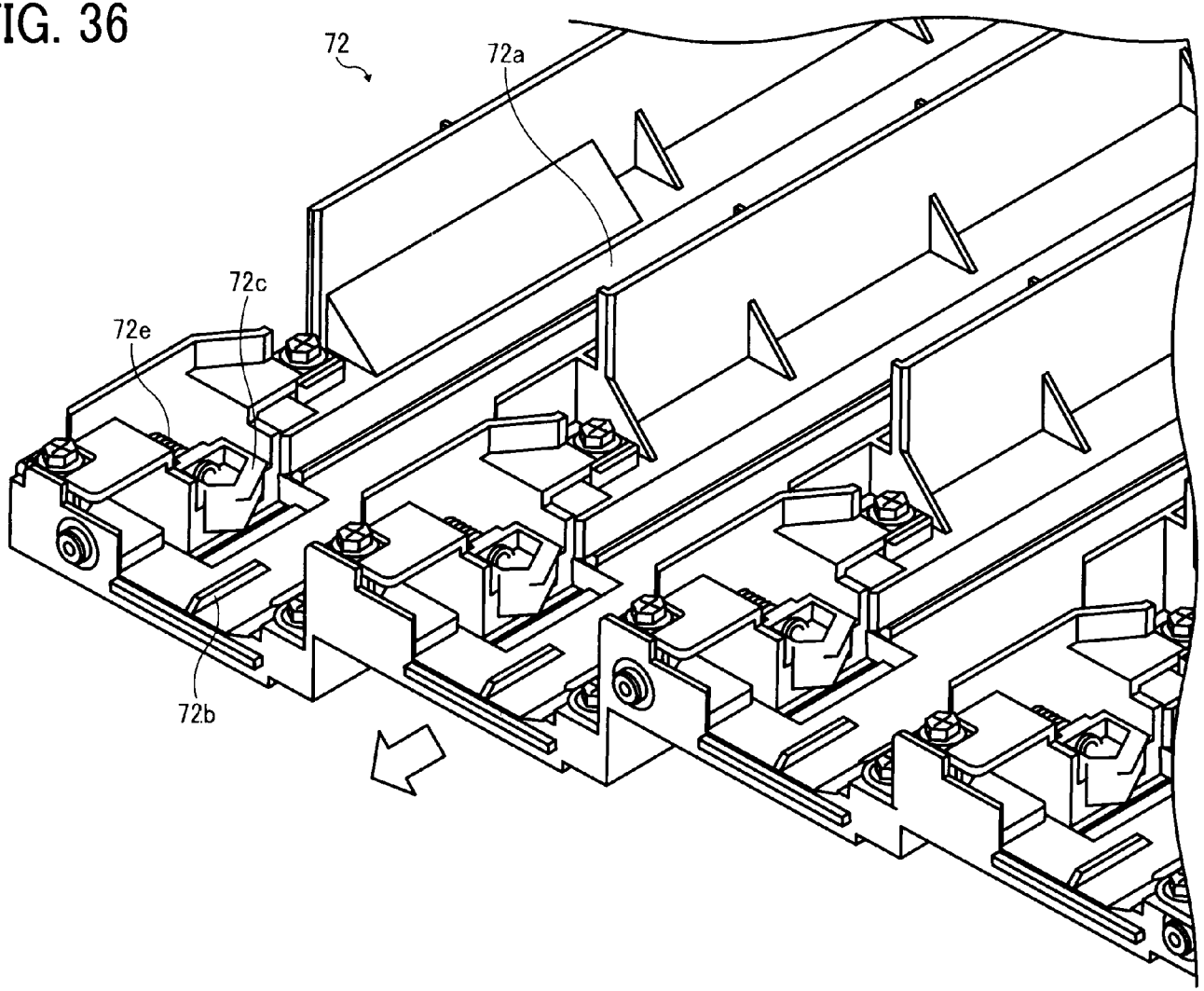
FIG. 36 is yet another enlarged perspective view illustrating the head portion of the bottle holder.
Figure 37:
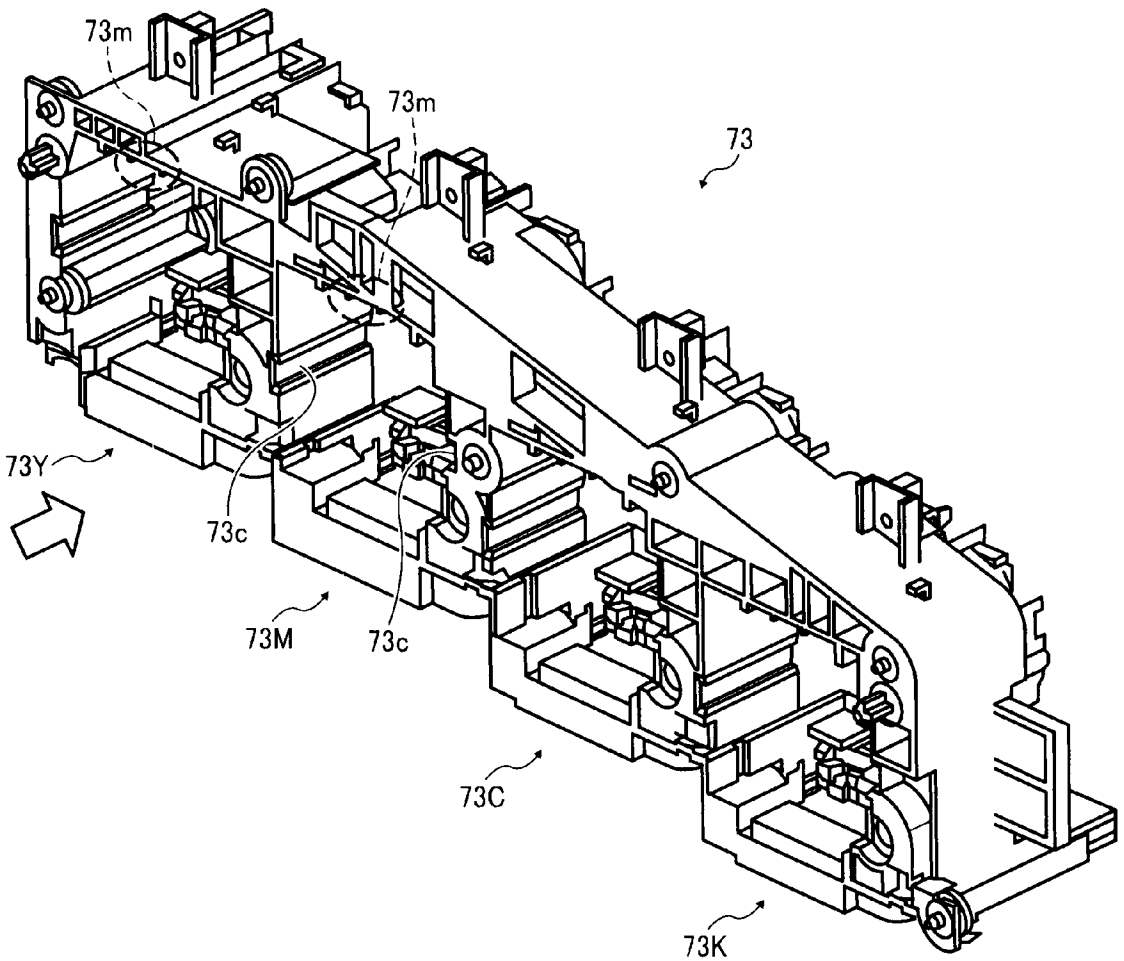
FIG. 37 is a perspective view illustrating a cap holder in the toner container frame.

Referring to FIG. 33, the pressing member 72*c* is provided on the right sidewall of the bottle holder 71*a* and disposed on the downstream side in the direction of insertion of the toner container 32Y. As shown in FIGS. 34 and 36, a tip of the pressing member 72*c* is mountain-shaped or trapeziform, and a base portion of the pressing member 72*c* opposite the trapeziform tip is connected to one end of the compression spring 72*e*. The pressing member 72*c* is biased leftward in FIG. 33 by the compression spring 72*e*.

Figure 35:
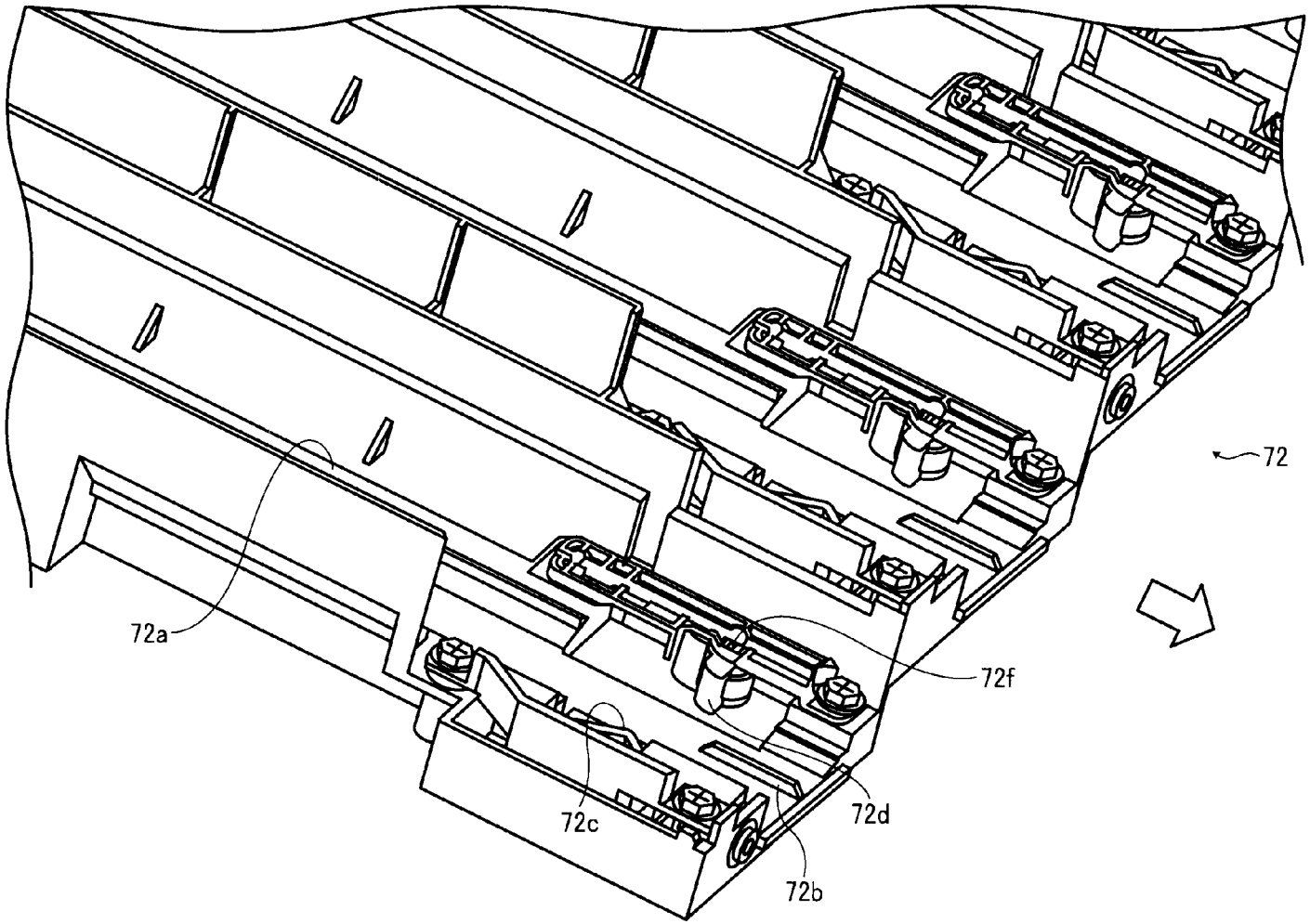
FIG. 35 is another enlarged perspective view illustrating the head portion of the bottle holder.

By contrast, in FIG. 33, the pressure receiving member 72*d* is provided on the left side wall of the bottle receiving face 72*a* facing the pressing member 72*c* and is positioned on the downstream side in the direction of insertion of the toner container 32Y. As shown in FIG. 35, the pressure receiving member 72*d* is curved into a reversed V shape whose valley portion faces the lower right in FIG. 33, and the torsion coil spring 72*f* is connected to the valley portion. The pressure receiving member 72*d* can pivot around a shaft in which the coil portion of the torsion coil spring 72*f* in inserted.

The position of the cap 34Y is determined with the pressing member 72*c* and the pressure receiving member 72*d* configured as described above just before the cap 34Y is inserted into the cap holder 73 in installation of the toner container 32Y into the toner container frame 70. More specifically, the cap 34Y is pressed leftward in FIG. 33 by the pressing member 72*c* while the pressed rail 34*n*2 (see FIG. 15) of the cap 34Y engages the pressing member 72*c*. Then, while the pressure receiving face 34*n*3 (see FIG. 14) slides on the pressure receiving member 72*d*, the pressure receiving member 72*d* receives the pressing force exerted by the pressing member 72*c* pressing the cap 34Y, and the position of the cap 34Y in the bottle holder 72 can be determined laterally (short side direction) in FIG. 33.

With reference to FIGS. 37 through 41, the cap holder 73 of the toner container frame 70 includes the main reference pin 73*a*, the sub-reference pin 73*b*, the projections 73*m*, the pair of lateral grooves 73*c*, the pair of shutter retainers 73*d*, the toner supply opening 73*w* surrounded by the wall 73*w*1, an escape portion 73*k*, the antenna 73*e* dedicated for the RFID chip 35, and the driving gear 81.

As described above with reference to FIG. 14, the main reference pin 73*a* and the sub-reference pin 73*b* are respectively fitted into the primary positioning hole 34*a* and the secondary positioning hole 34*b*. Thus, the position of the cap 34Y in the cap holder 73 is determined.

Figure 41:
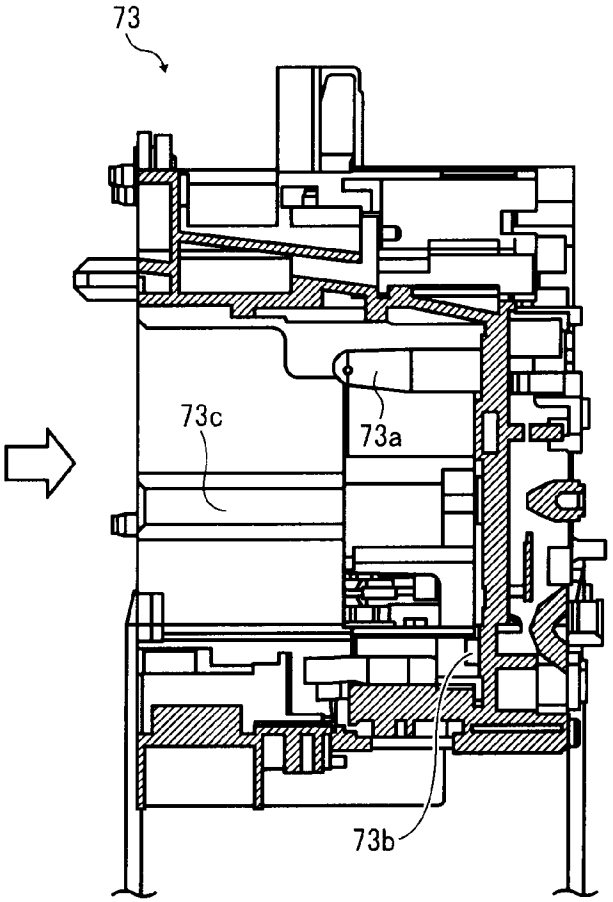
FIG. 41 is a cross sectional view illustrating the cap holder.
Figure 40:
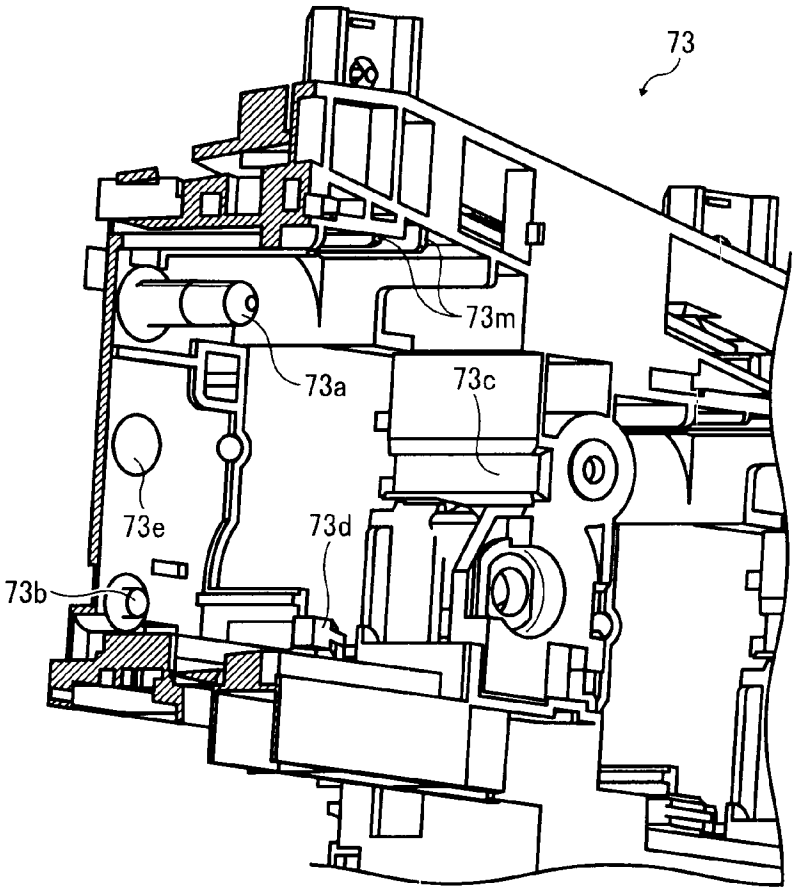
FIG. 40 is a perspective view illustrating an interior of the cap holder.

Herein, with reference to FIG. 41, the main reference pin 73*a* is longer than the sub-reference pin 73*b* in the longitudinal direction. The reference plane as bases of the pins 73*a* and 73*b* are on the same plane. In addition, the tip portion of the main reference pin 73*a* is tapered. Thus, the cap 34Y can be smoothly inserted into the cap holder 73 in the longitudinal direction in installation of the toner container 32Y into the container fame 70.

In addition, the projections 73*m* engage the first engaging member 34*e* and the second engaging member 34*f* formed in the cap 34Y to restrict the movement the toner container 32Y. While the cap 34Y is inserted into or released from the cap holder 73, the horizontal position of the cap 34Y is restricted by the first engaging member 34*e* and the second engaging members 34*f* engaging the projections 73*m*. In addition, in the state in which the cap 34Y is set in to the cap holder 73, the horizontal position of the cap 34Y is restricted.

In addition, the lateral grooves 73*c* engage the lateral protrusions 34*c* (second restriction member) formed in the cap 34Y of the toner container 32Y. With this configuration, while the cap 34Y is installed into the cap holder 73, the position of the cap 34Y in the rotational direction is restricted by the two lateral protrusions 34*c* (second restriction members) engaging the lateral grooves 73*c* (shown in FIG. 38) of the cap holder 73.

Next, operation of the shutter retainers 73*d* in conjunction with opening and closing of the shutter 34*d* is described in further detail below.

The shutter retainers 73*d* are disposed in the bottom portion of the cap holder 73 and upstream from the toner supply opening 73*w* in the installation direction of the toner container 32Y. The hoof-shaped shutter retainers 73*d* are arranged in the lateral direction in FIG. 43 facing each other. Each shutter retainer 73*d* is rotatable around the rotary shaft 73*d*3 in which a bias member 73*f* such as a torsion coil spring is provided. The first arm 73*d*1 is formed on one end of the shutter retainer 73*d* and the second arm 73*d*2 is formed on the other end thereof. As described above, when the shutter 34*d* opens or closes the toner outlet W in the toner container 32Y, the second arms 73*d*2 of the shutter retainers 73*d* hold the clamped portions 34*d*11, and the first arms 73*d*1 press against the vertical faces 34*s*, clamping the cap 34Y therebetween. Thus, the positions of the shutter 34*d* and the cap 34Y in the cap holder 73 are determined, facilitating smooth opening and closing movement of the shutter 34*d*.

FIGS. 43 through 45 illustrate movement of the shutter retainers 73*d* in conjunction with opening and closing operation of the shutter 34*d*.

Referring to FIG. 43, in the opening operation of the shutter 34*d*, initially, as the cap 34Y of the toner container 32Y is installed into the cap holder 73 in the direction indicated by arrow Q in FIG. 43, the first arms 73*d*1 contact the outer vertical surface 34*s* of the projection members 34*m*, and the second arms 73*d*2 contact the clamped portions 34*d*11.

Referring to FIG. 44, when the toner container 32Y is further inserted into the toner container frame 70, because the vertical faces 34*s* of the cap 34Y press the first arms 73*d*1 of the shutter retainers 73*d*, the shutter retainers 73*d* in contact with the vertical faces 34*s* rotate around the rotation shaft 73*d*3 as indicated by arrow O shown in FIG. 43. Then, the second arms 73*d*2 engage the engagement walls 34*d*11*a*

(shown in FIG. 26) of the clamped portion 34*d*11 of the shutter 34*d* and hold the side walls 34*d*11*c* of the clamped portions 34*d*11.

Subsequently, the shutter 34*d* contacts the wall 73*w*1 surrounding the toner supply opening 73*w* (see FIG. 38), and is interposed between the wall 73*w*1 and the second arms 73*d*2. Thus, the movement of the shutter 34*d* in the cap holder 73 is restricted. That is, the shutter 34*d* does not move absolutely in the longitudinal direction. The toner container 32Y, however, is moved further in the direction of insertion; the shutter 34*d* moves relative to the toner container 32Y in the opening direction. More specifically, as shown in FIG. 45, moving to the side of the bottle body 33Y relatively to the toner container 32Y, the shutter 34*d* opens the toner outlet W. At this time, as shown in FIG. 45, because the shutter 34*d* opens the toner outlet W while the first arms 73*d*1 hold the vertical faces 34*s* on both sides of the cap 34Y and the second arms 73*d*2 engage the clamped portions 34*d*11 of the shutter 34*d*, the positions of the shutter 34*d* and the cap 34Y in the cap holder 73 ca be determined. Thus, the shutter 34*d* can move smoothly.

By contrast, in removal of the toner container 32Y from the toner container frame 70, the above-described processes are performed in reverse. That is, as the shutter 34*d* closes the toner outlet W, the shutter retainers 73*d* move from the position shown in FIG. 45 to that shown in FIG. 44 and further to that shown in FIG. 43.

As described above, in the present embodiment, because the projecting portions 34*m* are provided to make the vertical faces 34*s* clamped between the first arms 73*d*1 in the direction of insertion (upward in FIG. 44) longer, the timing at which the shutter retainers 73*d* (second arms 73*d*2) release the vertical faces 34*s* (clamped portions 34*d*11) can be delayed from when the shutter retainers 73*d* completely close the shutter 34*d* in removal of the toner container 32Y from the toner container frame 70. More specially, until the shutter 34*d* fully closes the toner outlet W (moves relatively to the position shown in FIG. 44 from that shown in FIG. 45), the first arms 73*d*1 can keep holding the vertical faces 34*s* of the projection portions 34*m* and the second arms 73*d*2 can keep holding the clamped portions 34*d*11 of the shutter 34*d*, preventing the shutter retainer 73*d* from rotating in the direction indicated by arrow P in FIG. 44 (to the position shown in FIG. 43) by extending the vertical faces 34*s* to project upward in FIG. 44, forming the projection portions 34*m*.

In other words, if the vertical faces 34*s* do not project (upward in FIG. 44) and are shorter, the first arms 73*d*1 release the vertical faces 34*s* earlier than in the configuration shown in FIGS. 43 through 45, letting the shutter retainers 73*d* to rotate earlier in the direction indicated by arrow P shown in FIG. 44. Accordingly, the second arms 73*d*2 release the clamped portions 34*d*11 of the shutter 34*d*, and the shutter 34*d* cannot complete closing the toner outlet W.

Figure 39:
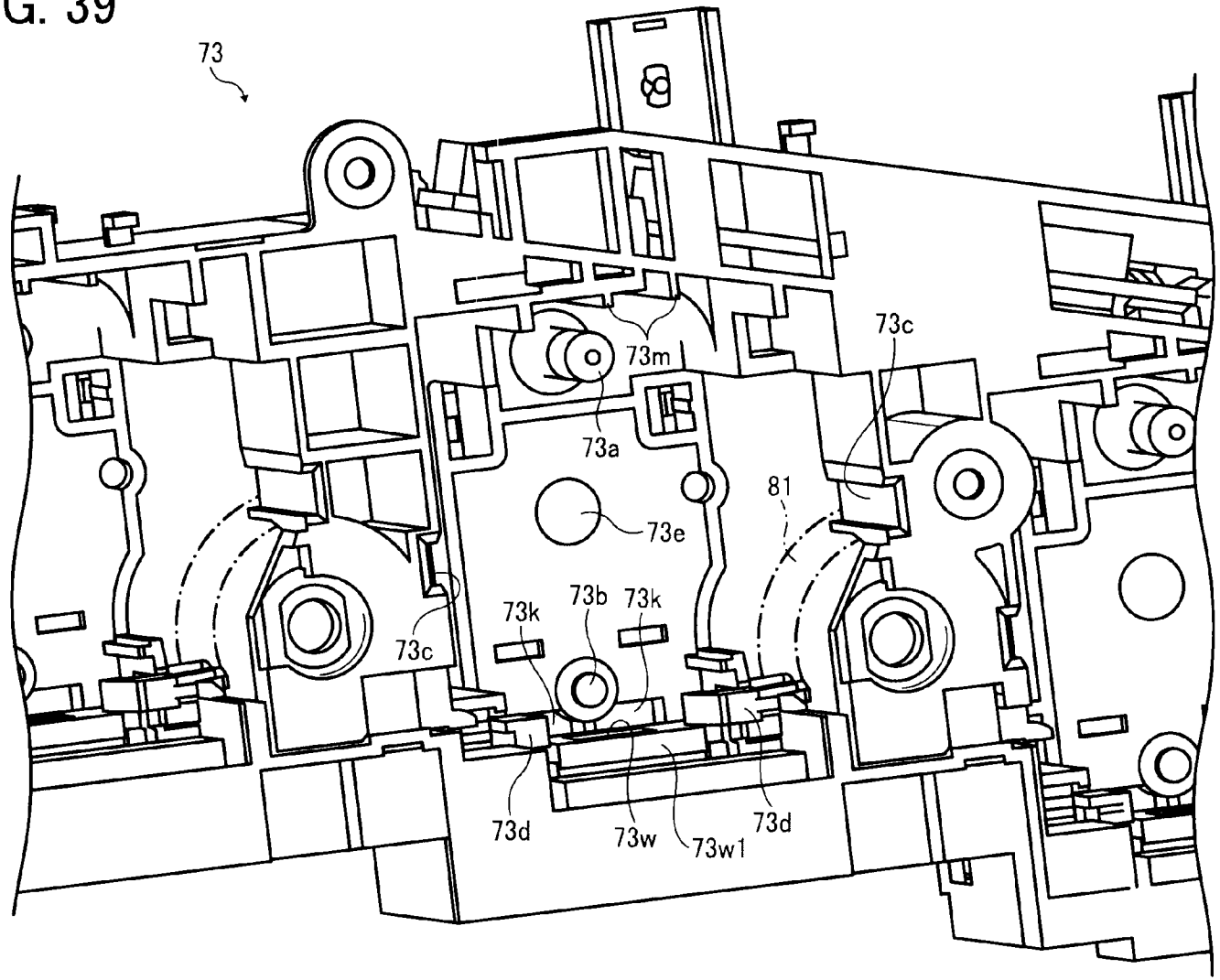
FIG. 39 is another enlarged perspective view illustrating of the cap holder.

By contrast, in the present embodiment, because the cap 34Y includes the projection portions 34*m*, the toner container 32Y is not released from the image forming apparatus before the shutter 34*d* fully closes the toner outlet W. It is to be noted that, as shown in FIGS. 38 and 39, escape portions 73*k* (holes or concave portions) are formed at positions facing the projection portions 34*m* in the inner surface of the cap holder 73 so that the projection portions 34*m* do not hit the inner wall of the cap holder 73.

Next, with reference to FIGS. 46A through 46D, states of the cap holder 73 and bottle holder 72 relating to the cap 34Y in insertion of the toner container 32Y into the toner container frame 70 are described below.

Initially, the cap 34Y slides on the bottle receiving face 72*a* and is held by the pressing member 72*c* as well as pressure-receiving member 72*d*. Thus, immediately before the cap 34Y is inserted into the cap holder 73, jolting of the cap 34Y can be restricted.

Figure 46A:
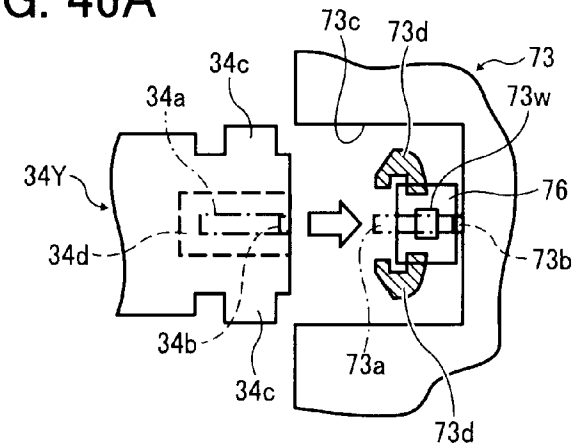
FIGS. 46A through 46D are schematic diagrams illustrating states of respective portions in the cap holder in relation to the installation of the toner container.
Figure 46B:
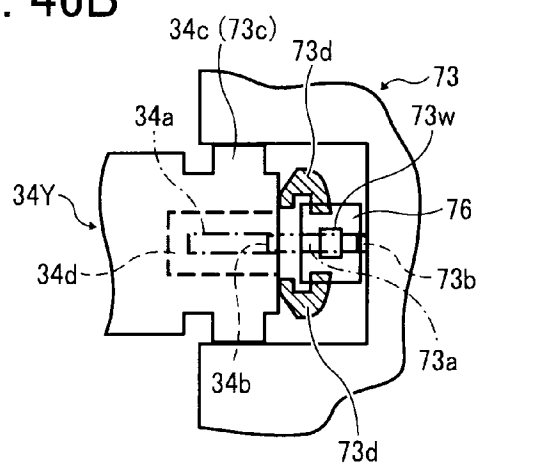
Figure 46C:
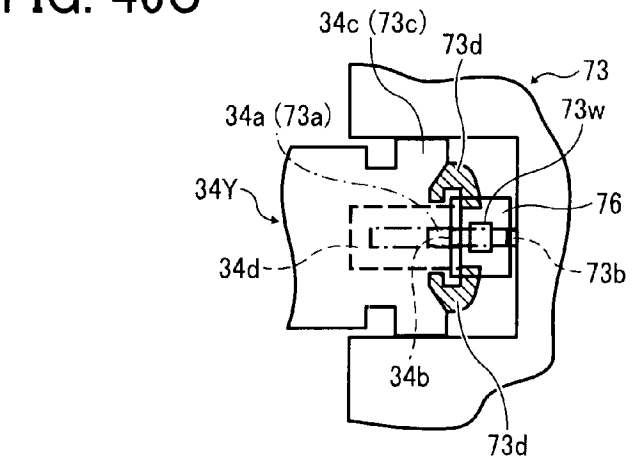
Figure 46D:
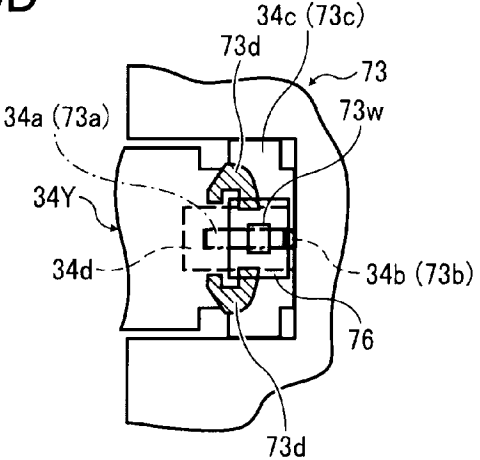

Subsequently, the first engaging member 34*e* and the second engaging members 34*f* engage the projections 73*m*, and the lateral protrusions 34*c* are fitted into the lateral grooves 73*c*, thus fixing the position of the cap 34Y in the lateral direction and vertical direction in the cap holder 73 (from the state shown in FIG. 46A to that shown in FIG. 46B). Subsequently, as shown in FIG. 46C, the main reference pin 73*a* of the cap holder 73 is fitted into the primary positioning hole 34*a* of the cap 34Y, and then the sub-reference pin 73*b* is fitted into the secondary positioning hole 34*b* of the cap 34Y. Thus, step-by-step positioning of the cap 34Y in the cap holder 73 is completed.

In addition, while the positioning is performed (before engagement between the sub-reference pin 73*b* and the secondary positioning hole 34*b* is completed), the bottom projection 72*b* disengages the stoppers 34*d*22 (see FIG. 29) of the shutter 34*d* from the contact faces 34*n*5 of the shutter container 34*n* in the cap 34Y, and the shutter retainers 73*d* determine the position of the shutter 34*d* and the cap 34Y in the cap holder 73 (the state shown in FIG. 46C). In this state, the shutter 34*d* opens the toner outlet W. Additionally, before the engagement between the secondary positioning hole 34*b* and the sub-reference pin 73*b* is completed, the rim (wall) 72*w*1 surrounding the toner outlet W of the cap 34Y slides on the seal member 76 surrounding the toner supply opening 73*w* in the cap holder 73. Then, the toner outlet W thus opened in the cap 34Y communicates with the toner supply opening 73*w* in the cap holder 73; the cap 34Y of the toner container 23Y is fully set in the cap holder 73 in the toner container holder 70 (the state shown in FIG. 46D). At this time, the gear 33*c* of the container body 33Y engages the driving gear 81 in the image forming apparatus 100, and the RFID chip 35 of the cap 34Y is disposed at the position suitable for communication with the antenna 73*e* in the image forming apparatus 100.

As described above, in the present embodiment, in installing the toner container 32Y in the toner container frame 70, because the position of shutter 34*d* of the cap 34Y in the cap holder 73 is determined by the shutter retainers 73*d*, the shutter 34*d* can be prevented from tilting when opening the toner outlet W.

In addition, in the installation of the toner container 32Y, after the main positioning with the main reference pin 73*a* of the cap holder 73 fitted into the primary positioning hole 34*a* of the cap 34Y is finished, the shutter retainers 73*d* determine the position of the shutter 34*d* in the cap holder 73, after which the sub-positioning with the sub-reference pin 73*b* of the cap holder 73 fitted into the secondary positioning hole 34*b* of the cap 34Y is finished. Therefore, the positions of the shutter 34*d* and cap 34Y can be corrected before the sub-positioning is completed.

In addition, before the main positioning of the cap 34Y using the main reference pin 73*a* fitted into the primary positioning hole 34*a* is completed, the lateral position as well as vertical position of the cap 34Y are restricted by the lateral protrusions 34*c* of the cap 34Y, fitted into the lateral grooves 73*c* in the cap holder 73, and the like; the cap 34Y can be smoothly positioned in the cap holder 73.

Further, after the shutter retainers 73*d* determine the position of the shutter 34*d* and the cap 34Y in the cap holder 73, the seal member 76 surrounding the toner supply opening 73*w* slides on the rim 34*r* surrounding the toner outlet W in the cap 34Y, after which the sub-reference pin 73*b* is fitted in the secondary positioning hole 34*b* of the cap 34Y. Therefore, the position of the shutter 34*d* of the cap 34Y can be corrected without receiving the sliding resistance from the seal member 76.

Moreover, in the present embodiment, the shutter retainers 73*d* are provided close to not the main reference pin 73*a* but the sub-reference pin 73*b*, which can facilitate the positional correction of the shutter 34*d* and the cap 34Y in the cap holder 73 by the shutter retainers 73*d*.

Additionally, in removing the toner container 32Y from the toner container frame 70, after the sub-reference pin 73*b* of the cap holder 73 is released from the secondary positioning hole 34*b* of the cap 34Y, the main reference pin 73*a* is kept fitted in the primary positioning hole 34*a* of the cap 34Y until the shutter 34*d* is fully closed. Therefore, the shutter 34*d* can be prevented from tilting when closing the toner outlet W.

It is to be noted that, as shown in FIG. 42, the seal member 76 is provided around the toner supply opening 73*w* in the cap holder 73 to prevent the leakage of toner between the opening toner outlet W in the cap 34Y and the toner supply opening 73*w* in the cap holder 73 as described above. Therefore, when the cap 34Y is set in the cap holder 73, a reaction force, which is an upward force in FIG. 28, due to the elastic deformation of the seal member 76 is exerted on the cap 34Y. However, as shown in FIG. 27, in the cap 34Y according to the present embodiment, the primary positioning hole 34*a* that engages the main reference pin 73 is formed just above the toner outlet W, at the position on which the reaction force by the seal member 76 is exerted. Therefore, floating and tilt of the cap 34Y caused by the reaction force can be reduced.

Further, referring to FIG. 28, in the cap 34Y according to the present embodiment, the primary positioning hole 34*a* that engages the main reference pin 73*a* is disposed in the ceiling portion, farthest in the vertical direction from the toner outlet W connected to the toner supply opening 73*w*. Therefore, even if backlash is present in the engagement between the main reference pin 73*a* and the primary positioning hole 34*a*, causing the cap 34Y to tilt, the tilt of the cap 34Y is less likely to cause the positional deviation of the toner outlet W relative to the toner supply opening 73*w* in the cap 34Y compared with a configuration in which the primary positioning hole 34*a* is closer to the toner outlet W.

As described above, in the image forming apparatus 100 according to the present embodiment, except opening and closing the main body cover 110, with a single action of moving the toner container 32Y in the longitudinal direction while holding the handle part 33*d*, insertion or removal of the toner container 32Y as well as opening or closing the shutter 34*d* relative to the toner outlet W can be completed because the shutter 34*d* can be moved in conjunction with that action.

In addition, in the toner container 32Y according to the present embodiment, because the toner outlet W opens downward and has a relatively large opening area, the toner can be discharged from the toner outlet W directly under its own weight.

Further, because the toner container 32Y is installed not from above but from the front side of the toner container frame 70 (image forming apparatus 100) therein, design flexibility in layout above the toner container frame 70 can be enhanced. For example, even when a scanner (document reader) is positioned just above the toner supply device 60, the workability in installation and removal of the toner container 32Y is not degraded.

In addition, because the toner container 32Y is installed in the image forming apparatus 100 with its long side horizontal, the toner capacity of the toner container 32Y can be increased, reducing frequency of replacement of the toner container 32Y, without sacrificing the design flexibility in vertical layout of the entire the image forming apparatus 100.

Figure 47:
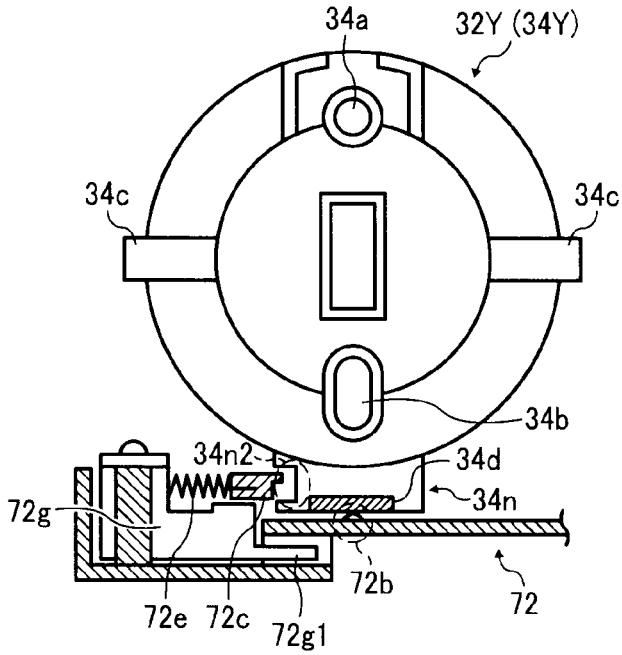
FIG. 47 is a front view of the toner container that illustrates engagement between the pressing member of the toner container frame and the pressed rail formed in the cap in installation of the toner container.
Figure 48:
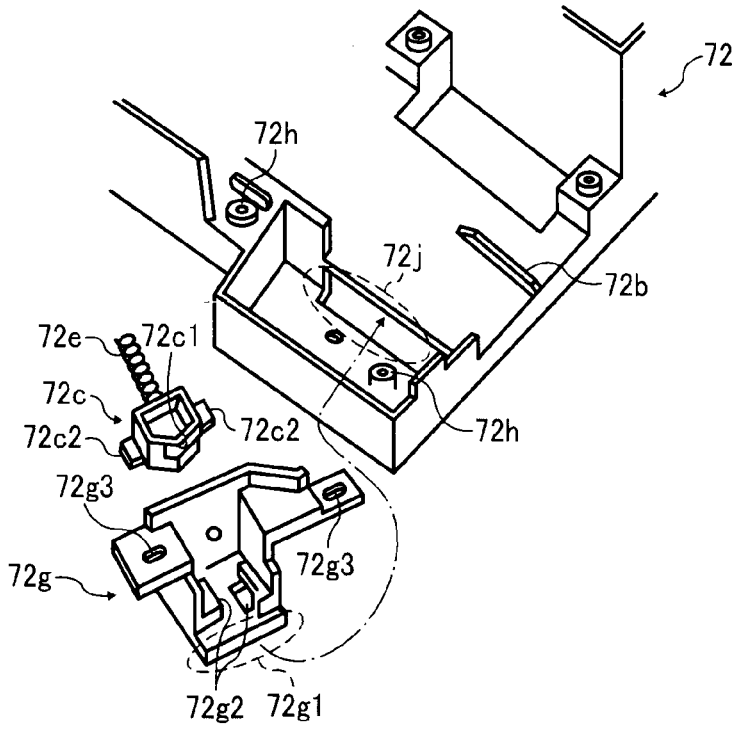
FIG. 48 is an exploded perspective view illustrating a holder for holding the pressing member.
Figure 49:
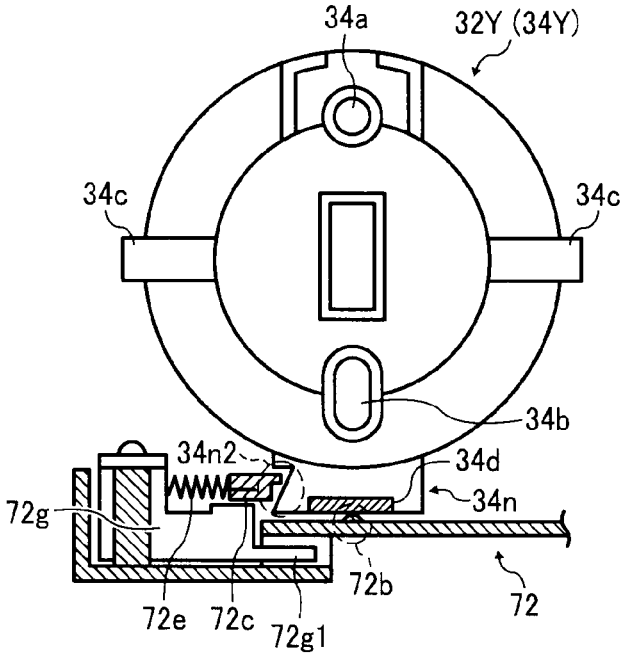
FIG. 49 is a front view of a toner container according to a variation and illustrates engagement between the pressing member of the toner container frame and the pressed rail of the cap.

Referring to FIGS. 47 and 48, specific features of the toner supply assembly according to the present embodiment are described below.

FIG. 47 is a front view of the toner container 32Y and illustrates engagement between the pressing member 72*c* and the pressed rail 34*n*2 in installation of the toner container 32Y. FIG. 48 is an exploded perspective view illustrating a holder 72*g* for holding the pressing member 72*c*. It is to be noted that, in FIG. 47, the pressing member 72*c* is disengaged from the pressed rail 34*n*2 for ease of understanding.

As described above with reference to FIGS. 32 through 36, the bottle holder 72 of the toner container frame 70 according to the present embodiment includes the bottom projection 72*b* and the pressing member 72*c*.

The bottom projection 72*b* is a trapezoid rib projecting upward from the bottle receiving face 72*a* on which the toner container 32Y slides. In conjunction with the horizontal installation of the toner container 32Y, the bottom projection 72*b* contacts the stopper release member 34*d*21 (shown in FIGS. 18 and 21) of the shutter 34*d* and applies an external force thereto from below.

Referring to FIGS. 33 and 36, the pressing member 72*c* engages the pressed rail 34*n*2 (shown in FIG. 15) formed on the side of the cap 34Y and pushes the cap 34Y from the side in conjunction with the horizontal installation of the toner container 32 for determining the position of the cap 34Y relative to the bottle receiving face 72*a* (slide surface) in the short side direction (lateral direction in FIG. 37), perpendicular to the installation direction of the toner container 32Y.

As shown in FIG. 47, the bottle holder 72 (toner container frame 70) is configured so that, while the bottom projection 72*b* is in contact with the stopper release member 34*d*21 (shutter 34*d*) in conjunction with the installation or removal of the toner container 32Y, the pressing member 72*c* engages pressed rail 34*n*2 to restrict the upward movement of the cap 34Y (toner container 32Y).

More specifically, referring to FIG. 36, in the bottle holder 72, the pressing member 72*c* and the bottom projection 72*b* are adjacent to each other in the insertion direction of the toner container 32Y. Further, the bottom projection 72*b* and the pressing member 72*c* are disposed so that, in the installation of the toner container 32Y, the bottom projection 72*b* comes into contact with the stopper release member 34*d*21 after a projecting portion 72*c*1 (shown in FIG. 48) of the pressing member 72*c* engages the pressed rail 34*n*2.

As described above, in conjunction with opening operation of the shutter 34*d*, the stopper release member 34*d*21 is pushed up by the bottom projection 72*b*. At that time, if the cap 34Y is moved up together with the stopper release member 34*d*21 (shutter 34*d*) thus receiving the upward force, the deformable portion 34*d*2 of the shutter 34*d* does not deform elastically, and the stoppers 34*d*22 are not disengaged from the contact face 34*n*5. Consequently, the shutter 34*d* fails to open the toner outlet W.

Therefore, in the present embodiment, while the cap 34Y (toner container 32Y) receives the upward force, the lower projection (lower inner face) of the pressed rail 34*n*2 contacts the bottom portion of the pressing member 72*c*, thereby inhibiting the cap 34Y (toner container 32Y) from moving up. This configuration can ensure that the shutter 34*d* opens the toner outlet W in conjunction with the installation of the toner container 32Y.

Further, referring to FIGS. 47 and 48, in the present embodiment, the pressing member 72*c* and the compression spring 72*e* to push the pressing member 72*c* in the short side direction (in FIG. 47, to the right) are held by the holder 72*g*. More specifically, referring to FIG. 48, the pressing member 72*c* includes the projecting portion 72*c*1, functioning as a point of action to bias the cap 34Y in the short side direction, and a sliding engagement portion 72*c*2 that engages an engaged portion 72*g*2 of the holder 72*g* slidably in the short side direction.

The holder 72*g* includes an inserted portion 72*g*1 inserted into an insertion recess 72*j* formed in the bottle holder 72, the engaged portion 72*g*2 to hold the pressing member 72*c*, and a slot 72*g*3 screwed to a boss 72*h* of the bottle holder 72.

The sliding engagement portion 72*c*2 engages the engaged portion 72*g*2 with the compression spring 72*e* interposed between an inner wall of the holder 72*g* and the pressing member 72*c*, and thus the pressing member 72*c* is attached to the holder 72*g*. Then, the holder 72*g* holding the pressing member 72*c* and the compression spring 72*e* is moved in the direction indicated by broken arrow shown in FIG. 48, and the inserted portion 72*g*1 is inserted laterally in the insertion recess 72*j* formed in a side face of the insertion recess 72*j*. In this state, the holder 72*g* is screwed to the boss 72*h* via the slot 72*g*3, thus determining the position of the holder 72*g* (pressing member 72*c*) relative to the bottle holder 72.

Thus, the insertion recess 72*j* of the bottle holder 72 engages the inserted portion 72*g*1 of the holder 72*g* that is placed on the slide surface or bottle receiving face 72*a* of the bottle holder 72. In this state, the insertion recess 72*j* serves as a movement limiter to restrict the upward movement of the holder 72*g*.

Providing the insertion recess 72*j* serving as the movement limiter in the bottle holder 72 can secure restricting the upward movement of the holder 72*g* even when the screw connecting the holder 72*g* to the boss 72*h* gets loose. More specifically, when the stopper release member 34*d*21 (shutter 34*d*) receives the upward force from the bottom projection 72*b* of the bottle holder 72 as the shutter 34*d* opens the toner outlet W, the cap 34Y (toner container 32Y) itself is urged upward. However, the bottom portion of the pressing member 72*c* contacts the lower inner face of the pressed rail 34*n*2, and the inserted portion 72*g*1 of the holder 72*g* engages the insertion recess 72*j*, thereby inhibiting the cap 34Y (toner container 32Y) from moving up. This configuration can secure the opening and closing of the toner outlet W by the shutter 34*d* in conjunction with the installation and removal of the toner container 32Y.

It is to be noted that the surface of the pressed rail 34*n*2 (indicated by broken circle shown in FIG. 49) formed in the toner container 32Y (cap 34Y) that contacts the pressing member 72*c* may be sloped to approach the pressing member 72*c* as the position in that surface descends. The sloped face of the pressed rail 34*n*2 can secure restriction of the upward movement of the holder 72*g*. More specifically, when the stopper release member 34*d*21 (shutter 34*d*) receives the upward force from the bottom projection 72*b* of the bottle holder 72 in conjunction with opening operation of the shutter 34*d*, the cap 34Y (toner container 32Y) itself is urged upward. The bottom portion of the pressing member 72*c*, however, can reliably contact the sloped face of the pressed rail 34*n*2, and a downward repulsive force acts on the cap 34Y. Thus, the cap 34Y (toner container 32Y) is prevented from moving up. This configuration can secure the opening and closing of the toner outlet W by the shutter 34*d* in conjunction with the installation and removal of the toner container 32Y.

Figure 50:
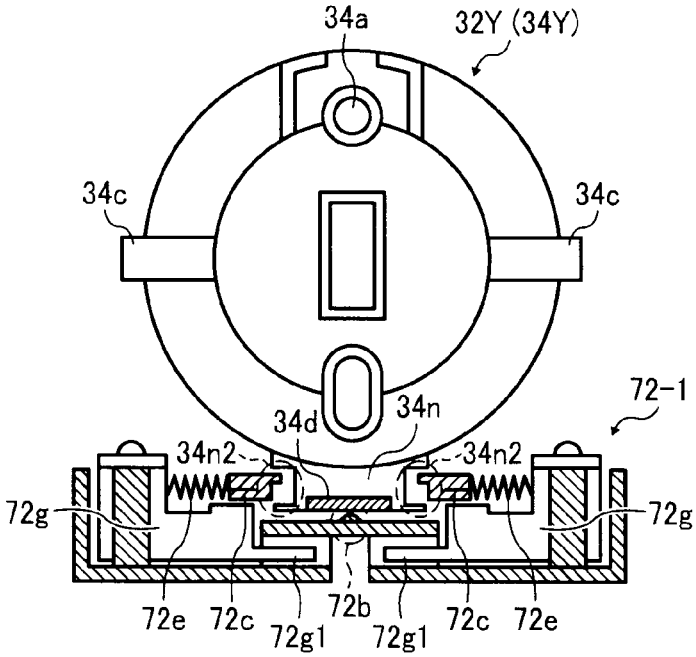
FIG. 50 is a front view of a toner container according to another variation and illustrates engagement between the pressing member and the pressed rail of the cap.

FIG. 50 illustrates a cap holder 72-1 as a variation of the first embodiment.

As shown in FIG. 50, one pressing member 72*c* and one pressed rail 34*n*2 may be disposed on each lateral side in the short side direction (lateral direction in FIG. 50), with the shutter 34*d* interposed therebetween. That is, the toner supply assembly may include two pressing members 72*c* each supported by the holder 72*g* and a pair of pressed rails 34*n*2, described with reference to FIG. 47. The pressed rails 34*n*2 are provided on the respective lateral sides in the short side direction.

This configuration can secure restriction of the upward movement of the cap 34Y (toner container 32Y), which is urged upward when the shutter 34*d* relatively moves in the direction to open the toner outlet W.

As described above, in the present embodiment, the toner container 32Y includes the deformable portion 34*d*2 that deforms elastically with reference to the connection between the shutter body 34*d*1 and the deformable portion 34*d*2, and the deformable portion 34*d*2 includes the stoppers 34*d*22 to restrict the movement of the shutter 34*d* in the opening direction and the stopper release member 34*d*21 to release the stoppers 34*d*22. When the bottom projection 72*b* is in contact with the stopper release member 34*d*21 of the shutter 34*d* in installation of the toner container 32Y in the toner container frame 70, the pressing member 72*c* engages the pressed rail 34*n*2 of the toner container 32Y, restricting the upward movement of the cap 34Y. With this configuration, the shutter 34*d* for opening and closing the toner outlet W does not move unintentionally when the toner container 32Y is not installed in the apparatus but moves reliably to open or close the toner outlet W in conjunction with the installation or removal of the toner container 32Y.

Second Embodiment

Figure 51:
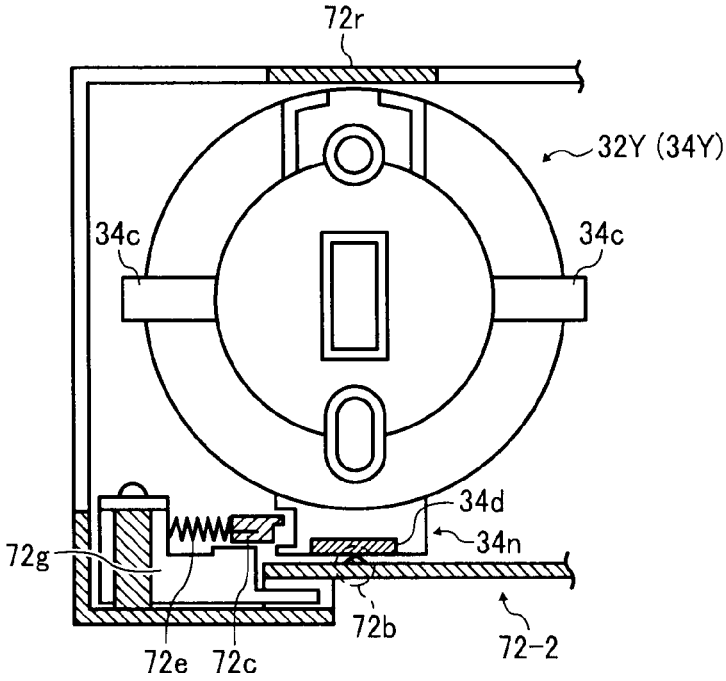
FIG. 51 is a front view of a toner container according to another embodiment and that illustrates engagement between the pressing member of the container frame and the pressed rail of the cap in installation of the toner container.
Figure 52:
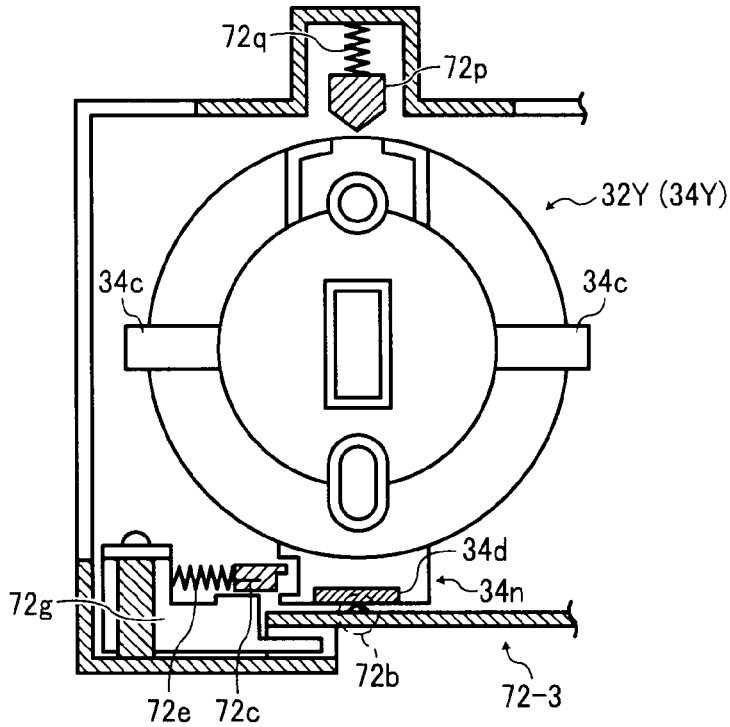
FIG. 52 is a front view of a toner container according to a variation and illustrates engagement between the pressing member of the container frame and the pressed rail of the cap in installation of the toner container.

Referring to FIGS. 51 and 52, a toner supply assembly according to a second embodiment is described below.

FIG. 51 is a front view of a bottle holder 72-2 according to the second embodiment and illustrates engagement between the pressing member 72*c* and the pressed rail 34*n*2 when the toner container 32Y is being inserted into the toner container frame 70. FIG. 51 corresponds to FIG. 47 in the first embodiment. FIG. 52 is a front view of a bottle holder 72-3 as a variation of the second embodiment. FIG. 52 corresponds to FIG. 47 in the first embodiment and illustrates engagement between the pressing member 72*c* and the pressed rail 34*n*2 when the toner container 32Y is being inserted into the toner container frame 70.

In the toner supply assembly according to the present embodiment, the configuration of the bottle holder 72-2 is different from that of the bottle holder 72 in the first embodiment.

Referring to FIG. 51, the bottle holder 72-2 includes the bottom projection 72*b*, the pressing member 72*c*, and the like similarly to the bottle holder 72 according to the first embodiment. When the bottom projection 72*b* is in contact with the stopper release member 34*d*21 (shutter 34*d*) in the installation of the toner container 32Y, the pressing member 72*c* engages the pressed rail 34*n*2, restricting the upward movement of the cap 34Y (toner container 32Y).

Further, referring to FIG. 51, the bottle holder 72-2 according to the second embodiment includes a ceiling (upper wall) 72*r* that contacts an upper circumferential surface of the cap 34Y, restricting the upward movement of the cap 34Y when the bottom projection 72*b* is in contact with the stopper release member 34*d*21 (shutter 34*d*) in conjunction with the installation of the toner container 32Y into the apparatus.

This configuration can secure restriction of the upward movement of the cap 34Y (toner container 32Y), which is urged upward when the shutter 34*d* relatively moves in the direction to open the toner outlet W. More specifically, even if the cap 34Y is urged upward as the shutter 34*d* moves in the opening direction, the bottom portion of the pressing member 72*c* that contacts the lower inner face of the pressed rail 34*n*2 as well as the ceiling 72*r* that contacts the upper circumferential surface of the cap 34Y can inhibit the cap 34Y (toner container 32Y) from moving up.

It is to be noted that, as in the variation shown in FIG. 52, a second pressing member 72*p* may be provided to push down the cap 34Y at a position above the bottom projection 72*b* pushing the stopper release member 34*d*21 when the bottom projection 72*b* is in contact with the stopper release member 34*d*21 (shutter 34*d*) in conjunction with the installation of the toner container 32Y. More specifically, a spring 72*q* such as a compression spring is provided on the ceiling of the bottle holder 72-3, and the second pressing member 72*p* is biased downward by the spring 72*q*.

This configuration can also secure restriction of the upward movement of the cap 34*d* (toner container 32Y), which is urged upward when the shutter 34*d* relatively moves in the direction to open the toner outlet W. More specifically, even if the cap 34*d* is urged upward when the shutter 32Y moves in the opening direction, the bottom portion of the pressing member 72*c* that contacts the lower inner face of the pressed rail 34*n*2 as well as the second pressing member 72*p* that pushes down the cap 34Y can inhibit the cap 34Y (toner container 32Y) from moving up.

As described above, also in the present embodiment, the toner container 32Y includes the deformable portion 34*d*2 that deforms elastically with reference to the connection between the shutter body 34*d*1 and the deformable portion 34*d*2, and the deformable portion 34*d*2 includes the stoppers 34*d*22 to restrict the movement of the shutter 34*d* in the opening direction and the stopper release member 34*d*21 to release the stoppers 34*d*22 similarly to the first embodiment. When the bottom projection 72*b* is in contact with the stopper release member 34*d*21 of the shutter 34*d* in installation of the toner container 32Y in the toner container frame 70, the pressing member 72*c* engages the pressed rail 34*n*2 of the toner container 32Y, restricting the upward movement of the cap 34Y. With this configuration, the shutter 34*d* for opening and closing the toner outlet W does not move unintentionally when the toner container 32Y is not installed in the apparatus but moves reliably to open or close the toner outlet W in conjunction with the installation or removal of the toner container 32Y.

It is to be noted that, although the toner containers 32Y contain one-component developer, that is, only toner, in the above-described embodiments, alternatively, the toner containers 32 may contain two-component developer consisting essentially of toner and carrier to be used in image forming apparatuses that use two-component developer. In such a configuration, effects similar to those attained in the above-described embodiments can be also attained. Further, features of the above-described embodiments are not limited to toner supply assemblies but may adapt to powder containers of other types and container mounts therefore.

Further, at least one of the components of the image forming unit 6 may be held together with the photoreceptor drum 1 in a common unit casing as a process cartridge removably insertable into the main body of the image forming apparatus. In such a configuration, effects similar to those attained in the above-described embodiments can be also attained.

Additionally, in the above-described embodiments, the container body 33Y is rotatable to convey the toner contained therein toward the opening A. By contrast, the container body 33Y may be held in the toner container frame 70 not to rotate together with the cap 34Y, and a toner conveyance member may be provided inside the container body 33Y to convey the toner toward the opening A. The toner conveyance member may be a conveyance coil or multiple blades provided on a shaft and rotated in a predetermined direction by a gear independent of the container body 33Y.

The above-described aspects of the present embodiments can adapt to such stationary toner containers, and similar effects can be attained.

In addition, in the above-described embodiments, with reference to FIG. 1, entire toner conveyance route formed of the toner tank 61, the toner conveyance portion in which the toner conveyance screw 62 is provided, and the toner supply tube 64 in the toner supply device 60Y is H-shaped when viewed in a direction orthogonal to the surface of the paper on which FIG. 1 is drawn and N-shaped when viewed from the backside of that paper. In addition, the toner conveyance portion in which the toner conveyance screw 62 is provided is provided immediately above the corresponding image forming unit (process cartridge) 6 and above the insertion opening through which the process cartridge is inserted into the image forming apparatus 100. Further, the upstream sides of the toner container 32, the toner tank 61, and the toner conveyance portion in which the toner conveyance screw 62 is provided for each color are positioned above not the image forming unit 6 for that color but the adjacent image forming unit 6 (in FIG. 1, on the left). With this configuration, in tandem-type image forming apparatuses including multiple image forming units arranged in parallel, when the image forming units 6 (process cartridge) are installed in or removed from the image forming apparatus 100, the image forming units 6 and the toner supply devices 60 do not interfere with each other. Therefore, the vertical length in the image forming apparatus from the toner containers 32 to the image forming units 6 can be reduced, and fluctuations in the amount of toner supplied to the respective development devices 5 can be reduced.

Numerous additional modifications and variations are possible in light of the above teachings. It is therefore to be understood that, within the scope of the appended claims, the disclosure of this patent specification may be practiced otherwise than as specifically described herein. The number, positions, and shapes of the above-described components are not limited to those described in each of the above-described exemplary embodiments and may be any other number, position, and shape suitable for practicing the present disclosure.

What is claimed is:

1. A toner supply assembly to supply toner to an image forming apparatus, the toner supply assembly comprising:

a toner container mount provided in the image forming apparatus and including a bottom slide surface on which the toner container slides, a bottom projection projecting from the bottom slide surface, and a pressing member positioned in a lateral side portion of the toner container mount; and a toner container removably installable in the toner container mount horizontally, the toner container including, a cylindrical container body having an opening in one end thereof from which toner contained in the container body is discharged, a cap, into which the end of the container body having the opening is inserted, having a toner outlet to discharge the toner discharged from the container body vertically downward, the cap including a shutter guide rail, a contact portion, and a pressed rail provided on a lateral side of the cap to be pressed by the pressing member of the toner container mount, the pressed rail, and a shutter, slidably held in a bottom portion of the cap, to move horizontally along an outer surface of the cap to open and close the toner outlet, the shutter including a shutter body to engage the shutter guide rail of the cap and slide along the shutter guide rail for opening and closing the toner outlet, and a deformable portion united with the shutter body to deform vertically about a connection portion between the shutter body and the deformable portion, wherein the deformable portion of the shutter includes a stopper to contact the contact portion of the cap for inhibiting the shutter from moving in a direction to open the toner outlet relative to the toner container, and a stopper release projection projecting downward from a bottom surface of the shutter and pressed from below by the bottom projection formed in the toner container mount in conjunction with installation of the toner container, wherein, when the bottom projection formed in the toner container mount presses the stopper release projection, the deformable portion of the shutter deforms upward, disengaging the stopper from the contact portion of the cap, wherein the pressing member of the toner container mount engages and pushes from the lateral side the pressed rail of the cap in conjunction with installation of the toner container to determine a position of the cap in the direction perpendicular to an installation direction in which the toner container is installed relative to the slide bottom surface of the toner container mount, and wherein, while the stopper of the shutter is in contact with the contact portion of the cap, the pressing member of the toner container mount engages the pressed rail of the cap to inhibit the cap from moving upward.

2. The toner supply assembly according to claim 1, wherein the shutter guide rail and the pressed rail of the cap extend in the installation direction in which the toner container is installed, the contact portion of the cap is positioned in a bottom portion of the cap and extends substantially perpendicular to the installation direction, and the deformable portion of the shutter is adjacent to the shutter body in the installation direction.

3. The toner supply assembly according to claim 1, wherein the toner container mount further comprises:

a compression spring to bias the pressing member provided in the toner container mount in the direction perpendicular to the installation direction of the toner container;

a holder to hold the pressing member and the compression spring, removably attached to the toner container mount; and a holder engagement portion to engage the holder and to inhibit the holder from moving upward.

4. The toner supply assembly according to claim 3, wherein the holder engagement portion is a recess formed in a lateral side face of the toner container mount, and the holder to hold the pressing member and the compression spring is laterally inserted into the holder engagement portion.

5. The toner supply assembly according to claim 1, wherein the pressed rail formed in the cap of the toner container comprises a contact surface pushed by the pressing member of the toner container mount, the contact surface sloped to approach the pressing member as a position in the contact surface descends.

6. The toner supply assembly according to claim 1, wherein the pressed rail is formed on each lateral side of the cap of the toner container, and the pressing member is provided in each lateral side portion of the toner container mount with the shutter interposed therebetween.

7. The toner supply assembly according to claim 1, wherein the toner container mount further comprises a ceiling portion positioned above the cap of the toner container to inhibit the toner container from moving upward when the bottom projection provided in the toner container mount is in contact with the stopper release projection in conjunction with installation of the toner container.

8. The toner supply assembly according to claim 1, wherein the toner container mount further comprises a bias member positioned above the toner container to inhibit the toner container from moving upward when the bottom projection provided in the toner container mount is in contact with the stopper release projection in conjunction with installation of the toner container.

9. An image forming apparatus comprising:

an image forming unit to form a toner image on a sheet of recording media; and the toner supply assembly according to claim 1.

10. A toner supply assembly to supply toner to an image forming apparatus, the toner supply comprising:

a toner container mount including a bottom slide surface, a bottom projection projecting from the bottom slide surface, and a pressing member positioned in a lateral side portion of the toner container mount; and a toner container removably installable in the toner container mount horizontally and including:

a toner outlet from which toner is discharged downward from the toner container, a shutter including a shutter body to open and close the toner outlet and a stopper to inhibit the shutter body from moving in a direction to open the toner outlet relative to the toner container and to allow the shutter body to move upon receiving an external force from below, a stopper release member projecting downward from the shutter, and a rail provided on a lateral side of the toner container;

wherein the bottom projection projecting from the bottom slide surface applies the external force to the stopper in conjunction with installation of the toner container, wherein, in conjunction with the installation of the toner container, the pressing member engages the rail of the toner container and pushes from the lateral side of the toner container to determine a position of the toner container in a direction perpendicular to an installation direction in which the toner container is installed relative to the bottom slide surface, and wherein, while the bottom projection projecting from the bottom slide surface is in contact with the stopper release member in conjunction with installation of the toner container, the pressing member of the toner container mount engages the rail to inhibit the toner container from moving upward.

11. The toner supply assembly according to claim 10, wherein the rail of the toner container comprises a contact surface to be pushed by the pressing member of the toner container mount, a tip of the contact surface is sloped such that a lower front of the tip is more forward on the toner container than an upper rear of the tip.

* * * * *